US010092082B2

(12) United States Patent
Edgar et al.

(10) Patent No.: US 10,092,082 B2
(45) Date of Patent: Oct. 9, 2018

(54) APPARATUS AND METHOD FOR THE PRECISION APPLICATION OF COSMETICS

(75) Inventors: Albert D. Edgar, Austin, TX (US); Thomas E. Rabe, Baltimore, MD (US); David C. Iglehart, Austin, TX (US); Rick B. Yeager, Austin, TX (US)

(73) Assignee: TCMS Transparent Beauty LLC, Austin, TX (US)

( * ) Notice: Subject to any disclaimer, the term of this patent is extended or adjusted under 35 U.S.C. 154(b) by 995 days.

(21) Appl. No.: 12/129,624

(22) Filed: May 29, 2008

(65) Prior Publication Data

US 2009/0025747 A1 Jan. 29, 2009

Related U.S. Application Data

(60) Provisional application No. 60/940,548, filed on May 29, 2007, provisional application No. 60/944,526,
(Continued)

(51) Int. Cl.
*A45D 44/00* (2006.01)
*B05B 5/16* (2006.01)
(Continued)

(52) U.S. Cl.
CPC ..... *A45D 44/005* (2013.01); *B05B 5/1691* (2013.01); *B41J 3/36* (2013.01);
(Continued)

(58) Field of Classification Search
CPC ... G06T 2207/30088; G06T 2219/2012; G06T 5/50; G06T 7/0081; A61M 35/00;
(Continued)

(56) References Cited

U.S. PATENT DOCUMENTS 4,190,056 A 2/1980 Tapper et al.
4,401,122 A 8/1983 Clark
(Continued)

FOREIGN PATENT DOCUMENTS

CN 101287607 B 9/2010
DE 202004003148 U1 4/2005
(Continued)

OTHER PUBLICATIONS

Chujit Jeamsinkul, "MasqueArray Automatic Makeup Selector/Applicator", Nov. 11, 1998, Rochester Institute of Technology, all pages pertinent.*
(Continued)

*Primary Examiner* — Elmer Chao
(74) *Attorney, Agent, or Firm* — Fish & Richardson P.C.

(57) ABSTRACT

One or more reflectance modifying agent (RMA) such as a pigmented cosmetic agent is applied selectively and precisely with a controlled spray to human skin according to local skin reflectance or texture attributes. One embodiment uses digital control based on the analysis of camera images. Another embodiment, utilizes a calibrated scanning device comprising a plurality of LEDs and photo diode sensors to correct reflectance readings to compensate for device distance and orientation relative to the skin. Ranges of desired RMA application parameters of high luminance RMA, selectively applied to middle spatial frequency features, at low opacity or application density are each significantly different from conventional cosmetic practice. The ranges are complementary and the use of all three techniques in combination provides a surprisingly effective result which preserves natural beauty while applying a minimum amount of cosmetic agent.

16 Claims, 34 Drawing Sheets

Related U.S. Application Data filed on Jun. 18, 2007, provisional application No. 60/944,527, filed on Jun. 18, 2007, provisional application No. 60/944,528, filed on Jun. 18, 2007, provisional application No. 60/944,529, filed on Jun. 18, 2007, provisional application No. 60/944,531, filed on Jun. 18, 2007, provisional application No. 60/944,532, filed on Jun. 18, 2007.

(51) Int. Cl.

| | |
|---|---|
| ***B41J 3/36*** | (2006.01) |
| ***B41J 3/407*** | (2006.01) |
| ***B41J 3/44*** | (2006.01) |
| *A45D 33/02* | (2006.01) |

(52) U.S. Cl.

CPC ..... *B41J 3/4073* (2013.01); *B41J 3/44* (2013.01); *A45D 33/02* (2013.01); *A45D 2044/007* (2013.01); *A45D 2200/057* (2013.01)

(58) Field of Classification Search

CPC ..... A61M 11/00; A01K 11/005; A61N 2007/0034; A61Q 1/08; A46B 2200/1046

USPC ..... 600/407, 473–479; 132/320; 434/100; 606/186, 9, 17

See application file for complete search history.

(56) References Cited

U.S. PATENT DOCUMENTS 4,628,356 A 12/1986 Spillman et al.
4,771,060 A 9/1988 Nakagawa
4,807,991 A 2/1989 Carew
4,882,492 A 11/1989 Schlager
5,027,817 A 7/1991 John
5,156,479 A * 10/1992 Iizuka ..... 401/151
5,241,468 A 8/1993 Kenet
5,268,166 A 12/1993 Barnett
5,431,911 A 7/1995 Reynolds
5,836,872 A 11/1998 Kenet et al.
5,931,166 A 8/1999 Weber et al.
6,021,344 A 2/2000 Lui et al.
6,067,996 A 5/2000 Weber et al.
6,111,653 A 8/2000 Bucknell et al.
6,122,042 A 9/2000 Wunderman et al.
6,151,031 A 11/2000 Atkins et al.
6,208,749 B1 3/2001 Gutkowicz et al.
6,250,927 B1 6/2001 Narlo
6,286,517 B1 9/2001 Weber et al.
6,292,277 B1 9/2001 Kikinis
6,293,284 B1 9/2001 Rigg
6,295,737 B2 10/2001 Patton et al.
6,312,124 B1 11/2001 Desormeaux
6,341,831 B1 1/2002 Weber et al.
6,385,487 B1 5/2002 Henley
6,436,127 B1 * 8/2002 Anderson et al. ..... 607/89
6,477,410 B1 11/2002 Henley
6,487,440 B2 11/2002 Deckert et al.
6,502,583 B1 1/2003 Utsugi
6,543,893 B2 4/2003 Desormeaux
6,554,452 B1 4/2003 Bourn et al.
6,575,751 B1 6/2003 Lehmann et al.
6,578,276 B2 6/2003 Patton et al.
6,641,578 B2 11/2003 Mukai
6,706,035 B2 3/2004 Cense et al.
6,719,467 B2 4/2004 Hess et al.
6,810,130 B1 10/2004 Aubert et al.
7,027,619 B2 4/2006 Pavlidis et al.
7,233,693 B2 6/2007 Momma
7,369,692 B2 5/2008 Shirai
7,382,400 B2 6/2008 Sablak
7,433,102 B2 10/2008 Takahashi
7,602,942 B2 10/2009 Bazakos et al.
7,890,152 B2 2/2011 Edgar et al.
8,026,942 B2 9/2011 Payonk
8,027,505 B2 9/2011 Edgar et al.
8,182,425 B2 5/2012 Stamatas
8,231,292 B2 7/2012 Rabe
8,384,793 B2 2/2013 Ciuc
8,464,732 B2 6/2013 Wong
8,582,830 B2 11/2013 Edgar
8,610,767 B2 12/2013 Uzenbajakava
8,695,610 B2 4/2014 Samain
8,899,242 B2 12/2014 Wong
8,915,562 B2 12/2014 Edgar
8,942,775 B2 1/2015 Edgar
8,977,389 B2 3/2015 Witchell
9,247,802 B2 2/2016 Edgar
9,277,799 B2 3/2016 Takaleh
9,333,156 B2 5/2016 Ito
9,449,382 B2 9/2016 Edgar
2001/0040982 A1 11/2001 Kim et al.
2002/0054714 A1 5/2002 Hawkins et al.
2002/0064302 A1 5/2002 Massengill
2002/0070988 A1 6/2002 Desormeaux
2002/0081003 A1 6/2002 Sobol
2002/0105662 A1 8/2002 Patton et al.
2002/0107456 A1 8/2002 Leveque
2002/0128780 A1 9/2002 De
2002/0155069 A1 10/2002 Pruche et al.
2002/0172419 A1 11/2002 Lin et al.
2002/0176926 A1 11/2002 Pletcher et al.
2003/0010083 A1 1/2003 Minnerop
2003/0045799 A1 3/2003 Bazin et al.
2003/0050561 A1 3/2003 Bazin et al.
2003/0053664 A1 3/2003 Pavlidis
2003/0053685 A1 3/2003 Lestideau
2003/0060810 A1 3/2003 Syrowicz et al.
2003/0062058 A1 4/2003 Utsugi
2003/0063102 A1 4/2003 Rubinstenn et al.
2003/0067545 A1 4/2003 Giron et al.
2003/0100837 A1 * 5/2003 Lys et al. ..... 600/476
2003/0108228 A1 6/2003 Garnier
2003/0130575 A1 7/2003 Desai
2003/0208190 A1 11/2003 Roberts et al.
2003/0223622 A1 12/2003 Simon et al.
2003/0229514 A2 12/2003 Brown
2004/0005086 A1 1/2004 Wolff et al.
2004/0007827 A1 1/2004 Hahn
2004/0073186 A1 4/2004 Cameron
2004/0078278 A1 * 4/2004 Dauga et al. ..... 705/26
2004/0125996 A1 7/2004 Eddowes et al.
2004/0170337 A1 9/2004 Simon et al.
2004/0174525 A1 9/2004 Mullani
2004/0179101 A1 9/2004 Bodnar
2004/0201694 A1 10/2004 Gartstein et al.
2004/0236229 A1 * 11/2004 Freeman et al. ..... 600/474
2004/0254546 A1 12/2004 Lefebvre
2004/0257439 A1 12/2004 Shirai
2004/0267189 A1 12/2004 Mavor et al.
2005/0004475 A1 1/2005 Giron
2005/0010102 A1 * 1/2005 Marchesini et al. ..... 600/408
2005/0019285 A1 1/2005 Lee
2005/0053628 A1 3/2005 Montanari et al.
2005/0053637 A1 3/2005 Ma Or et al.
2005/0063197 A1 3/2005 Nightingale
2005/0069208 A1 3/2005 Morisada
2005/0154382 A1 7/2005 Altshuler et al.
2006/0104507 A1 5/2006 John
2006/0153470 A1 7/2006 Simon et al.
2006/0228037 A1 10/2006 Simon et al.
2006/0228038 A1 10/2006 Simon et al.
2006/0228039 A1 10/2006 Simon et al.
2006/0228040 A1 10/2006 Simon et al.
2006/0282137 A1 12/2006 Nightingale
2007/0016078 A1 1/2007 Hoyt et al.
2007/0035815 A1 2/2007 Edgar et al.
2007/0047761 A1 3/2007 Wasilunas et al.
2007/0049832 A1 3/2007 Edgar et al.
2007/0134192 A1 6/2007 Shimizu
2007/0203413 A1 8/2007 Frangioni
2007/0255589 A1 11/2007 Rodriguez
2008/0192999 A1 8/2008 Edgar et al.

(56) References Cited

U.S. PATENT DOCUMENTS

| | | | |
|---|---|---|---|
| 2008/0193195 | A1 | 8/2008 | Edgar et al. |
| 2008/0194971 | A1 | 8/2008 | Edgar et al. |
| 2008/0219528 | A1 | 9/2008 | Edgar et al. |
| 2009/0025747 | A1 | 1/2009 | Edgar et al. |
| 2009/0209833 | A1 | 8/2009 | Waagen |
| 2009/0231356 | A1 | 9/2009 | Barnes et al. |
| 2010/0114265 | A1 | 5/2010 | Lechthaler |
| 2010/0139682 | A1 | 6/2010 | Edgar |
| 2010/0224205 | A1 | 9/2010 | Mitra |
| 2010/0224211 | A1 | 9/2010 | Rabe |
| 2011/0124989 | A1 | 5/2011 | Edgar et al. |
| 2011/0270200 | A1 | 11/2011 | Edgar et al. |
| 2012/0230562 | A1 | 9/2012 | Edgar |
| 2013/0149365 | A1 | 6/2013 | Rajagopal |
| 2013/0302078 | A1 | 11/2013 | Edgar |
| 2014/0050377 | A1 | 2/2014 | Edgar |
| 2015/0196109 | A1 | 7/2015 | Edgar |
| 2015/0237991 | A1 | 8/2015 | Edgar |
| 2015/0359315 | A1 | 12/2015 | Rabe |
| 2015/0359714 | A1 | 12/2015 | Rabe |
| 2017/0004635 | A1 | 1/2017 | Edgar |
| 2017/0256084 | A1 | 9/2017 | Iglehart et al. |

FOREIGN PATENT DOCUMENTS

| | | | |
|---|---|---|---|
| EP | 1184663 | A2 | 3/2002 |
| EP | 1210909 | A2 | 6/2002 |
| EP | 1304056 | A2 | 4/2003 |
| EP | 1495781 | A2 | 1/2005 |
| EP | 1677254 | A1 | 7/2006 |
| EP | 1763380 | A1 | 3/2007 |
| FR | 2810761 | B1 | 9/2003 |
| JP | 59171280 | U | 9/1984 |
| JP | 5281041 | A | 10/1993 |
| JP | 6201468 | A | 7/1994 |
| JP | 11019050 | A | 1/1999 |
| JP | 11019051 | A | 1/1999 |
| JP | 2000139846 | A | 5/2000 |
| JP | 2000331167 | A | 11/2000 |
| JP | 2001112722 | A | 4/2001 |
| JP | 2002263084 | A | 9/2002 |
| JP | 2003052642 | A | 2/2003 |
| JP | 2003057169 | A | 2/2003 |
| JP | 2003057170 | A | 2/2003 |
| JP | 2003513735 | X | 4/2003 |
| JP | 2003519019 | A | 6/2003 |
| JP | 2003210248 | A | 7/2003 |
| JP | 2002017689 | A1 | 10/2003 |
| JP | 2004501707 | A | 1/2004 |
| JP | 2004105748 | A | 4/2004 |
| JP | 2004315416 | A1 | 11/2004 |
| JP | 2004315426 | A | 11/2004 |
| JP | 2006271654 | A | 10/2006 |
| JP | 2007231883 | A | 9/2007 |
| JP | 2008526241 | A | 7/2008 |
| JP | 2008526284 | A | 7/2008 |
| RU | 2336866 | C2 | 10/2008 |
| WO | WO2001026735 | A1 | 4/2001 |
| WO | W02001049360 | A1 | 7/2001 |
| WO | WO2001077976 | A2 | 10/2001 |
| WO | WO2004028420 | A1 | 4/2004 |
| WO | WO2004091590 | A1 | 10/2004 |
| WO | WO2004095372 | A1 | 11/2004 |
| WO | WO2005123172 | A1 | 12/2005 |
| WO | WO2006008414 | A1 | 1/2006 |
| WO | W02006074881 | A1 | 7/2006 |
| WO | WO2007022095 | A1 | 2/2007 |

OTHER PUBLICATIONS

Age Spot_Definition of Age Spot by Medical Dictionary http://medical-dictionary.thefreedictionary.com/age+spot.*

Bruise_Definition of Bruise by Medical Dictionary http://medical-dictionary.thefreedictionary.com/bruise.*

Railan et al; Laser Treatment of Acne, Psoriasis, Leukoderma and Scars; Seminars in Cutaneous Medicine and Surgery; Dec. 2008; 285-291.

Chiu et al; Fractionated Photothermolysis: The Fraxel 1550-nm Glass Fiber Laser Treatment; Facial Plastic Surgery Clinics of North America (2007), vol. 15, Issue 2; May 2007, 229-237.

Cula et al; Bidirectional Imaging and Modeling of Skin Texture; IEEE Engineering of Medicine and Biology Society; Nov. 2004; 1-6.

Laubach et al; Effects of Skin Temperature on Lesion Size in Fractional Photothermolysis; Lasers in Surgery and Medicine; Jan. 2007; 14-18.

Bon et al; Quantitative and Kinetic Evolution of Wound Healing through Image Analysis; 2000 IEEE Transactions on Medical Imaging, vol. 19, No. 7; Jul. 2000; 767-772.

"Lehrstuhl für Optik 2004 Annual Report" Jun. 2005 (2005-2006), Lehrstuhl Fër Optik, Institute Für Optik, Information und Photonik, Max-Planck-Forschungsgruppe, Universität Erlangen-Nürnberg, Erlangen, Germany, XP002460048, 2 pages.

EPO Office Action in App. No. 06 801 295.4, dated Feb. 3, 2010, 3 pages.

Authorized Officer Nora Lindner, International Preliminary Report on Patentability and Written Opinion of the International Searching Authority for International Application No. PCT/US2006/031441, dated Feb. 12, 2008, 9 pages.

Russian Official Action (including translation) for Application No. 2008109234, dated Apr. 2, 2009, 7 pages.

EPO Office Action in Application No. 06 801 295.4, dated Jun. 10, 2008, 3 pages.

Authorized Officer Moritz Knupling, International Search Report for International Application No. PCT/US2006/031441, dated Dec. 7, 2007, 2 pages.

Authorized Officer Lars-Oliver Romich, International Search Report and the Written Opinion for International Application No. PCT/US2006/031441, dated Dec. 7, 2007, 14 pages.

Notification of the First Office Action (including translation) in Application No. 200680037564.6, dated Jul. 31, 2009, 7 pages.

Examiner's First Report in Application No. 2006279800, dated Feb. 2, 2011, 2 pages.

Russian Deputy Chief S.V. Artamonov, Decision on Grant Patent for Invention (including translation) in Application 2008109235, dated Feb. 19, 2009.

Authorized Officer Dorothee Mulhausen, International Preliminary Report on Patentability for International Application No. PCT/US2006/031657, dated Feb. 12, 2008, 7 pages.

Authorized Officer Laure ACQUAVIVA, Invitation to Pay Additional Fees and, where applicable, Protest Fees International Application No. PCT/US2008/053527, dated Jul. 7, 2008, 8 pages.

Examiner's First Report in Application No. 2006279652, dated Jan. 28, 2011, 2 pages.

Notification of the First Office Action (including translation) in Application No. 200680037560.8, dated Jul. 17, 2009, 8 pages.

EPO Office Action in Application No. 06 789 746.2, dated Apr. 3, 2009, 3 pages.

Authorized Officer Wolfhard Wehr, International Search Report for International Application No. PCT/US2006/031657, dated Dec. 20, 2006, 2 pages.

Authorized Officer Athina Nickitas-Etienne, International Preliminary Report on Patentability for International Application No. PCT/US2008/053640, dated Aug. 19, 2009, 5 pages.

Authorized Officer Michael Eberwein, International Search Report and Written Opinion for International Application No. PCT/US2008/053640, dated Jun. 3, 2008, 9 pages.

European Patent Office Action for Application No. 08 729 481.5, dated Aug. 23, 2010, 5 pages.

Authorized Officer Jens Clevorn, International Search Report for Application No. PCT/US2008/053528, dated Nov. 13, 2008, 4 pages.

Authorized Officer Jens Clevorn, International Preliminary Report on Patentability and Written Opinion of the International Searching Authority for Application No. PCT/US2008/053528, dated Aug. 11, 2009, 9 pages.

(56) References Cited

OTHER PUBLICATIONS

Notification of First Office Action for Application No. 200880009579.0, dated Jul. 14, 2010, 10 pages.
Authorized Officer Simin Baharlou, International Preliminary Report on Patentability and Written Opinion of the International Searching Authority for Application No. PCT/US2008/065168, dated Dec. 1, 2009, 8 pages.
Anonymous, "Circular Polarizer Films," Internet Article, [Online] 2005, http://www.optigrafix.com/circular.htm [retrieved on Sep. 5, 2008].
Authorized Officer Carlos Nicolas, International Search Report and Written Opinion for Application No. PCT/US2008/065168, dated Sep. 19, 2008, 13 pages.
Mike Topping et al., "The Development of Handy 1, A Robotic System to Assist the Severely Disabled," IOPRR '99, Sixth International Conference of Rehabilitation Robotics, Stanford, CA, Jul. 1-2, 1999, pp. 244-249.
Robot News, "Handy1-Rehabilitation robot for the severely disabled; helping you to eat and drink and brush and even do make-up!", posted on Apr. 3, 2006, http://robotnews.wordpress.com/2006/04/03/handy1-rehabiliation-robot-for-the-severely-disabledhelping-you-to-eat-and-drink-and-brush-and-even-do-make-up/, 6 pages.
Mike Topping, "An Overview of the Development of Handy 1, a Rehabilitation Robot to Assist the Severely Disabled" Journal of Intelligent and Robotic Systems, vol. 34, No. 3, 2002, pp. 253-263.
Notice of Reasons for Rejection for Application No. 2008-526241, dated Aug. 31, 2011, 7 pages.
Notification of the First Office Action (including translation) in Application No. 200880009069.3, dated Jul. 1, 2011, 8 pages.
EPO Office Action in App. No. 06 801 295.4, dated Oct. 10, 2011, 5 pages.
Cula O G et al., "Bidirectional Imaging and Modeling of Skin Texture," IEEE Transactions on Biomedical Engineering, IEEE Service Center, Piscataway, NJ, USA, vol. 51, No. 12, Dec. 1, 2004, pp. 2148-2159.
Second Examiner's Report in Application No. 2006279652, dated Nov. 3, 2011, 2 pages.
Examiner's First Report in Application No. 2008260040, dated Apr. 13, 2012, 2 pages.
Notice to File a Response in Application No. 10-2008-7006079, dated Aug. 6, 2012, 10 pages.
Notice of Reasons for Rejection for Application No. 2008-526284, dated Apr. 18, 2012, 10 pages.
Notification of the Second Office Action for Application No. 200880009579.0, dated Mar. 1, 2012, 4 pages.
Office Action for Application No. 2009148819, dated May 30, 2012, 7 pages.
Notification of the Third Office Action for Application No. 200880009579.0, dated Jan. 7, 2013, 8 pages.
Office Action for Korean Patent Application No. 10-2009-7019063, dated Mar. 24, 2014, 8 pages.
Examination Report for Canadian Patent Application No. 2,618,706, dated Jul. 31, 2014, 3 pages.
Weyrich et al., "Analysis of Human Faces using a Measurement-Based Skin Reflectance Model," Association for Computing Machinery, Inc. 2006, pp. 1-12 (1013-1024).
Donner et al., "A Layered, Heterogeneous Reflectance Model for Acquiring and Rendering Human Skin" ACM Transactions on Graphics, vol. 27, No. 5, Article 140, Publication date: Dec. 2008 pp. 1-12.
Examination Report for Canadian Patent Application No. 2,618,519, dated Jan. 16, 2015, 2 pages.
Examination Report for Australian Patent Application No. 2013200395, dated Feb. 5, 2015, 4 pages.
Examination Report for Canadian Patent Application No. 2,618,706, dated Jul. 30, 2015, 4 pages.
Examination Report for Canadian Patent Application No. 2,618,519, dated Jul. 9, 2015, 3 pages.
Patent Examination Report No. 1 for Australian Patent Application No. 2014200087, dated Jun. 30, 2015, 3 pages.
Examination Report for Canadian Patent Application No. 2,618,706, dated Jun. 17, 2016, 3 pages.
Examination Report for Indian Patent Application No. 5301/CHENP/2009, dated Jan. 19, 2017, 7 pages.
European Search Report for Application No. 11160161.3 dated Mar. 31, 2017, 4 pages.
European Examination Report for Application No. 11160161.3 dated Apr. 11, 2017, 6 pages.
Examination Report for European Application No. 08769826.2, dated Jul. 16, 2013, 6 pages.
Notice to File a Response in Application No. 10-2008-7006079, dated Jun. 25, 2013, 5 pages.
Notice to File a Response in Application No. 10-2008-7006041, dated Jan. 29, 2013, 10 pages.
Office Action for Japanese Patent Application No. 2009-549296, dated Apr. 30, 2013, 12 pages.
European Examination Report for Application No. 11160161.3 dated Mar. 22, 2018, 6 pages.

* cited by examiner

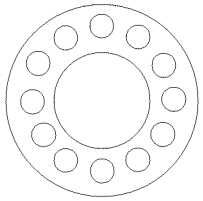
FIG 36A
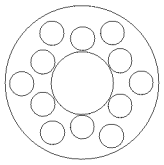
FIG 36B
FIG 36C
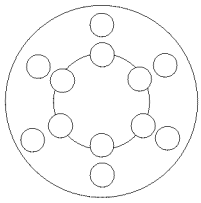
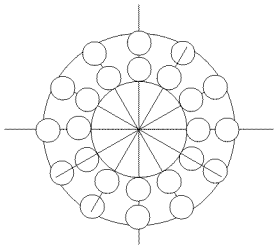
FIG 36D
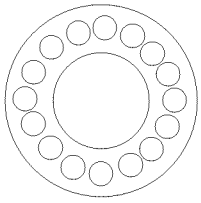
FIG 36E
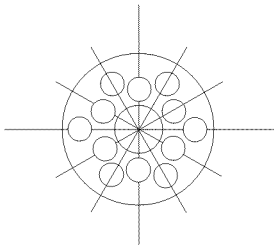
FIG 36F

APPARATUS AND METHOD FOR THE PRECISION APPLICATION OF COSMETICS

CROSS-REFERENCE TO RELATED APPLICATIONS

This patent application is related to U.S. Provisional Patent Application No. 60/940,548 filed May 29, 2007 for "Apparatus and method for the precision application of cosmetics" and claims the filing date of that Provisional application.

This patent application is related to

U.S. Provisional Patent Application No. 60/944,526 filed Jun. 18, 2007;

U.S. Provisional Patent Application No. 60/944,527 filed Jun. 18, 2007;

U.S. Provisional Patent Application No. 60/944,528 filed Jun. 18, 2007;

U.S. Provisional Patent Application No. 60/944,529 filed Jun. 18, 2007;

U.S. Provisional Patent Application No. 60/944,531 filed Jun. 18, 2007; and

U.S. Provisional Patent Application No. 60/944,532 filed Jun. 18, 2007.

This patent application incorporates by reference the specification, drawings, and claims of U.S. patent application Ser. No. 11/503,806 filed Aug. 14, 2006 for "SYSTEM AND METHOD FOR APPLYING A REFLECTANCE MODIFYING AGENT TO IMPROVE THE VISUAL ATTRACTIVENESS OF HUMAN SKIN" which claims the priority date of U.S. Provisional Patent Application No. 60/708,118, Application WO 07022095A is related to U.S. patent application Ser. No. 11/503,806.

FIELD OF THE INVENTION

The current invention relates to automated methods to selectively and precisely apply one or more reflectance modifying agents (RMAs), such as a pigment or dye, to human skin to improve their visual attractiveness.

BACKGROUND OF THE INVENTION

U.S. patent application Ser. No. 11/503,806 presents a general system and method for the digitally-controlled application of reflectance modifying agents (RMAs) through drop control technologies, such as inkjet printing. One aspect of that earlier application is that surprising aesthetic results are possible with the selective deposition of very small amounts of an RMA.

In one embodiment of that application, transparent dyes were deposited precisely by an inkjet printer in a manner that preserved natural high spatial frequency features, but disguised less desirable middle spatial frequency features. That embodiment included a scanning and deposition device that was aware of its position relative to the face or body-part being treated. In addition to the camouflaging or morphing of particular skin features, the embodiment permitted the use of color to provide an apparent re-shaping of a region of skin, such as rounder or more slender cheek appearance. Another embodiment of the earlier application included a smoothing mode which did not require positional awareness.

In the current invention, the concept of the surprising and pleasing results from the selective deposition of RMAs is extended to describe various deposition strategies; deposition ranges for pigmented RMAs, and various devices for selective deposition, including non-drop control spray devices. These pigmented RMAs may be similar to traditional cosmetic formulations, or may deliberately be highly differentiated with respect to desired skin luminance. The devices may be used to treat a relatively large skin area such as a face, arm, or leg; or the devices may be used to selectively treat only one or a few skin features of interest to the user without moving a scanning or deposition element over other areas of the skin.

The prior art has suggested inkjet printing or the computer controlled application of cosmetic designs such as U.S. Pat. No. 6,312,124 to Desormeaux, and U.S. Patent Application No. 2004/0078278 to Dauga. However, these references suggest adapting computers or inkjet printers to conventional tattooing or makeup practices. There has been little motivation to adapt digital technologies to cosmetic deposition because there has been no compelling reason to substitute digital technologies for the "fingers and sticks" which have been used to apply cosmetic agents for many centuries. The current invention provides a novel cosmetic practice—that of using much less cosmetic agent in a highly selective and precise manner.

There is a need for a method and apparatus to improve appearance by selectively applying small amounts of a cosmetic agent to a region of skin. There is a need to support sparse deposition strategies, such that large portions of the skin area retain a natural appearance. In addition to the more natural appearance, sparse applications have a much lighter feel than traditional cosmetics; and the sparse applications permit the use of compositions and formulations, such as for improved durability, that may not be practical for traditional cosmetic deposition.

Prior art techniques for modifying the appearance of skin include natural tanning, artificial tanning, and the deliberate application of cosmetics. Each of these prior art techniques has limitations.

Typically, the applications of cosmetic substances to skin are largely manual, for example through the use of brushes, application tubes, pencils, pads, and fingers. These application methods make prior art cosmetics imprecise, labor intensive, expensive, and sometimes harmful, when compared to the techniques of the present invention.

When RMAs are applied precisely, a much smaller amount of the agent can be used than with traditional cosmetics. In the current invention, a small amount of an RMA may be applied in some areas, and other areas may have no RMA applied. This combination of less RMA and non-uniform coverage permits a more natural look.

Manual cosmetic applications are imprecise compared to computer-controlled techniques, and this imprecision may make them less effective. For example, the heavy application of a foundation base for makeup may cause an unattractive, caked-on appearance.

There is a need for the selective precise application of reflectance modifying agents (RMAs) to provide a more effective, more automated, faster, and less expensive modification of the appearance of skin.

BRIEF SUMMARY OF THE INVENTION

These and other needs are addressed by the present invention. The following explanation describes the present invention by way of example and not by way of limitation.

It is an aspect of the present invention to provide an apparatus and software method for the computerized, digital application of RMAs through other means besides drop control technologies, for example through spray technologies.

It is another aspect of the current invention to provide improved control techniques for drop control deposition devices, and to use drop control devices in combination with non-drop control deposition devices.

It is another aspect of the present invention to provide a digital eraser brush that the user may move back and forth, like a common eraser, over an area of skin or other human feature to scan that area and quickly deposit one or more RMAs in response to the skin attributes identified there.

These and other aspects, features, and advantages are achieved according to the apparatus and method of the present invention. A device typically comprises at least one deposition element which is controlled by a processor which processes data obtained from multiple illuminators, also termed light sources, and one or more sensor for detecting light reflected from the skin surface. In one embodiment, the multiple light sources are turned on simultaneously in order to provide a uniform lighting for an area of skin so that reflectance can be accurately measured with sufficient illumination to permit the use of a polarizing filter. Although these objectives can be accomplished with a single light source such as a ring light, the use of multiple LEDs provides additional flexibility to sequence the light sources to provide different lighting states in order to obtain data for skin topology. The use of multiple LEDs also permits a pairing of one or more LEDs with one or more photodiodes in another embodiment. The sensor can be any element that is sensitive to the amount of reflected light in one or more wavelength, and is typically one or more camera or a plurality of photodiodes or phototransistors.

In accordance with one embodiment of the present invention, a digital eraser brush typically comprises multiple sensors, such as photodiodes, and multiple illuminators, such as LEDs. Typically, there are multiple pairs of light sources and sensors, where each pair provides information which may be used to determine one or more of the angles of the device relative to the skin, the distance of the device from the skin, or the local reflectance of the skin.

In accordance with another embodiment of the present invention, a digital eraser brush comprises at least one camera and multiple illuminators such as LEDs. Images are used to determine the distance and tilt of a device from the skin, and to determine accurate local reflectance of the skin. This information is then used to control one or more deposition elements in order to selectively apply one or more RMA to the skin.

Software identifies scanned attributes of an area of skin or other feature and initiates the automatic and precise depositing of a reflectance modifying agent, such as a traditional pigment-based cosmetic, on the area. A means of deposition, for example a spray technology, applies the cosmetics. In one embodiment, the eraser brush is moved manually back and for across the area in multiple passes, to continually scan attributes of the area, for example lightness and darkness, relative to a set threshold designed to cosmetically improve the appearance of the area. The eraser brush automatically deposits the RMA, such as a cosmetic substance, until the threshold is achieved.

Small Amounts of RMA

One aspect of the current invention is the deposition of very small amounts of RMA as compared to conventional prior art cosmetic treatments and as compared to prior art computer controlled techniques. In various embodiments of the invention, several factors contribute to the ability to use very small amounts of RMA.

Typically, only a small portion of a surface area is targeted for RMA deposition. The technique may deliberately target undesirable middle spatial frequency skin features without disturbing the more pervasive desirable high spatial frequency features. Significant and unexpected visual enhancement is provided by selectively applying RMA to small portions of a skin area. Thus the RMA deposition target areas typically represent a fraction of the skin area which may be scanned by a device.

The amount of RMA applied to those target areas is much smaller than prior art techniques due to deliberate enhancement strategies, precise deposition, and the ability to use small amounts of a highly differentiated RMA.

Small amounts of an RMA can have significant visual impact because the human eye detects differences according to the square of the reflectance. For instance, a correction of ¼ of a desired lightening level of correction for a dark age spot provides ½ of the ultimate visual benefit of a full correction. In some embodiments of the current invention, it is desirable to deliberately "undercorrect" features in order to enhance or preserve a more natural appearance.

One or more RMA agents is precisely applied in register "in agreement" or in register "in opposition" to locally measured skin properties such as reflectance or surface topology. Those measurements are compensated for height and tilt of the measuring device relative to a skin surface. An example of "in opposition" to a surface texture attribute is printing light on the top of an indented wrinkle, which will lighten the frexels normally in shadow because they face down, thereby opposing the shadowing of a wrinkle, and making it less visible. An example of "in agreement" is accentuating a dimple.

For those areas where an RMA deposition is desired, a "highly differentiated RMA" may be selected so that much less RMA is required than with conventional techniques. One aspect of precise control is that it is possible to select a more highly differentiated RMA for deposition. In simplified terms, in a lightening application, a much "lighter" cosmetic agent selectively applied requires significantly less agent than a "darker" cosmetic agent. In technical terms, a highly differentiated RMA is one that is selected along an extension of the correction vector to nearer the red channel saturation, where the correction vector is between an actual skin luminance and a desired skin luminance.

Speed and Accuracy of RMA Application

There are two substantial problems in attempting to selectively apply RMAs to an area such as a face. One problem relates to the speed of the application. Unless the application can be made relatively quickly, the time required to cover a relatively large area is unreasonably long.

A second problem relates to the accuracy of the technique. Experience with manually retouching photographs demonstrates that it is very difficult for people to accurately control the deposition of a small amount substance in response to reflectance manually.

One aspect of the current invention is to combine several inventive aspects to provide a practical solution to the challenges of accuracy and speed. In one embodiment, the invention permits both a fairly rapid manual back-and-forth "eraser-type" movement over an area to cover the face or other area more quickly, and a slower more deliberate movement as desired. In one embodiment, the invention shifts the problem complexity from hardware to software by using simple sensors, and using enough sensors to compensate for process variables such as distance and angle. In one embodiment, the invention provides a rich set of data to support computer control of the RMA application, and uses multiple passes to apply a desired amount of an RMA effectively.

Eraser Brush

An embodiment of the current invention is the Eraser Brush™. One aspect of the Eraser Brush is the recognition that small amounts of an RMA, precisely deposited, can provide a dramatic improvement of appearance. Another aspect of the Eraser Brush is a recognition that it is possible to provide this precise deposition with a very simple device. The device may be handheld so that it is portable, convenient, small, and inexpensive.

One principle of the Eraser Brush is that skin reflectance may be measured accurately by employing multiple inexpensive sensors and light sources. This plurality of light sources and sensors provide a rich source of information which can be used to provide an accurate calibration of the device to compensate for distance from target and angle of measurement. A polarizing filter may be used to eliminate the effects of gloss.

Another principle of the Eraser Brush is that the skin reflectance may be measured quickly and accurately as a deposition device is moved in rapid cyclical movement. Because the desired correction to an area of skin may only be a few percent of reflectance, there are several practical challenges to obtaining good reflectance readings, including

- the need for a high accuracy in determining reflectance;
- compensating for gloss of the surface; compensating for various deposition angles; and
- compensating for various measurement and deposition heights.

In one embodiment of the current invention, these complexities are address by providing multiple LED illuminators and one or more cameras and by providing a circular polarizing filter to remove effects from gloss. In one example, the illuminators are LEDs which are positioned a short distance from the filter so that they provide ample light for both polarization and reflectance measurement. The brightness of the LEDs permit them to be used in ambient light conditions. Reference marks are projected on the surface and the relative position of the marks on an image are analyzed to compensate for the height from the surface and the angle of the device relative to the surface.

In another embodiment of the current invention, these complexities are address by providing multiple synchronized LED/sensor pairs focused at different points to flatten the error curve for reflectance data; providing a circular polarizing filter to remove effects from gloss; providing one or more LED/sensor pairs to measure and compensate for the angle of deposition; and providing one or more LED/sensor pairs to measure the height from the surface to be treated.

BRIEF DESCRIPTION OF THE DRAWINGS

The following embodiment of the present invention is described by way of example only, with reference to the accompanying drawings, in which:

FIGS. 36A-F are top views of various sensor rings.

DESCRIPTION OF EMBODIMENT

Figure 1:
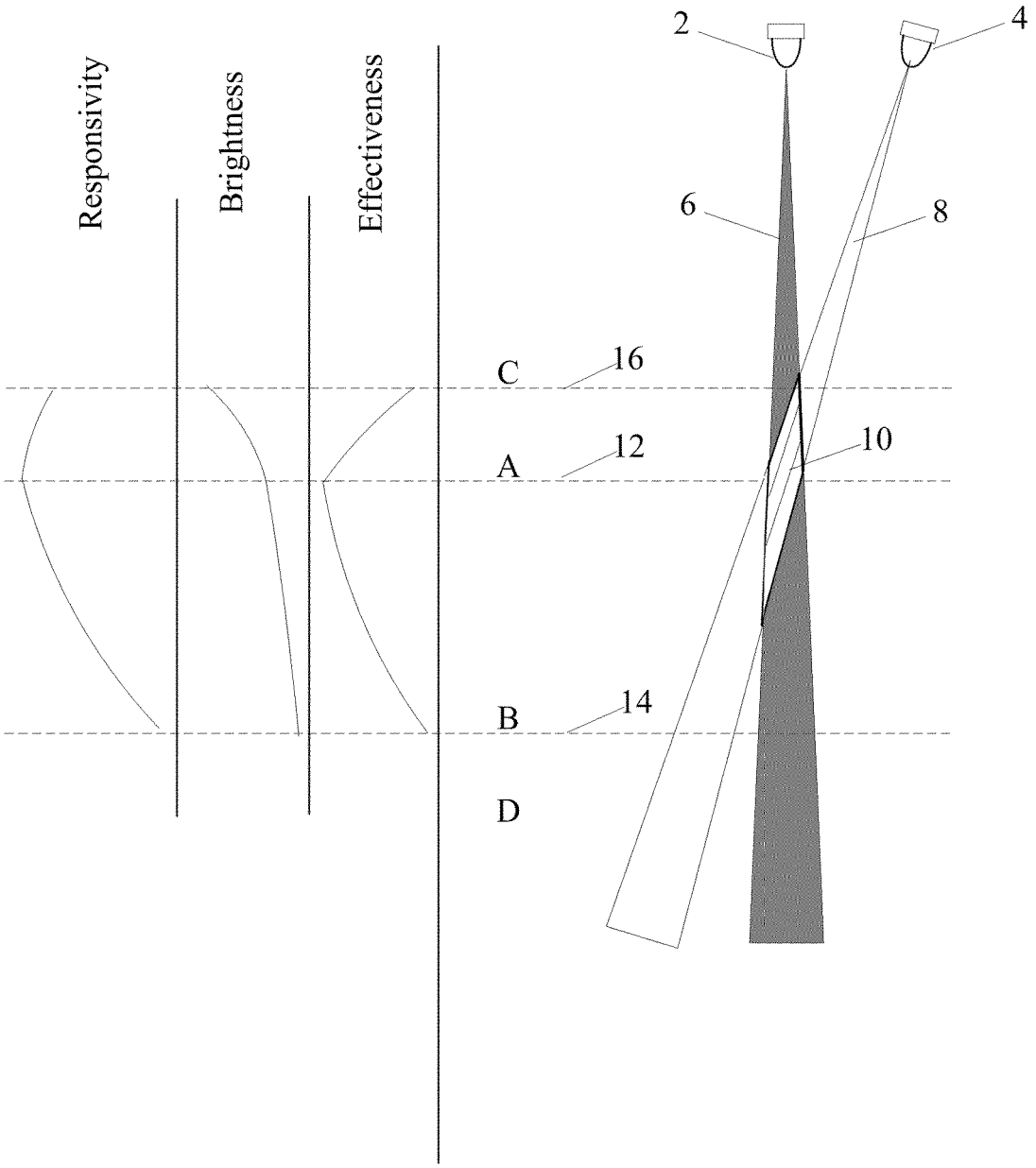
FIG. 1 is a representative diagram that illustrates beam intersection of a light source and sensor.

Use of LEDs and Photodiodes to Provide Accurate Reflectance Measurements to Support Digital Control of Cosmetic Spray Device This embodiment describes a method and apparatus for controlling a deposition device to apply relatively small amounts of an RMA in register with measured skin attributes. The deposition device may be a drop control device such as an inkjet head, a non-drop control device such as a spray device, or a combination of devices. The RMAs include pigment-based cosmetic compositions to make cosmetic enhancements, using any means of deposition, for example spray technology such as airbrushing. For example, these cosmetic enhancements may be to lighten an area, darken it, and change its color values.

In this embodiment, the present invention adapts conventional cosmetic application devices such as an airbrush or electrostatic spray device by providing a scanning and control capability; and by modifying the deposition strategy from large-scale uniformity to more precise multi-pass selective deposition. The strategy may also use more extreme colors, rather than a base color close to the skin color. The device may deposit a wide range of RMAs under precise computer-control. In some examples, the RMA may be much darker or lighter than the skin, and those agents may be applied lightly in multiple passes.

In this embodiment, a user moves the eraser brush manually across an area, with the familiar and instinctive pattern of moving an eraser, so that the eraser brush scans a plurality of frexels. The applicator then automatically deposits an RMA in response to the reflectance attributes of the frexels to improve the appearance of the area.

Definitions

In this specification and claims, the terms "reflectance modifying agent" or "RMA" refer to any compound useful for altering the reflectance of skin. Some examples of RMAs are inks, dyes, pigments, bleaching agents, chemically altering agents, and other substances that can alter the reflectance of human skin and other features. An "RMA composition" is a composition which includes at least one RMA. An RMA composition typically includes other ingredients such as a moisturizer or carrier. A "transparent RMA" is typically a dye, although dilute pigmented RMAs are essentially transparent also. An "opaque RMA" typically comprises high refractive index particles. In one example of pigmented cosmetics, the term "high refractive index particles" refers to particles having a refractive index of 2.0 or greater.

The term "frexel" is defined as a small pixel-like region of the skin, which may represent a single large pixel or a small number of pixels. More specifically, a pixel refers to the area of the deposition on a surface immediately below the deposition aperture of a cosmetic applicator, for example an electrostatic airbrush applicator. For some non-drop control embodiments, a pixel may represent an area of $1/15^{th}$ to $1/5^{th}$ inch.

The term "skin" is used not only to refer to skin as on the surface of the human body, but also to refer more broadly to any human feature that may be enhanced cosmetically, for example fingernails and hair. The term "skin" includes, but is not limited to, areas of human skin including the face, head, neck, torso, back, legs, arms, hands, and feet.

The term "attribute" means the local reflectance of skin, the surface morphology of the skin, or both. The term "attribute" is a subset of the broader term "characteristic" which refers to any measurable skin property. The terms "in register in agreement" or "in agreement" means specifically applying an RMA in register to frexel attributes in a manner to accentuate one or more frexels of a feature such as applying a light RMA to lighten a light skin feature; applying a dark RMA to a darken a dark feature; adding red RMA a red frexel; and applying RMA to a dimple to highlight the dimple. The terms "in register in opposition" or "in opposition" means specifically applying an RMA in register to frexel attributes in a manner to conceal or cover one or more frexels of a feature such as applying a light RMA to a dark skin feature to lighten the feature; applying a dark RMA to a light feature to darken the skin; adding a green or blue RMA to a red frexel; and applying a light RMA to a portion of a wrinkle to hide the wrinkle.

The term "middle spatial frequencies" means most preferably features or frequencies in the approximate range of 1.5 to 8 mm on a face and 2-16 mm on a leg. In the spatial frequencies between 2 mm to 12 mm, weaker waves below for example 10% peak to peak reflection can be attenuated, but stronger waves can be retained. In the range ½ to 2 mm, the same can be done with a higher threshold, below ½ mm the spatial frequency waves can be retained. In the range 12 to 25 mm, the same threshold can be applied under restricted control. Filtering or partial camouflaging of middle spatial frequencies means selectively applying RMA in a manner to disguise or cover middle spatial frequency features such as age spots.

A "deposition event" is a discrete event such as a single spray which has a start time and a duration.

The term "differentiated RMA" means an RMA that is deliberately selected to be darker (have less luminance) or lighter (have more luminance) than a desired skin color. The term "highly differentiated RMA" means an RMA that is deliberately selected to be substantially darker or lighter than a desired skin color. Technically, a highly differentiated RMA is typically at least 85% saturated in the red channel and is selected along an extension of the vector between the actual local skin reflectance and the desired skin reflectance. In the example of lightening a dark feature, a highly differentiated RMA might look pink. The term "skin color" means the skin's hue, chroma, and luminance. Perceived skin color is influenced by factors such as the actual skin color, lighting, and texture.

The phrase "eraser-like movement" refers to a general back-and-forth, circular, or generally elliptical motion. The motion is similar in concept to using a pencil eraser to erase a word on a sheet of paper.

The term "illuminator" refers to a light source that is used to illuminate a portion of a surface. Illuminators are typically controllable so that data from various lighting arrangements can be used to correct for ambient light and to obtain accurate reflectance or surface profile data. Illumination states or illumination conditions refers to various combinations of a plurality of sensors in ON or OFF states. The term "LED" refers specifically to a light emitting diode, and more generally to an example of an illuminator.

The term "sensor" refers to a photodiode, phototransistor, or other optical detector. In some embodiments, a camera functions as one or more sensor. A "sensor ring" refers to a housing for LEDs and other components such as sensors. The housing may be shapes other than annular.

In general, an illuminator illuminates a region of a plane with a pattern and intensity. A sensor detects a region of illumination on the plane that may or may not intersect the illumination pattern. The "effectiveness" is a measure of how completely the light beam and the sensor beam intersect at the plane of interest. A "region of effectiveness" is the intersection of the light source profile and a sensor profile on a portion of the surface. The "brightness" of an illuminator is the illumination per unit area at the plane of interest. The "sensitivity" is the efficiency of a sensor in detecting the actual illumination at the plane of interest. The "responsivity" is the product of the effectiveness, the brightness, and the sensitivity. The term "ratios of responsivity" refers to the ratio of one light source and sensor's responsivity to another sensor's responsivity. The ratios may also involve comparison of one light source and sensor's responsivity, such as an adjacent sensor, to two or more other sensors, such as sensors located opposite of a light source on a sensor ring as described below. The ratios of responsivity are typically used to calculate the relative tilt between a surface and the sensor.

A "deposition device" is a device which applies an RMA to the skin. In this specification, the deposition device may be a sprayer, including an electrostatic sprayer or airbrush sprayer, a drop control device, or other apparatus. A "deposition element" is a portion of a deposition device that applies an RMA, such as a sprayer, a drop control element, or both. A "scanning and deposition device" scans a portion of the skin and uses scan data to control a deposition of one or more RMA. An example of a drop control element is an inkjet print head where individual droplets are precisely controlled. An example of a non-drop control element is a sprayer. Spray devices are non-drop control techniques where droplets are produced and controlled only in aggregate.

The term "mean illumination" is the average angle and diffusion of light reaching a particular surface. This defines how surface irregularities are typically shaded. For example, mean illumination for the entire body is overhead, and a typical orientation for a head is vertical; therefore, a bump on a cheek is typically shaded at the bottom. Mean illumination may further be defined as the interaction of mean light direction relative to gravity and the mean orientation of a particular frexel of skin relative to gravity.

The terms "reflectance", "optical density", or "density" refers to a measure of the reflection of the skin. In this specification, an "initial reflectance" reading is an initial reflectance reading from a sensor, before compensating for distance or tilt. An "adjusted reflectance" reading compensates the initial reflectance reading for distance and tilt of a surface from a sensor ring. Adjusted reflectance is a reflectance reading corrected for device height and tilt relative to the skin surface. A "desired density level" is typically a desired level of smoothing for an area of skin, such as threshold for lightening skin, darkening skin, or both. An "average density" over an area of skin may be used as the desired density level. The term "RMA application density" refers to the mass per unit area of RMA applied to a surface.

The term "handheld" includes devices that are self-contained in a housing that may be held in a hand as well as devices where a housing is tethered to power supply and/or computer.

Spatial Frequencies

One aspect of the invention is the filtering or partial camouflaging of middle spatial frequencies. The skin exhibits three types of spatial frequencies as summarized in Table 1 below. In general, high frequency features are desirable, and middle frequency features are less desirable. Many of the control strategies described below are targeted at covering or altering middle spatial frequency features.

TABLE 1

| Spatial Frequencies | |
|---|---|
| HIGH | These tend to be small and desirable natural variations in the skin, such as those derived from the genetic code. One problem with conventional cosmetics is that they cover these high frequency, natural features. One result of covering these features is the skin looks more artificial and less real. |
| MIDDLE | These are generally undesirable features or aspects such as caused by bruising or aging. |
| LOW | These are the shape of larger features such as the cheek. It is possible to use aesthetic strategies such as light and dark shading to change the apparent shape of these features. |

Cosmetic applications of the eraser brush include smoothing the appearance of the skin, skin lightening, simulated natural tanning, and applying shades of color.

The application of cosmetics with an apparatus of the current invention may improve the appearance of age spots, rings, veins, bumps, and other skin imperfections as the device is moved over skin. It is not typically necessary for a user to have a high skill level in order to use the apparatus.

One advantage of the current invention is that small areas of skin may be treated without obvious transition edges. Within a given region of skin, a typical correction is on a small portion of the region, so that most skin is unaffected. When a feature such as an age spot is corrected, such as in multiple passes of dilute puffs of an RMA, the transition between the age spot and surrounding skin is much less noticeable than with the uncorrected feature.

Accurate Reflectance Measurements—Correcting for Distance and Tilt

The measurement of color or reflectance is typically done under controlled conditions of a set distance and a set angle between the sensor and the object being measured. In the present invention, it is desirable for a sensor to provide accurate measurements of reflectance through a range of device distances and tilt. One way to provide accurate measurements is to use stereoscopy to measure the distance and tilt. Another way to provide accurate measurements is to use a plurality of light sources and sensors to determine the distance and tilt.

Stereoscopy

Classical stereoscopy is a subset of the general analytical techniques described below. In stereoscopy, a camera is used to capture images that are projected onto a surface. The images may include reference marks, so that distances and other factors can be calculated from the reference marks. In this approach, one or more cameras are used to look at the image, and triangulation techniques are then used to provide an indication of distance and angle in order to correct the reflectance. Representative stereoscopic approaches include the use of two cameras and one or more light source, multiple cameras with one or more light source, or a single light source with a projected pattern such as reference marks or a grid.

This embodiment of the current invention provides a simpler approach by using fewer sensors and light sources in a specific pattern to measure the distance and compensate for the angle from the surface in order to correct the responsivity and give an accurate measure of reflectance. The LED and camera embodiment described below includes both variations of classical stereoscopy techniques, and the use of cameras to measure LED beam profile and location so that the camera can replace photodiode sensors.

Light Sources and Sensors

One approach to correcting reflectance readings to account for distance and tilt uses illuminators and sensors such as photodiodes. At least one sensor is used with multiple light sources. Generally, it is desirable to use multiple light sources and multiple sensors.

In this example, the Eraser Brush measures the reflectance of a surface, without contact with the surface, in the presence of ambient light. FIG. 1 shows a light-emitting source 2, and a light receiving sensor 4. The light source and sensor are oriented so that their beams 6 and 8 intersect over a range of distances away from the sensor, and the extent of that intersection varies with distance. The techniques described below illustrate methods for using this variation to improve data analysis—such as for compensating for height and tilt of a device with respect to a skin surface.

In this embodiment, a plurality of LEDs are used as light sources 2 and sensors are used to detect the illumination of the LEDs.

Figure 3:
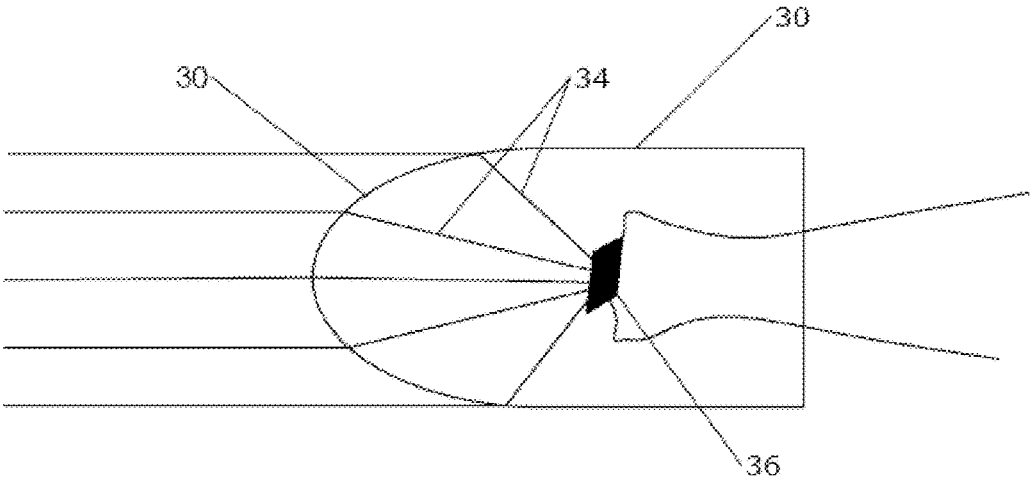
FIG. 3 is a representative diagram that illustrates the operation of a common domed LED or sensing diode.

FIG. 3 illustrates the operation of a common domed LED 30 or sensing diode. The dome 32 is molded in a generally parabolic shape specifically to focus the light rays 34 from or to an embedded diode chip 36. The same structure is used redundantly in an LED or a single element sensor, and so the two will appear in further drawings interchangeably.

To accurately measure reflectance, external light should be ignored. Since it is often impractical to shroud an apparatus without contacting the surface, or require use of a darkroom for operation, extraneous light may be excluded by modulating the light beam 6 shown in FIG. 1.

In this approach, it is desirable to turn the LEDs "ON" and "OFF" in a sequence, and to take measurements of each sensor while the LED is "ON" and while it is "OFF". The "OFF" value can then be subtracted from the "ON" value to compensate for ambient light. This specification describes two general approaches to the sequencing of the LEDs. The first approach is synchronous demodulation. The second approach is to turn each LED on and off at specified times within a cycle.

Synchronous Demodulation

Figure 4:
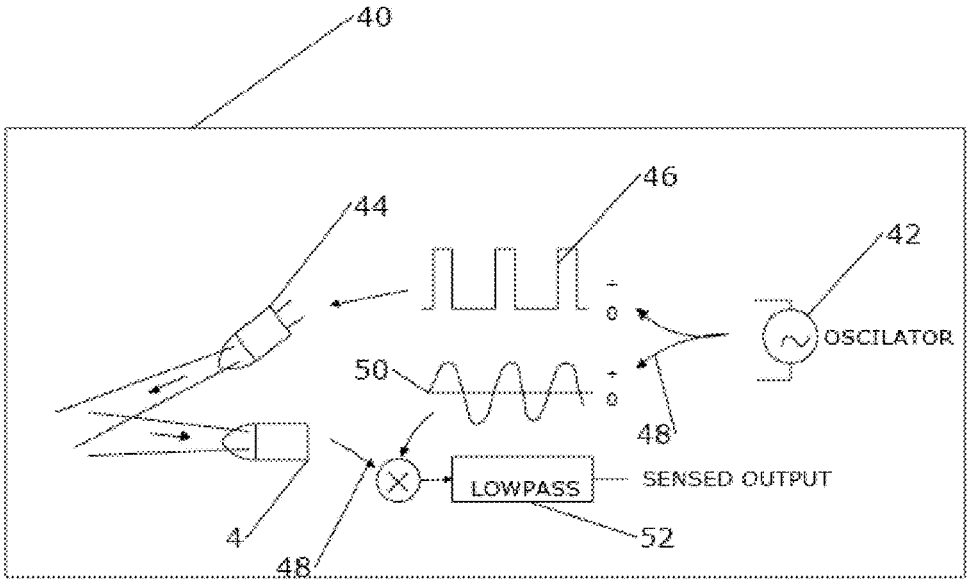
FIG. 4 is a representative diagram that illustrates a synchronous demodulator.

FIG. 4 illustrates a synchronous demodulator 40 that is very effective when the exact phase of the transmitted carrier is known, as in this case. A local oscillator 42 drives an LED 44 with an asymmetric square wave 46, the most effective stimulation when harmonics are not a problem. The signal 48 received from the sensor 4 is fed to a two-quadrant multiplier, with the other input being the bidirectional sine wave 50 from the oscillator 42. A following low pass filter 52 determines the bandwidth and response speed, as is well known in radio art.

Several LEDs 44 can be driven with different oscillator frequencies, and each separately distinguished from a single sensor 4 by separately tuning a demodulator 40 to each of those frequencies, just as many radio stations may be received from a single antenna by connecting multiple radios.

By using multiple frequencies, multiple pairs of LEDs 44 and sensors 4 can be operated simultaneously. The demodulation can be done with analog electronics at radio frequencies. An alternative is to modulate the light sources 44 at lower, e.g. audio, frequencies, and use software to perform the demodulation.

Sensors

At least one sensor 4 senses data from the illumination of the light source. In an embodiment, one or more photocells such as photodiodes or phototransistors may be used that match the modulation of the light source, such as an LED. The signal from a matching photocell is synchronously demodulated at the same frequency as the LED to exclude all ambient light.

In one embodiment, the sensors are photodiodes which are similar in appearance to the LEDS. The photodiodes are available in a selection of viewing angles, referred to as device beam angles in this specification. The simulation described below permits the designer to evaluate various photodiode viewing angles and LED beam angles in order to design a sensor head with acceptable signal to noise ratio.

Combinations of LEDs and Sensors

Figure 5A:
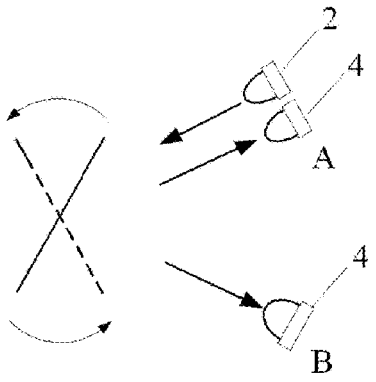
FIGS. 5A, 5B, 5C, and 5D are representative diagrams that illustrate how multiple pairs of light sources and sensors are affected by angle and distance.
Figure 5B:
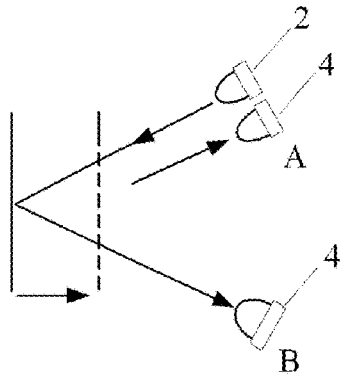
Figure 5C:
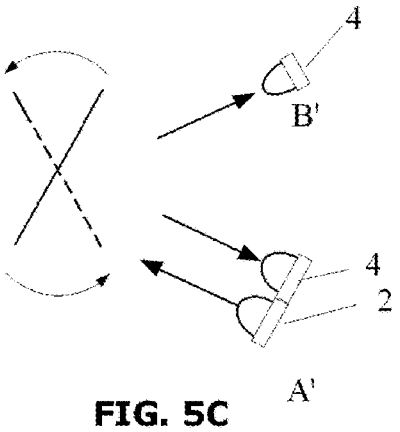

FIGS. 5A, 5B, 5C, and 5D demonstrate the response of light sources 2 and sensors 4 to changes in distance and tilt. In FIG. 5A, a light source 2 and a first sensor 4 are located at the top portion of the figure and a second sensor 4 is located at the bottom portion of the figure. As a plane of interest is rotated counterclockwise from the solid line to the dashed line, the upper sensor reading will decrease and the lower sensor reading will increase. Thus the ratio of the upper sensor reading to the lower sensor reading will decrease. In FIG. 5C, a light source 2 and a first sensor 4 are located at the bottom portion of the figure and a second sensor 4 is located at the top portion of the figure. As a plane of interest is rotated counterclockwise from the solid line to the dashed line, the upper sensor reading will increase and the lower sensor reading will decrease. Thus the ratio of the upper sensor reading to the lower sensor reading will increase. In these examples, the ratios of the sensor readings provides information about direction and magnitude of tilt.

Figure 5D:
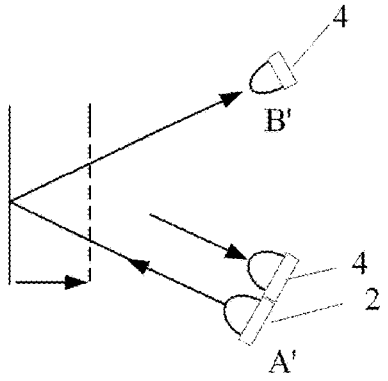

FIG. 5B has the same light source and sensor configuration as FIG. 5A, and FIG. 5D has the same light source and sensor configuration as FIG. 5C. In these examples, as a plane of interest is moved from the solid line to the closer dashed line, both the upper sensor reading and the lower sensor reading will typically increase. The ratio of the upper to lower sensor readings is unchanged.

Thus the direct readings and the ratio of readings from various sensors provides information on distance and tilt.

Simplified Geometric Analysis

The use of multiple LEDs and sensors can be viewed as an approach to measure the intersection of the various combinations of LEDs and sensors. The following analysis is simplified by treating light beams and sensor beams as having a uniform intensity and sharp edges.

This simplified geometric analysis is presented to provide some insight into the responses of a measurement device with changes to distance and tilt. A more theoretical analysis may be used, and more detailed analysis or simulation may provide more accurate results for optimizing design and control strategies.

Beam Profiles at Planes Various Distances from a Light Source

Figure 23:
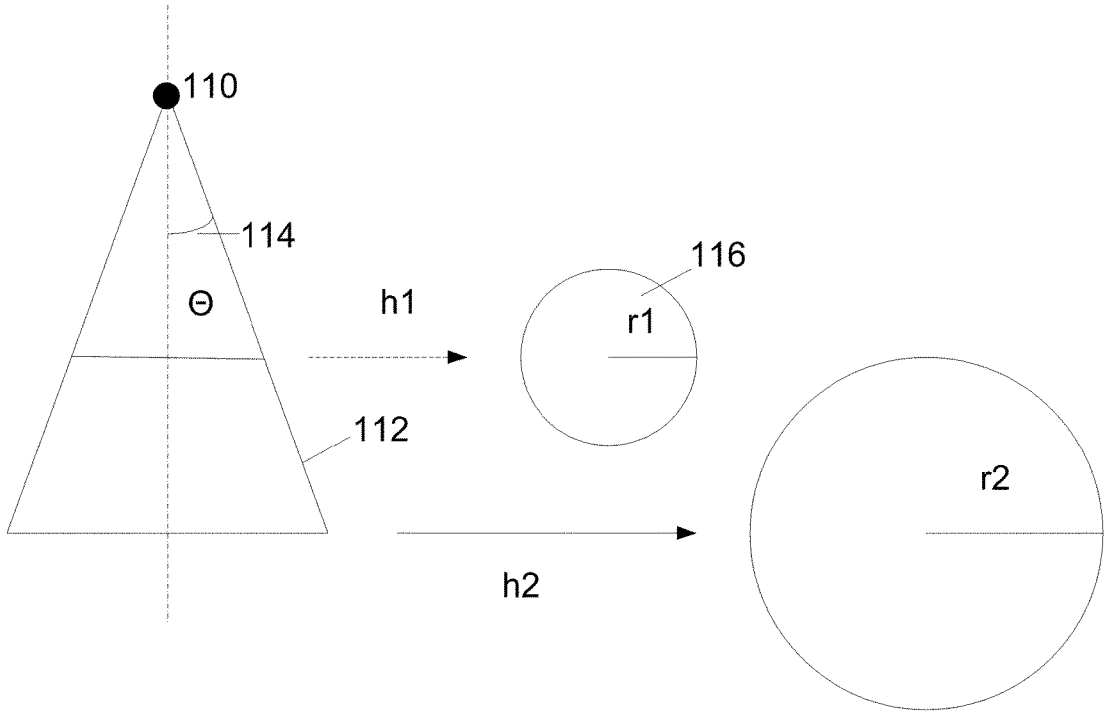
FIG. 23 is an example of circular beam patterns projected on a plane normal to a light source.

As illustrated in FIG. 23, an ideal beam 112 from a source 110 such as an LED or sensor with beam angle (Θ) 114 projects a circular pattern 116 of radius r at a distance h below the source 110. The magnitude of the radius is determined by the angle Θ and the distance h. In this simplified analysis, the ideal beam has a uniform illumination I across the circular pattern. As the distance from the source increases, the size of the beam projection on the surface increases, and the illumination per unit area decreases.

In more detailed analysis, these relationships can be adjusted to specify a Gaussian distribution or other desired pattern of intensity for the beam. The illumination can also be further decreased with distance to allow for scatter or loss of light as the distance from the source increases.

The Effective of Tilt Angle

In Cartesian coordinates, tilt can occur along an arbitrary x-axis, a y-axis, or both axes.

Figure 24:
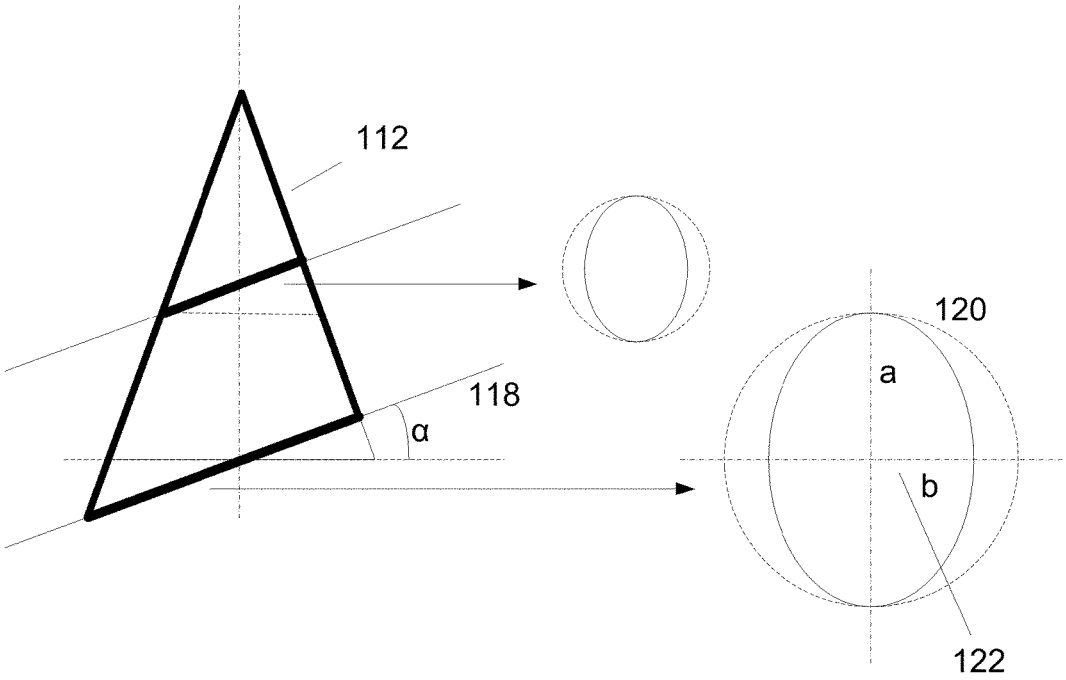
FIG. 24 is an example of elliptical beam patterns projected on a plane tilted with respect to a light source.

As shown in FIG. 24, the beam 112 intercepts the tilted plane 118 to form an elliptical cross section 120. The minor axis 122 of the ellipse decreases as the tilt angle increases. Thus the greater the tilt angle, the more elongated the ellipse. At zero tilt angle, the beam intercepts the plane to form a circle as described above.

Figure 25:
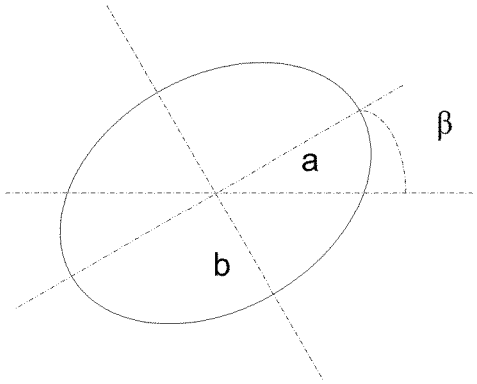
FIG. 25 is an example of an elliptical beam pattern with rotation.

If the source is offset from the centerline, then the ellipse may be rotated by angle β as shown in FIG. 25. The actual shape of the beam may be more of an egg-shape with one end larger than the other end. For purposes of illustration, ellipses are used.

Figure 26:
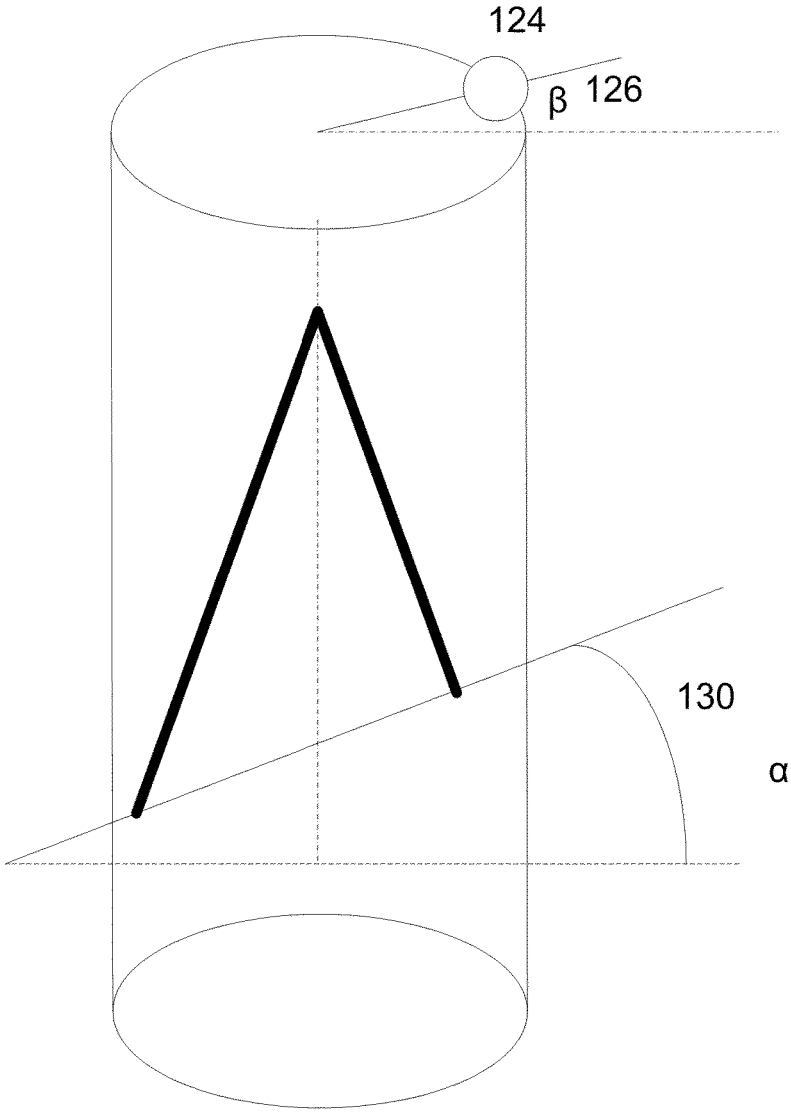
FIG. 26 is a representation of a beam projection in 3 dimensions.

As shown in FIG. 26, the shape and position of the ellipse is related to several factors including the position 124 of the LED or sensor, angle of rotation 126 of the LED or sensor (β), the direction of aim 128 of the LED or sensor, the beam angle 114 for the LED or sensor, and the tilt 130 of the plane (α).

Figure 27:
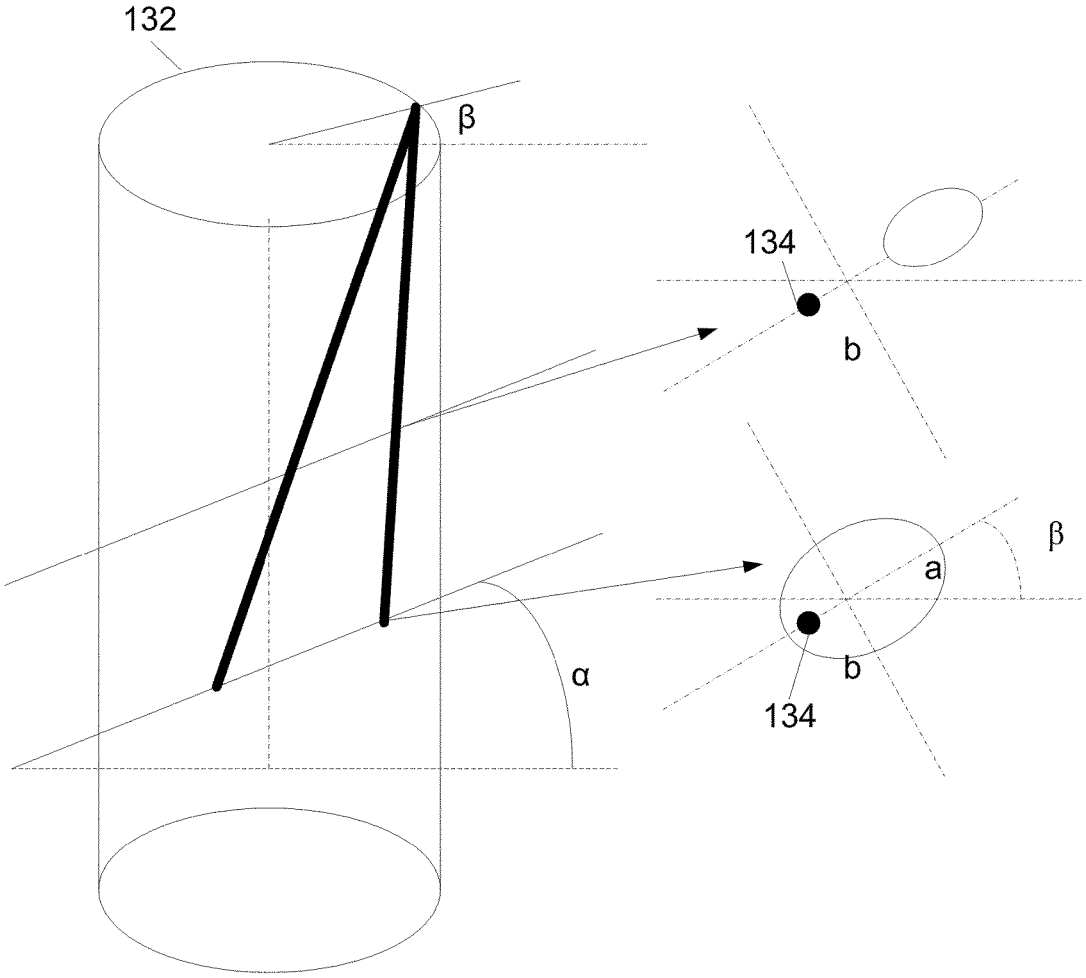
FIG. 27 is a representation of a beam projection in 3 dimensions to a first plane, and to a second plane that is closer to the light source.

FIG. 27 demonstrates a general case of an LED or sensor located on a sensor ring 132 at angle β. Region 134 in the ellipse represents the intercept of the centerline. As the plane of interest is moved closer to the LED or device, the ellipse gets smaller and its center moves away from the centerline.

Multiple Light Sources and Sensors

The intersection of various LED and sensor beam profiles at the surface to be measured produces different measurement values for each combination of light source and sensor as the input variables change. In this case, the input variables are distance 136 from the light source or sensor to the surface 138 being measured, the reflectance 140 of that surface, and the angle of tilt 130 and 131 of the surface in two axes. Simulation may be used to explore various strategies for design and control including sensor alignment, beam angle, and data analysis.

Figure 30:
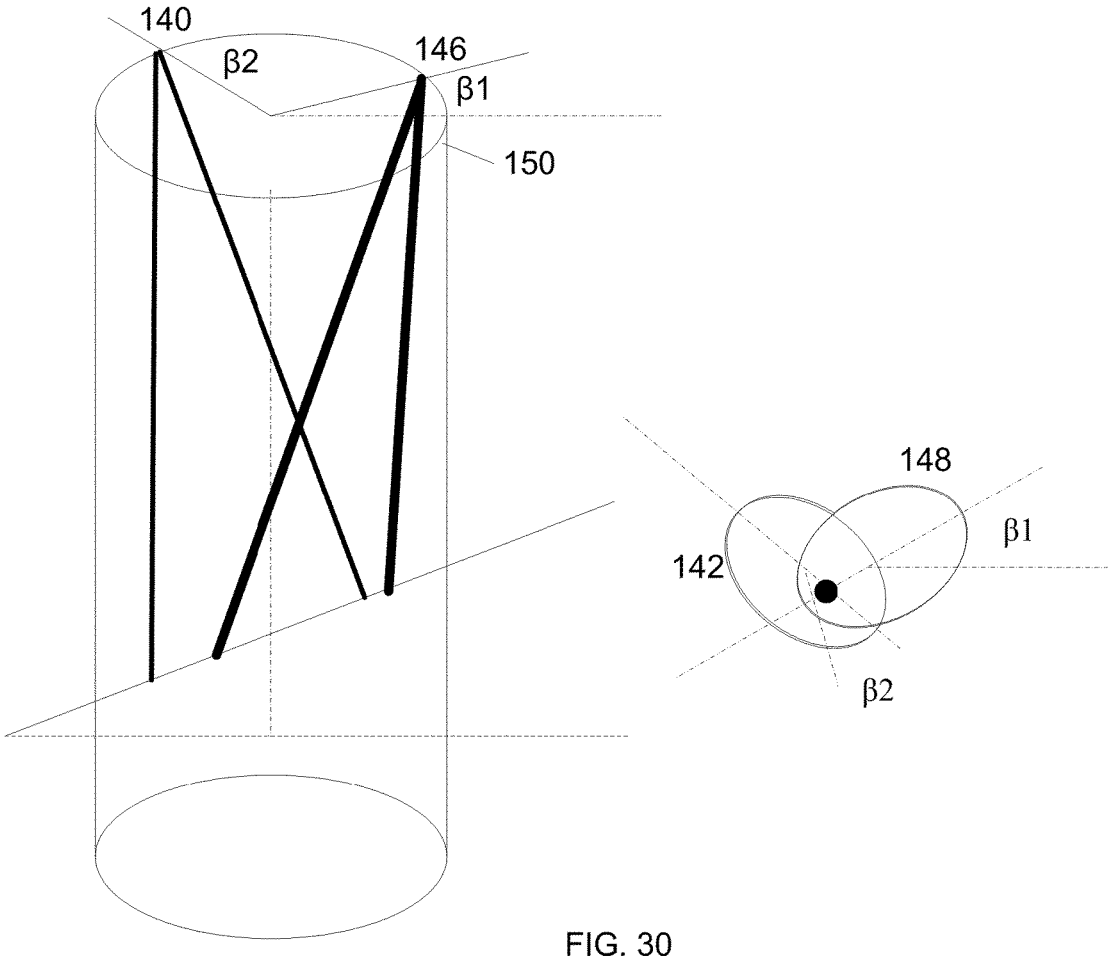
FIG. 30 is an example of the intersection of an LED profile and a sensor profile.

FIG. 30 shows an LED 146 and a sensor 140 mounted on a sensor ring 150, and a theoretical pattern of intersection at a horizontal plane. As described below, the ring configuration is used as a convenient form for mounting LEDs and sensors. Other configurations may be used.

The LED is mounted at radius $r_L$ and position β1=30 degrees. The sensor is mounted on the same ring at the same radius at a position β2=150 degrees. The resulting LED and sensor elliptical beam patterns 142 and 148 at a horizontal plane are exaggerated for purposes of discussion. If the plane is tilted, then the shape and orientation of the beam intersection will change.

In some examples, it is desirable to obtain readings from several sensors for each LED. For instance, one sensor may be adjacent to the LED, and one or more other sensors may be opposite the LED.

Figure 31:
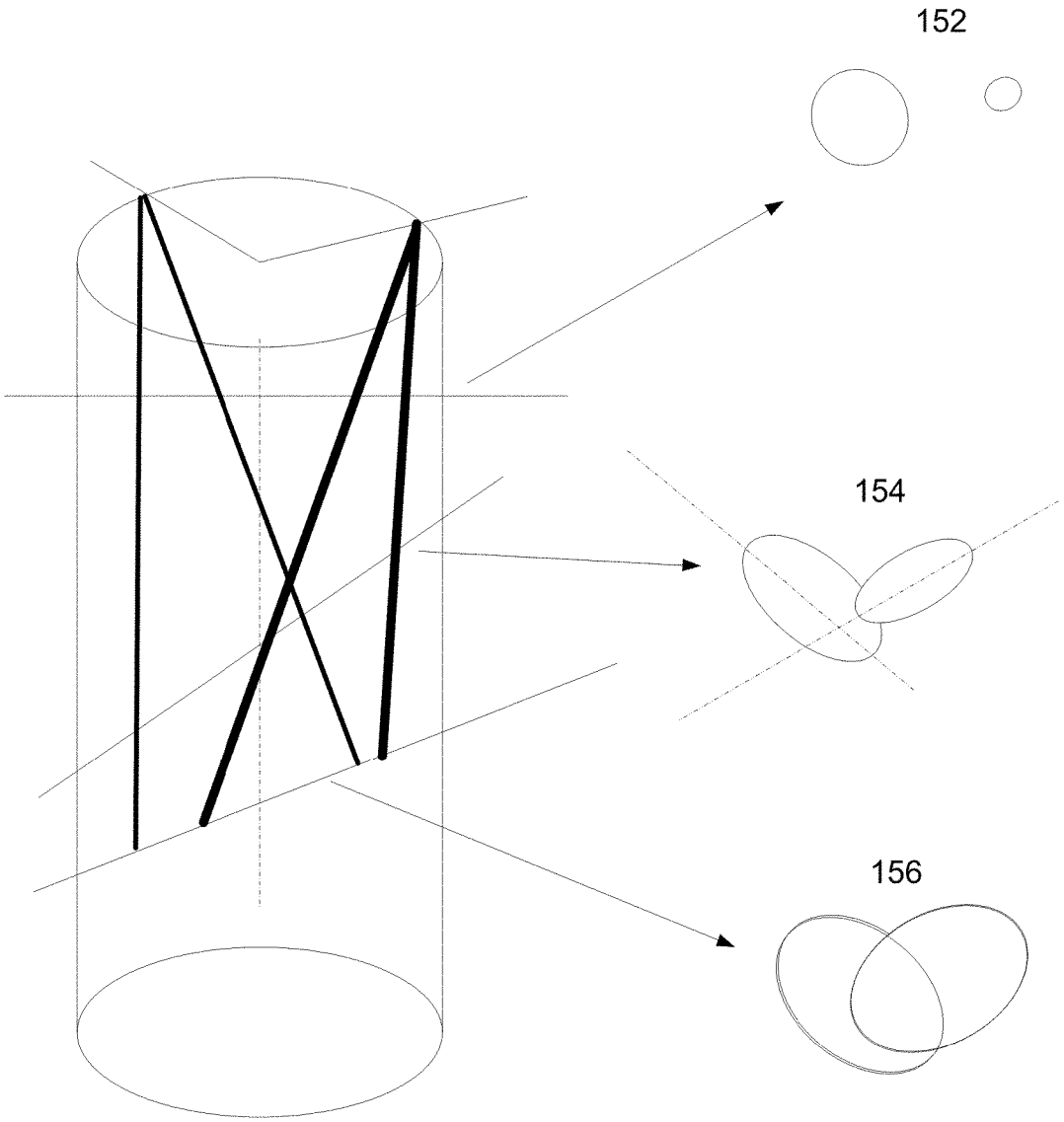
FIG. 31 is an example of the intersections of an LED profile and a sensor profile at various distances from the LED and sensor.

The size and shape beams and their intersection provide useful data. FIG. 31 illustrates changes in intersection of three pairs of beam profiles 152, 154, and 156 as the distance and relative tilt between the sensor ring and the surface changes. As the plane of interest moves away from the sensor ring, the areas of each beam increase. As the angle of tilt of the plane increases, the eccentricities of the ellipses increase.

The Combination of LEDs and Sensors

The following discussion considers several factors related to obtaining and improving reflectance readings with light sources and sensors. The region of effectiveness is the area of overlap of an LED beam and a sensor profile. There is typically a Gaussian or other distribution of light within a beam, with the center being more intense than areas away from the center. There is no sharp edge as depicted in the geometric analysis above; the ellipses in the geometric analysis can be considered as representing the perimeter of a 1σ variation of the beam intensity. There is an inverse square relationship of intensity or sensitivity with distance away from the LED or sensor.

The degree of tilt of the local surface away from a plane perpendicular to the local portion of the beam is a factor. This factor is not considered in the first pass simulations described below.

For illustration, these factors are assumed to be additive. Given a particular orientation of a light source and a sensor, and a surface which is located a distance away from the light source and tilted in two axes with respect to the light source, a region of effectiveness will be the intersection of the light source profile and a sensor profile on a portion of the surface. Then, in addition to the actual reflectance of the surface, there are several factors which affect the reflectance measurement within that region of effectiveness.

One factor is that there is typically a distribution of light intensity or sensor sensitivity that is stronger in the middle of the profile and which drops as the distance from the center increases. For discussion, this is treated as a Gaussian contribution. Another factor is that as the distance doubles, then the average illumination per area will decrease by a factor of four. The intensity per unit area decreases by a factor of $1/d^2$ as the distance increases. This is the inverse square contribution. A third factor is how much the surface tilts away from a plane normal to the local beam profile.

A responsivity for one sensor and one light source can be viewed as the product of these three factors within the region of effectiveness. A comparison of the responsivity or reflectance reading for a first sensor and a light source with the reflectance reading for a second sensor and a light source provides information about the distance and orientation of the surface with respect to the devices. The objective of a sensor head design is to provide sufficient data so that there is a good signal to noise ratio, so that actual reflectance, distance, and tilt can be determined from the data.

One aspect of this embodiment of the current invention is to provide a digital control which can determine accurate reflectance measurements by obtaining ample data from inexpensive light sources and sensors.

In general, one approach is to aim LEDs and sensors to different points. For instance, a first set of LEDs and sensors may be aimed to the center of a first plane of intersection located at a first distance from the sensor ring; and a second set of LEDs and sensors may be aimed to the center of the second plane of intersection located at a second distance from the sensor ring.

In one embodiment of the current invention, this degree of overlap may be indicated by sensor reading, such as by a photodiode output. In this embodiment, as the degree of overlap decreases, the sensor reading decreases.

In another embodiment of the current invention as described below, various arrangements of LEDs are configured for one or more aim distances, and one or more cameras are used to determine the locations and profiles of the beams on a surface.

Example

In this example, three pairs 158, 160, and 162, of LEDs and sensors are arranged on a sensor ring 150. Each LED in sensor is aimed at a center point at a first distance from the ring.

Figure 21A:
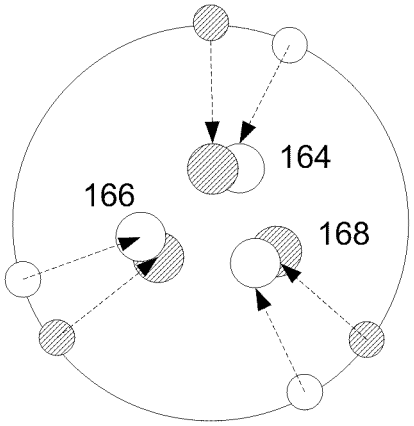
FIG. 21A shows an example of beam locations at a distance closer than the aim distance.

In FIG. 21A, the plane of intersection is closer than the aim distance. Although the beam profiles 164, 166, and 168 are shown as circular patterns in this example, the actual beam profiles would be elliptical.

Figure 21B:
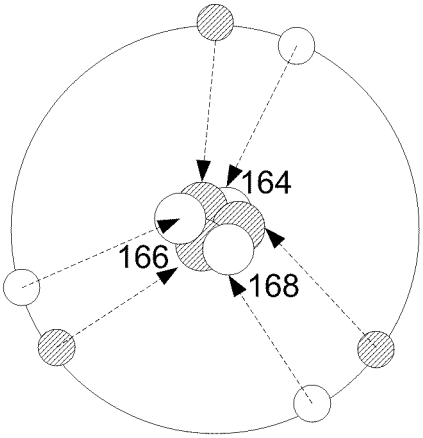
FIG. 21B shows an example of beam locations at a distance close to the aim distance.

In FIG. 21B, the plane is near the aim distance, and the beam profiles 164, 166, and 168 are closer to the center than in FIG. 21A.

Figure 21C:
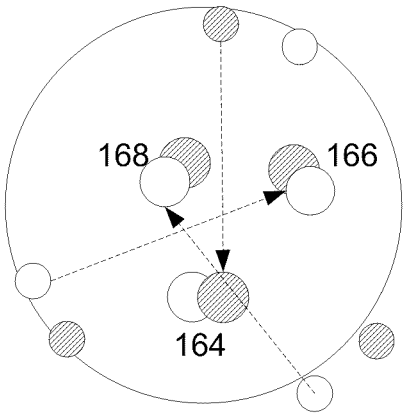
FIG. 21C shows an example of beam locations at a distance further than the aim distance.

In FIG. 21C, the plane is farther than the aim distance, and the beam profiles have crossed the center point. As the distance increases, these beam profiles will get further from the center.

Region of Invariant Net Gain

Referring now to FIG. 1, the light source 2 may be focused into a beam 6, and the sensor 4 may also be considered as being focused into a beam 8. It may be understood that the region of effectiveness 10 is the intersection of these two beams 6 and 8. More precisely, the responsivity at a distance away from the light source is the product of both beams 6 and 8 at that distance. For example, if each beam 6 and 8 has a 10% overspill or flare, the net overspill of the region of effectiveness 10 is only 1%. Thus, it is not necessary to extensively hood the light source 2 and sensor 4.

The region of effectiveness 10 lies between the light source and sensor. In one embodiment of the present invention, LEDs and sensors are placed around a ring and a deposition device is placed in the center of the ring. By aiming the LEDs and sensors toward the center, the region of effectiveness occurs in the deposition zone without requiring placement of LEDs or sensors directly overhead.

The sensitivity is reciprocal between the light source 2 and sensor 4 such that they can exchange roles with the same net region of effectiveness 10.

The graphs on the left side of FIG. 1 are relative diagrams of "effectiveness", "brightness", and "responsivity" versus distance. The "effectiveness" is a measure of the area of intersection of the beams 6 and 8 at a distance. Although these beams are shown as sharp profiles, the edges of the beam may be considered to be some measure of a Gaussian distribution, such as the 1-sigma levels at the distance as described below. The "brightness" is a measure of the illumination per unit area. In this example, the far end of the region of effectiveness 10 is about twice the distance from the light source as the near end of the region. Since illumination decreases with the square of distance, the far end has about ¼ the brightness as the near end. The "responsivity" is the product of brightness and effectiveness.

In region A 12, the increase in brightness offsets the decrease in effectiveness as the distance decreases, so that region exhibits an "invariant net gain". For purposes of this discussion, invariant means approximately the same.

In distance region B 14, both the brightness and the effectiveness increase as the distance decreases, so the responsivity increases over the entire range.

As described in more detail below, these types of responses with distance can provide useful information. One design strategy of the current invention is to provide various pairings of light sources and sensors so that there is a plurality of regions of effectiveness with a variety of brightness and responsivity profiles. These varied responses then provide a basis for analyzing the data to determine distance and tilt and to adjust reflectance readings accordingly. In practice, there are a number of ways to obtain responsivity profiles including various arrangements of light sources and sensors.

In one embodiment of the present invention, wide variations in distance are accommodated by the use of multiple LEDs and sensors aimed at various distances.

In the present invention, the data may be used to obtain an accurate determination of distance from the sensor head to the surface. The distance is important for several reasons, including correcting a reflectance measurement to account for the distance, advising a user when a desirable deposition range is exceeded, and determining the trajectory of a drop or spray to more accurately turn on or off the deposition device.

Treatment of Gloss

In one embodiment, a circular polarizer is used to overcome the potential error in reflectance readings caused by gloss. In many applications, polarizers can rob valuable light. In one embodiment, bright LEDs are placed close to the subject, so that there is adequate light for light remaining after the polarizing filter. A circular polarizer comprises, in general, a one quarter wave filter positioned between the incoming light and a linear polarizing filter. The arrangement of several LEDs and a camera or photocells behind a single circular polarizer allows a computer to interpret skin lightness independently of distance, angle, and gloss. This technology has been used in a few expensive antiglare screens for CRTs to eliminate internal reflections. Further, circular polarizers are common, and available at most camera stores in preference to linear polarizers 60. They are used to spin the angle inside the camera to avoid polarimetry issues with the meter and autofocus. The advantage in this application is that all the sources and all the sensors may be placed behind a single polarizing filter, which is self aligning and may be placed at any angle.

In one embodiment, the illuminators are LEDs in a green wavelength to provide improved visibility of skin conditions relative to red or other wavelengths. In other examples, other wavelengths or combinations of wavelengths may be used.

Calibration

It is generally desirable to perform a calibration procedure on the control unit in order to accurately convert to signals from the sensors to meaningful data. One method of calibrating the control unit is to obtain sensor readings for various heights and angles of tilt with known color samples. The calibration data can then be used to convert the sensor data to measurements of distance and angle. In practice, this calibration would be performed over a range of working heights, angle of tilt, and range of surface reflectance.

In one embodiment of the current invention, an audible signal, light, or other indication is provided to advise the user that a distance range or angle of tilt has been exceeded. This feedback enables the user to become more proficient in using the device. The data is also used to provide a more accurate reflectance measurement by compensating for distance and angle of tilt, and to provide an adjustment for turning on or off a delivery device to account for the actual trajectory of the RMA drop or spray exiting a deposition device.

Example Calibration

In this case example there are four input variables—actual surface reflectance (R), height or distance (d), first axis tilt ($\alpha x$), and second axis tilt ($\alpha_y$). There are a total of six sensors and six LEDs. Three of the LEDs (L1, L2, and L3) and three of the sensors (S1, S2, S3) are aimed at a first angle. The remaining three LEDs (L4, L5, and L6) and three sensors (S4, S5, and S6) are aimed at a second angle. Each pair of sensor and LED within a set produces a data point of interest. There are 18 responses that may be used individually or in combination to calibrate the device. For instance, one combination of interest is to compare the reading of the sensor adjacent to an LED, such as LIS1, to the average reading of sensors opposite the LED, such as LIS2 and LIS3. In this example, the readings are typically the difference between a sensor reading when the LED is ON and win the LED is OFF. This difference subtracts the effect of ambient light, so the difference can be attributed to the illumination from the LED.

Ring Topology of Light Sources and Sensors

Figure 7A:
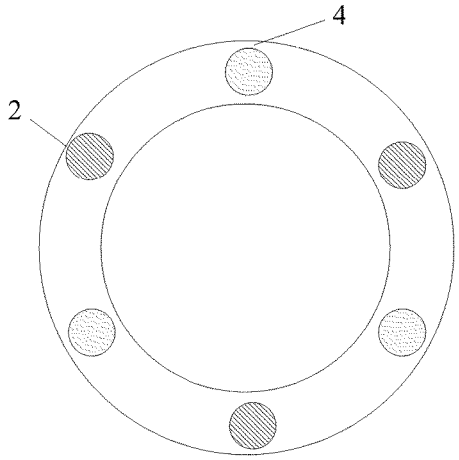
FIGS. 7A and 7B are representative diagrams that illustrate ring topologies of light sources and sensors.
Figure 7B:
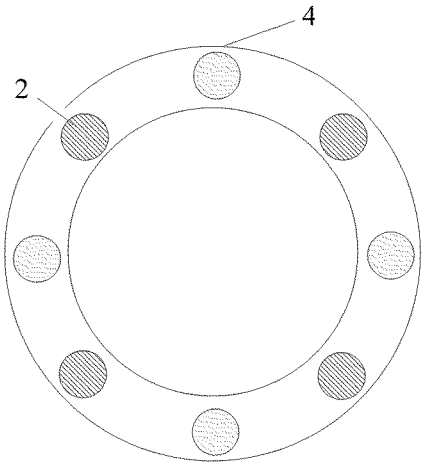

FIGS. 7A and 7B illustrate a ring topology of light sources 2 (white) and sensors 4 (black) that may be used in an embodiment of an eraser brush. The triplet (3×2) configuration may be used to sense distance and both tilt angles. However, a quad (4×2) configuration, shown in FIG. 7B, is presented as a more robust option. It may be understood that different groupings of the portrayed light sources 2 and sensors 4 would give the information portrayed earlier in FIGS. 5A, 5B, 5C, 5D, and 5E. Other arrangements may be used.

FIGS. 36A-F show additional configurations light sources and sensors. The term ring is used to describe any shape of housing for the light sources and sensors. A round shape is not required. FIG. 36A shows two sets of three pair of LEDs and sensors in a ring approximately 1 inch in outer diameter with a 0.5 inch center opening. FIG. 36B shows a smaller ring with an outer diameter of 0.8 inch and an inner diameter of 0.325 inch. In this example, one set of three pair of LEDs and sensors are provided a first radius from the center, and a second set of three pair of LEDs and sensors are provided at a second radius from the center. FIG. 36C shows a ring with concentric alignment of two sets of three pair of LEDs and sensors. In this example, the devices within each set are spaced 60° apart. FIG. 36D shows a ring with concentric alignment of two sets of six pair of LEDs and sensors. In this example, the devices within each set are spaced 30° apart. FIG. 36E shows a ring with the alignment of two sets of four pair of LEDs and sensors. FIG. 36F shows a ring with an offset alignment of LEDs and sensors. These examples are illustrative of a much broader set of possible arrangements of light sources and sensors.

Figure 8:
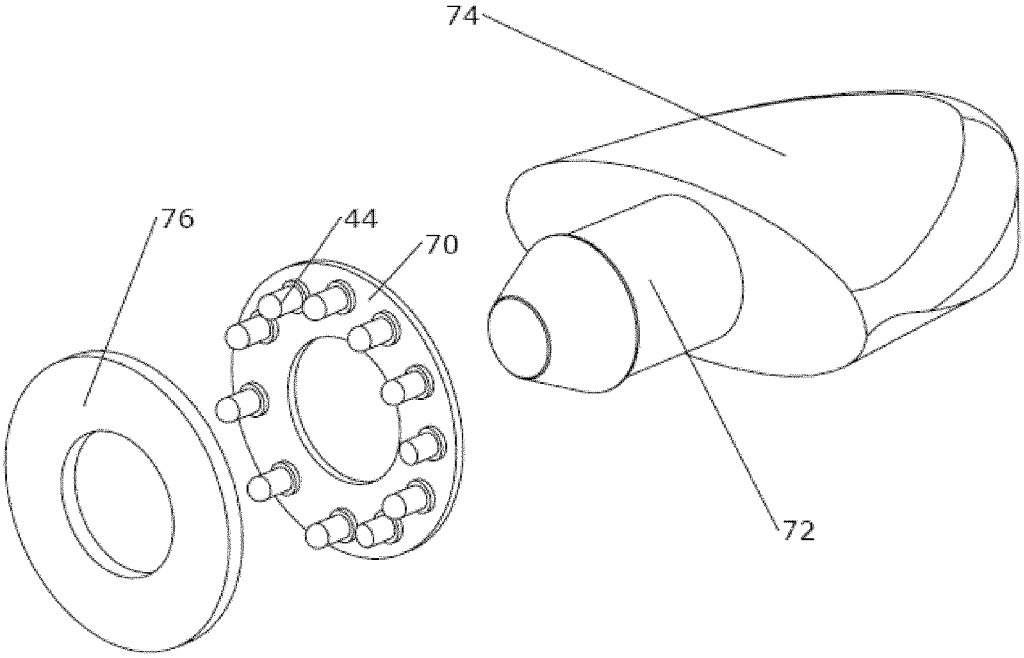
FIG. 8 is a representative diagram that illustrates how a group of LEDs in a ring structure can be placed over a deposition device such as an electrostatic applicator.

FIG. 8 illustrates an embodiment of how such a group of eight LEDs 44 in a ring structure 70 can be placed as a yoke over the nozzle 72 of a deposition device 74, for example over an adapted SK II Airtouch™ electrostatic applicator. A donut-cut circular polarizer 76 fits over the ring structure 70, and a final screw-on shroud with o-rings (not shown) is provided. It may also be desirable to modify aspects of the sprayer, such as the size of the spray orifice.

Example—Sensor Ring with 3 Pairs of LEDs and Sensors

In this example, a black Delrin® acrylic ring was provided as a holder for the multiple light sources and sensors. The ring is about ¼ inch thick, and has an outer diameter of 1 inch and an inner diameter of ¾". A plurality of 3 mm holes were drilled in the ring so that each hole received a portion of an LED or sensor device. In this example the 3 mm LEDs and 3 mm sensor devices were slightly recessed in the holes to permit the material to intercept stray light. A circular polarizing filter, such as obtained from a camera store, may be placed on the bottom portion of the ring.

Figure 22:
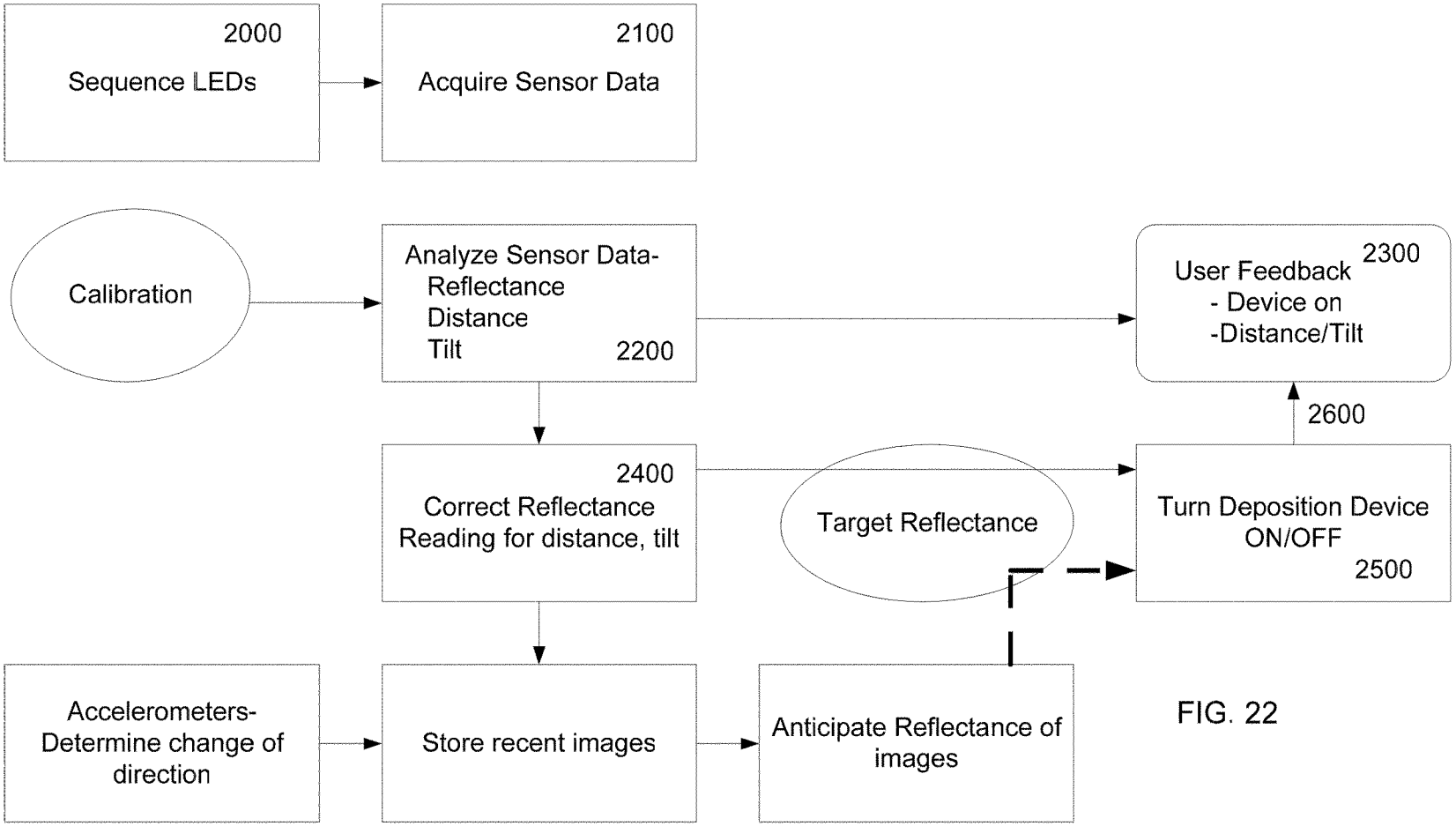
FIG. 22 is a block diagram of a general control scheme for an example embodiment.

FIG. 22 is a block diagram of the general control scheme in this example. At Step 2000, a conditioned signal turns the LEDs on and off in a desired sequence so that data can be acquired while each LED is ON, and then while each LED is OFF. At Step 2100, the sensors acquire data for each LED when the LED is ON and when the LED is OFF. At Step 2200, the sensor data is analyzed to determine reflectance, distance, and tilt. At Step 2300, the apparatus may provide user feedback on distance and tilt. At Step 2400, the reflectance reading is corrected for distance and tilt. At Step 2500, the control provides signals to turn the deposition device ON and OFF. At Step 2600, the apparatus provides a feedback, such as a sound, light, or vibration, to the user when deposition device is ON. The combination of this feedback and the distance and tilt feedback at Step 2400, provide a method for training the user in more effective application techniques.

In a demonstration device, these control functions are provided in software. In a consumer product, the control functions can be provided in a control circuit within the apparatus which sequences the LEDS, captures measurements, calculates adjusted reflectance, drives one or more user feedback device, and drives a deposition device.

In this embodiment, the LEDs and sensors are positioned around the ring of a diameter of approximately 1 inch diameter. The devices are aimed at a plane approximately ½" below ring so that the area of intersection of the sensors and light sources is about ⅛ to 3/16 inch. The light sources are sequenced or modulated so that each sensor detects each light source independently. Therefore there are nine data points available to calculate the four variables.

In some cases, the sensors opposite a light source may be averaged so that there are effectively six data points for the four variables. In either case, the system can be calibrated by taking multiple data points at various tilts and distances from targets of known reflectance. This data can be statistically analyzed in order to return response curves for each of the variables of distance, first axis tilt, second axis tilt, and reflectance.

In some cases the light sources or sensors may not be focused in the middle axis of the sensor. In some examples, the sensors or LEDs may be deliberately aimed at a point other than the centerline of a sensing device. This difference in aim point can be compensated during the calibration process.

Example—Sensor Ring with 2 Sets of 3 Pairs of LEDs and Sensors

Figure 16:
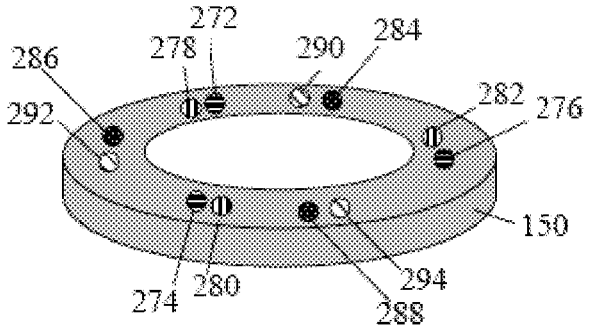
FIG. 16 is a top perspective view of one embodiment of a sensor ring.

FIG. 16 shows a representative sensor ring 150 with two sets of three pairs of sensors. A first set comprises LEDs 272, 274, and 276; and sensors 278, 280, and 282. A second set comprises LEDs 284, 286, and 288; and sensors 290, 292, and 294. The devices are inset into the ring.

In other examples, un-encapsulated LEDs and sensor devices may be placed or fabricated in a substrate which is then covered with a lens material. A circular polarizing filter can also serve as a protective lens cover to the devices.

Figure 17:
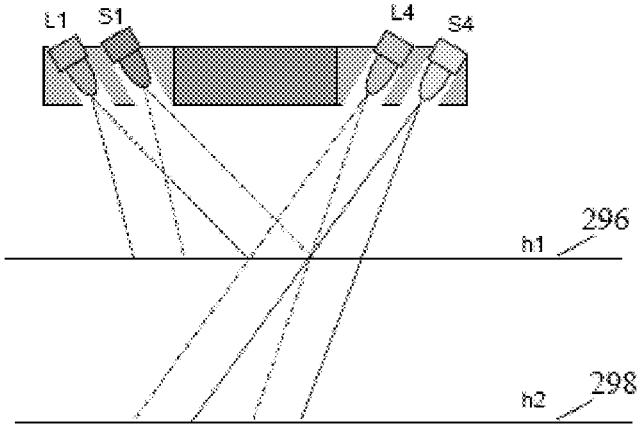
FIG. 17 is a cross section view of the sensor ring of FIG. 16.

As illustrated in FIG. 17, the first set of sensors and LEDs are aimed at a first plane at a distance h1 296 located approximately ⅜" below the sensor ring, and the second set of sensors and LEDs are aimed at the second plane at a distance h2 298 located approximately 9/8" below the sensor ring. This sensor ring was used in combination with a modified airbrush to provide selective deposition of cosmetic agent according to the sensor readings and a selected threshold.

A circular polarizing filter (not shown) may be attached to the bottom of the ring, and may be constructed from the combination of a polarizing filter and a ¼ wave retardation plate.

Example Configuration

In this example, six pairs of LEDs and sensors are equally spaced around the example ring. The three pair of sensors are aimed at a first height of ⅜ inch, and an alternating three pair of sensors are aimed at a second height of ⅝ inch.

In one embodiment, it is desirable to cycle the sequence of lighting of the six LEDs so that each LED is on at a time when all other LEDs are off. As each of the first set of LEDs (L1, L2, and L3) is turned on, data from each of the first set of sensors (S1, S2, and S3) is acquired for each of the first set of LEDs in both an "ON" and "OFF" state. Then, as each of the second set of LEDs (L4, L5, and L6) is turned on, data from each of the second set of sensors (S4, S5, and S6) is acquired for each of the second set of LEDs. This sequencing can be accomplished by a timing circuit as discussed below, or by having each LED driven by a modulation function.

In this case, the device sequencing is based on 88 kHz so that standard audio equipment might be employed. During each cycle, each LED will turn on and off so that data can be acquired from its associated sensors. For instance, LED 1 will be turned ON and data will be acquired for S1, S2, and S3. Then LED 1 will be turned off and data will be acquired for S1, S2, and S3. This data acquisition process will be repeated for each LED in each cycle. Preferably, this sequencing is programmable in order to permit evaluation of alternate strategies. Other timing or modulation strategies may be employed.

Figure 37:
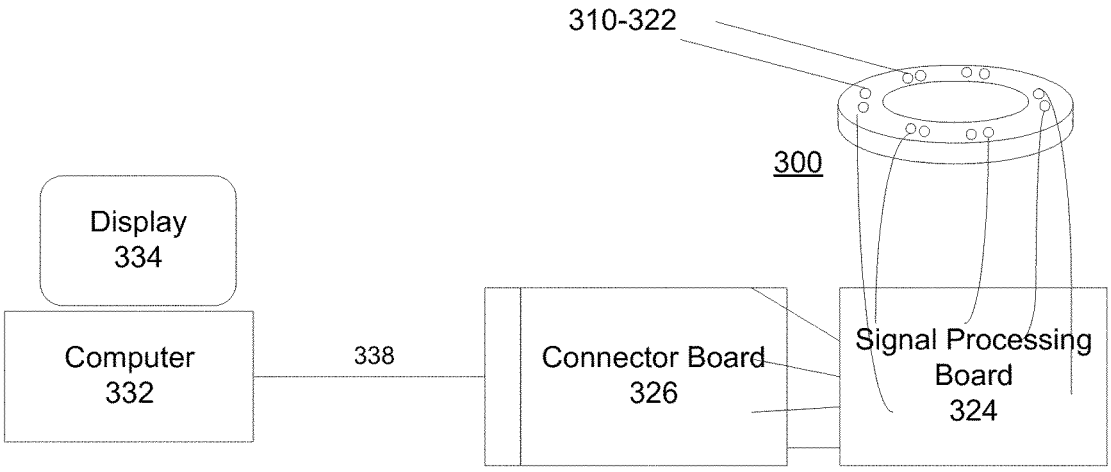
FIG. 37 is a block diagram of a demonstration device comprising a test head with LED and photodiode devices, a signal processing board for providing power to the LEDs and for capturing the signal from the photodiodes, a connector board, LabView™ data acquisition software from National Instruments, a data acquisition board in a computer, a computer display, a connector board, and a shielded cable from the connector board to the data acquisition board.

A diagram of a demonstration device of this example is shown in FIG. 37. This demonstration unit comprises a test head 300 with LED and photodiode devices 310-322, a signal processing board 324 for providing power to the LEDs and for capturing the signal from the photodiodes, a connector board 326, LabView™ data acquisition software 328 from National Instruments, a data acquisition board 330 in a computer 332, a computer display 334, a connector board 336, and a shielded cable 338 from the connector board to the data acquisition board. The purpose of this demonstration device is to evaluate responses of the sensor head to changes in position tilt and reflectance. The actual responses may be compared to simulation results in order to gain more confidence in the use of simulation to evaluate design strategies and parameters.

Digital Control

In this embodiment, the primary device control decision is whether to turn the spray device on or off. When the deposition device is turned on, a relatively large area may be affected. One unexpected result of the current invention is that it is possible to achieve surprising results with a relatively blunt tool. By depositing several passes of a thinly applied RMA, relatively gross resolution can produce good results. This type of result is difficult or impossible to achieve with a manual application using similar deposition devices. One aspect of the current invention is the ability to provide control of the deposition in order to precisely deposit an RMA.

In this embodiment, a useful control device is provided with relatively simple and inexpensive light sources and sensors. The control device may operate a sprayer or drop control deposition device which has a relatively wide deposition path. A relatively large area of spray is a practical requirement for one embodiment of the current invention so that a deposition over a large area may be completed in a reasonably short period of time.

Computerized Calculation of Enhancements

The general pixel-level application of cosmetics is practical through computerized control which is unachievable manually. This control acquires data about the characteristics of the surface, such as skin; to calculate cosmetic enhancements, and to achieve those enhancements by the precise deposition of cosmetics onto the surface.

Figure 10:
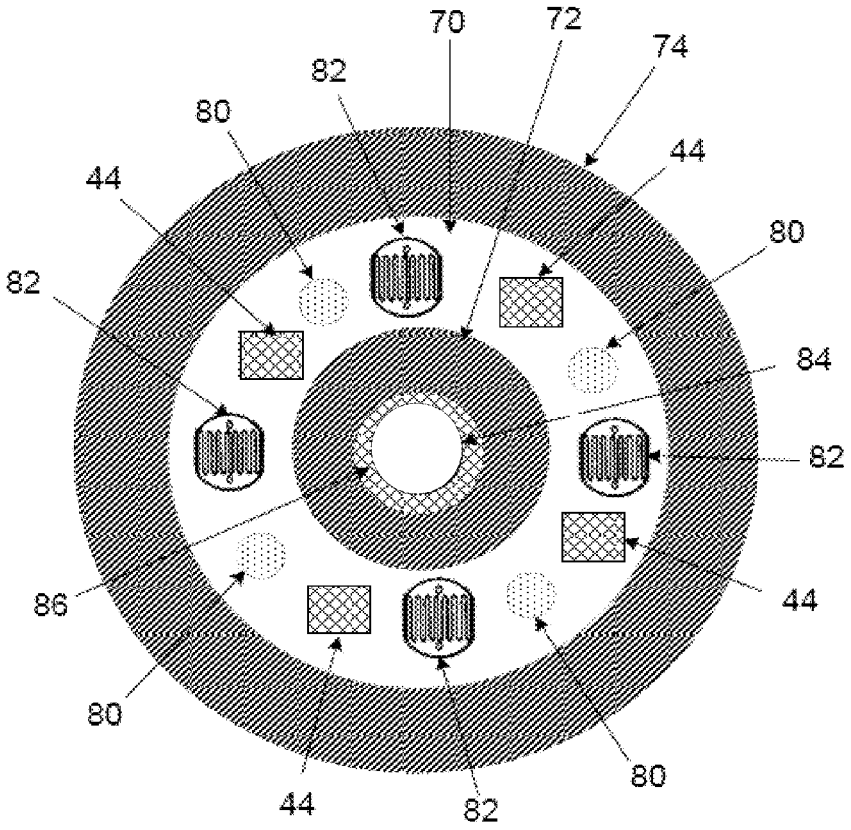
FIG. 10 is a representative diagram that illustrates the underside of an eraser brush ring structure.

To achieve computerized control, one or more microprocessors or control chips 80, shown in FIG. 10, may be used. In an embodiment, these control chips 80 may be preset for certain density levels, where density is the aim reflectance (albedo) of the surface. In another embodiment, they may be set to density levels by the user, as explained below.

For example, in an embodiment the erase brush may be used to enhance an electrostatic deposition device 74, such as an electrostatic applicator 88. One or more control chips 80, shown in FIG. 10, may be used with LEDs 44 and photocells 82 in a ring structure 70 that may be placed over the nozzle 72. These control chips 89 may be used to control an electronic valve 86 that opens and shut to control the flow of cosmetics through the aperture 84 of the nozzle 72, to achieve a desired density level.

Timing

As the speed of the application device increases, it is important to accurately estimate the point of application while the Eraser Brush is being moved over the surface to be treated. For example, deposition may be adjusted for the predicted trajectory of the cosmetic being applied, in methods known to those skilled in the art.

Figure 9A:
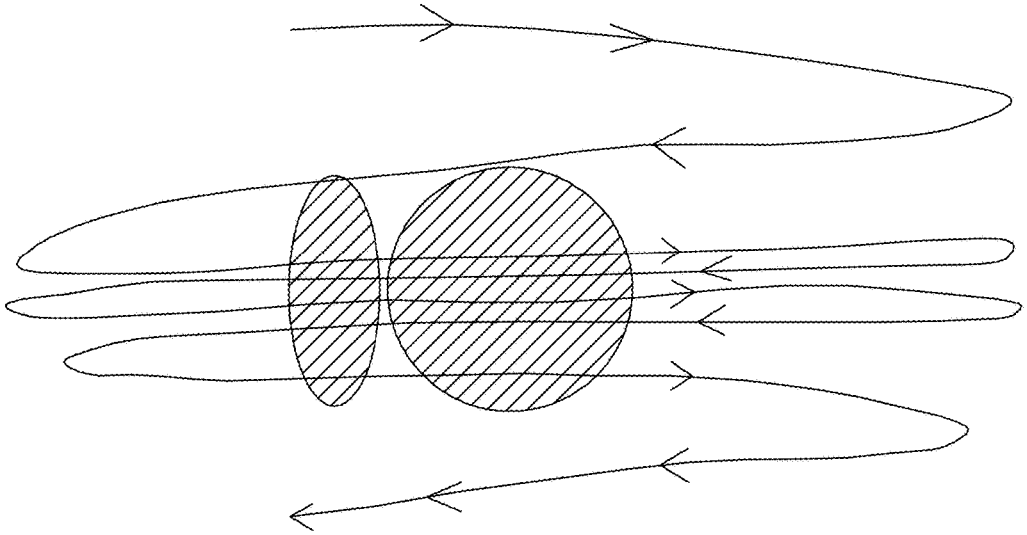
FIG. 9A is a representative diagram that illustrates the erasing motion used with an eraser brush.

Because of mechanical lag times, it may be difficult to modulate the deposition in real time over a stain or defect without incurring mis-registration due to time lags. One solution is to require the user to move the brush very slowly so as not to outpace the mechanical reaction time of the deposition device valves or controls. However, it is anticipated that the natural mode of operation for a user will be to attempt to operate the device as an eraser, that is, with rapid back and forth movement, as shown in FIG. 9A. In one embodiment, this mode can be accommodated through use of at least one accelerometer.

It is desirable to provide a high accuracy in determining and correcting reflectance. Typical skin variations may be on the order of 3-4% variation, so it is desirable to control to a higher accuracy than those observed variations.

One control strategy to improve accuracy is to move slowly as discussed above. Another control strategy is to improve the repetitiveness of movement in order to reduce error.

Many different means of deposition, known to those skilled in the art, may be used with the eraser brush to apply cosmetics to a surface. In an embodiment, a spray technique may be used for the deposition. For example, an airbrush technique may be used. In another embodiment described below, a drop control technique may be used for the deposition. For example, an inkjet technique may be used. Some other examples of means of deposition are a pressurized chamber with an on/off valve, and an electric motor.

A proper distance should be maintained from the surface to be enhanced for effective deposition through an aperture of a specific size, based on the results of empirical studies.

For example, a tube surrounding the aperture of the applicator on the eraser brush may be used to maintain a proper distance between the aperture and skin.

Cosmetic Reservoir

Figure 12:
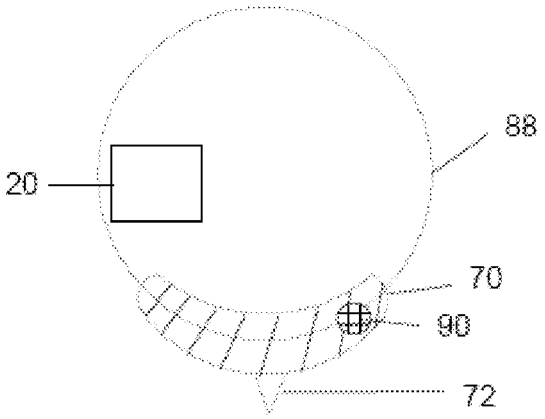
FIG. 12 is a representative diagram that illustrates an SK II Airtouch™ electrostatic applicator modified for use as an eraser brush.

As shown in FIG. 12, a replaceable cosmetics reservoir 20 may be used to contain the cosmetics, typically configured in association with the means of deposition, in this example an airbrush applicator 88. The cosmetics reservoir 20 is shown only as a block, but it may have a visually appealing design. In an embodiment, the cosmetics reservoir 20 may contain multiple chambers with multiple separate cosmetic colors that may be mixed to achieve desired effects. In another embodiment, it may contain a single RMA color premixed to achieve a desired aim color or effect.

Applying Small Amounts of an RMA to an Area of Skin

The eraser brush permits the efficient computerized application of conventional cosmetics that are used in small amounts selectively at the pixel level, as well as the application of inks and dyes.

In one embodiment, rather than covering up a defect an opaque color matching the skin, the color of the skin is nudged to a desired result with very dilute, almost transparent puffs of highly differentiated RMA. With human skill and time limits it is impractical or impossible to successfully apply highly differentiated RMA without computer assistance.

In this embodiment, the cosmetic is applied to only a small fraction of the skin surface, typically to less than 20-40% of the skin surface being treated, and only in very dilute, virtually transparent puffs. This approach preserves visual biological flags of real human skin and provides a stealth makeup. By transparently removing the middle spatial frequencies of age spots, the desirable higher spatial frequencies smaller than the deposition spot size remain.

The RMA may be applied in multiple passes as described in an embodiment below.

Simulation

Simulation may be used to evaluate alternative configurations of light sources and sensors. By assuming various configurations, illumination and sensor sensitivities, we can then simulate the illumination readings on each of the devices and use that data to evaluate the capability of the device to compensate for various errors.

Example Simulation

In one example simulation, LED factors include Intensity (I), Wavelength, Beam angle ($\Theta$), radial distance from centerline ($r_L$), the angular location from a reference axis ($\beta_L$), and angle of aim ($\gamma_L$). The sensor factors include the photodiode sensitivity at the wavelength of the LED, the viewing angle ($\Theta$), radial distance from centerline ($r_S$), the angular location from a reference axis ($\beta_S$), and angle of aim ($\gamma_S$). The local surface is described as a plane of interest located a distance (h) below the center of the ring, and having a first axis tilt ($\alpha_x$) and a second axis tilt ($\alpha_y$).

In this example, the plane of interest comprises a plurality of cells. Each LED projects a beam to the plane of interest, and that beam profile can be calculated at each cell center as the product of a Gaussian distribution component and a $1/L^2$ component to account for the decrease in illumination per surface area as the distance L increases.

Figure 39:
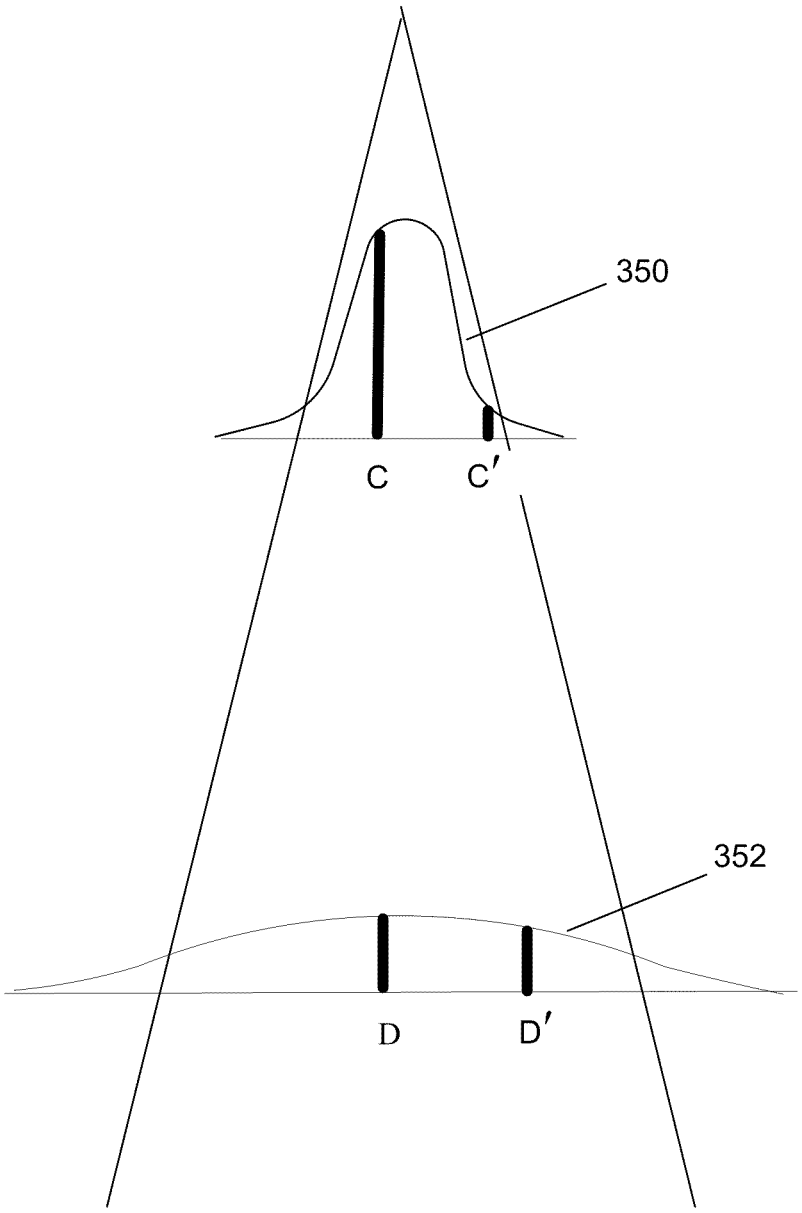
FIG. 39 is a two-dimensional example of Gaussian beam distributions with a $1/L^2$ contribution.

FIG. 39 shows a two-dimensional example of this type of analysis. A first Gaussian distribution 350 is shown at a first height, and a second Gaussian distribution 352 is shown at a second height. Point C represents a cell near the center of the beam, and C' represents a point further from the center of the beam. The difference in intensity is due to the distance from the beam center. Points D and D' are the same distance from the beam center as C and C', but have lower intensities because the illumination per unit area has decreased with the further distance from the source. These differences are the $1/L^2$ contribution.

For purposes of this simulation, other factors such as the relative tilt of the cell to the normal to the beam, and loss of total light with distance are not considered. If desired, the simulation can be expanded to consider additional factors. A similar calculation can be made for the sensor. A simulated sensitivity reading may then be made by summing the contribution of each cell within an area of interest. A cells contribution is calculated as the product of the LED illumination on the cell and the Sensor beam viewing intensity of that cell.

Figure 40:
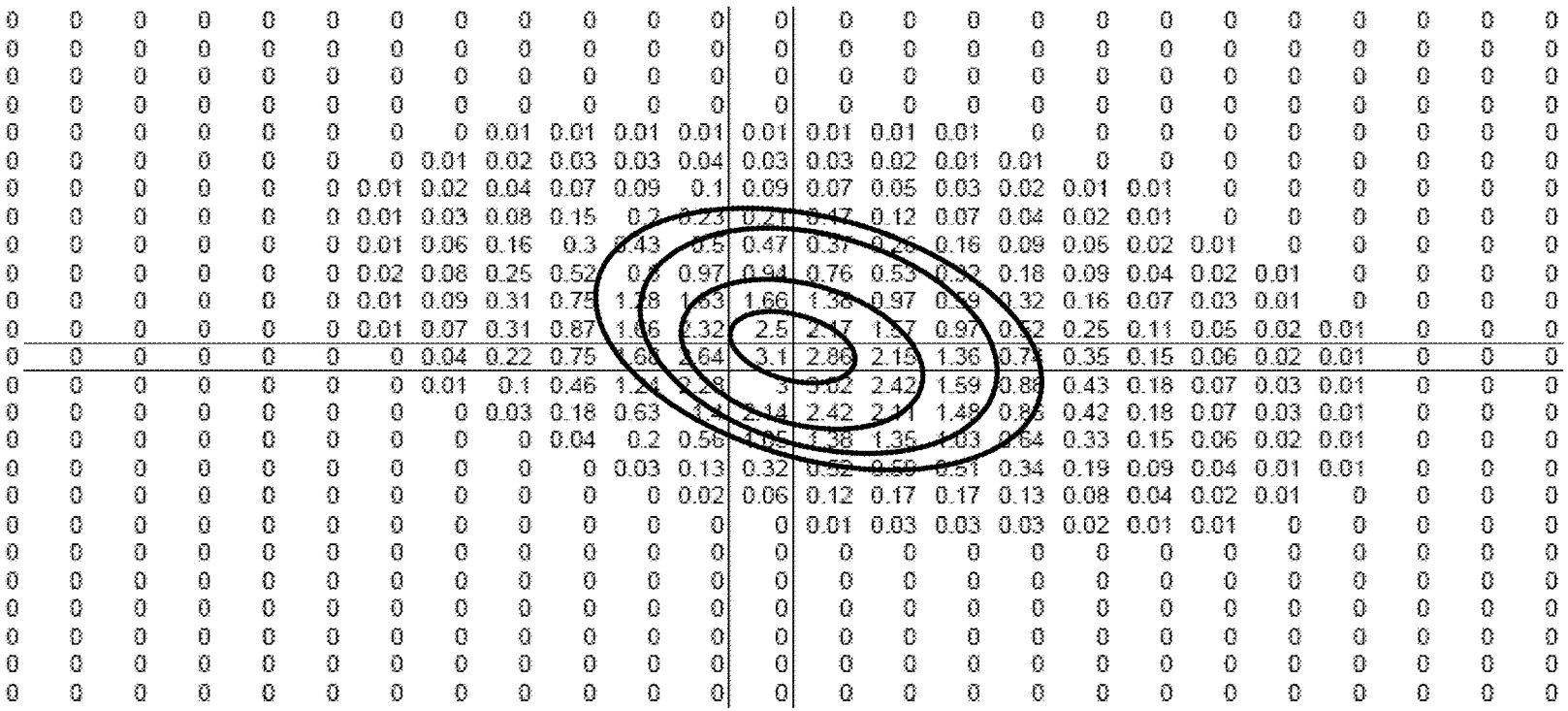
FIG. 40 is a representative result for responsivity of a grid of cells.

For grids of cells, the result of this simulation is typically all or a portion of an elliptical intersection pattern. FIG. 40 is a representative result for responsivity of a grid of cells.

Description of Embodiment—Use of LEDs and Camera to Provide Accurate Reflectance Measurements to Support Digital Control of Cosmetic Spray Device In this embodiment, a combination of LEDs and cameras are used in a scanning and deposition device to provide accurate measurement of surface reflectance. Data is acquired with the cameras to determine distance from the surface, tilt of the surface, and actual reflectance. The device is typically used for the specific application of cosmetics such as described above.

In typical embodiments, one, two, or three cameras may be used. In one example, a camera is used that operates at a rate of 60 frames per second and can evaluate a field.

Cameras can provide much more data about an area of interest than photocells, such as photodiodes or photo transistors, can. For example if an LED beam had the surface profile of FIG. 40, a camera can provide more information about the distribution of an LED beam versus the single intensity reading from a photodiode. This increased data may thus provide more accurate information about the center of an area of interest. Because of the increased data that may be obtained from cameras, a few cameras may be used with a greater number of LEDs.

Data from Leading and Trailing Images

In addition, the increased data from cameras may be used for the analysis of the leading and trailing images obtained. For example, the leading edge of the camera may be used to capture data about the area of interest. The control device's software may then analyze that data and have RMA deposited on the area to achieve a percentage of a desired reflectance. The trailing edge of the camera can be used subsequently to capture data about the area of interest after that deposition, and the control device's software can then analyze that to determine how much RMA still needs to be applied to the area. This technique may speed up the process of sensing, analysis, and deposition in many passes.

One or more cameras maybe used in a stereoscopic approach to determine the position of the control device relative to the area of interest. Reference marks may be projected by LEDs to known locations, and the control device's software can then record and analyze the positions of those marks to determine distance and tilt.

In one embodiment, a first LED projects a pattern such as a dot in each of the four corners of an area of interest. A second LED light source projects in uniform field to the area of interest, so that the stereoscopic effect of using data from two LEDs with different locations may be obtained. The first LED provides a pattern which can be used to determine distance and tilt of the surface with respect to the sensors. This first LED also provides data which can be used to offset the effect of ambient light.

In another embodiment, a plurality of LEDs are projected onto a small area of interest. Camera readings from that area are then calibrated to determine distance, tilt, and adjusted reflectance.

To remove the effects of ambient light picked up by a camera, which might distort reflectance readings, a first frame may be taken by the camera with one or more LEDs on. A second frame may be taken with the LEDs off, so that data about the ambient light is captured. The reflectance differential between the first and second frames may then subtracted from the first frame's reflectance data.

Example—Test Device

Figure 18:
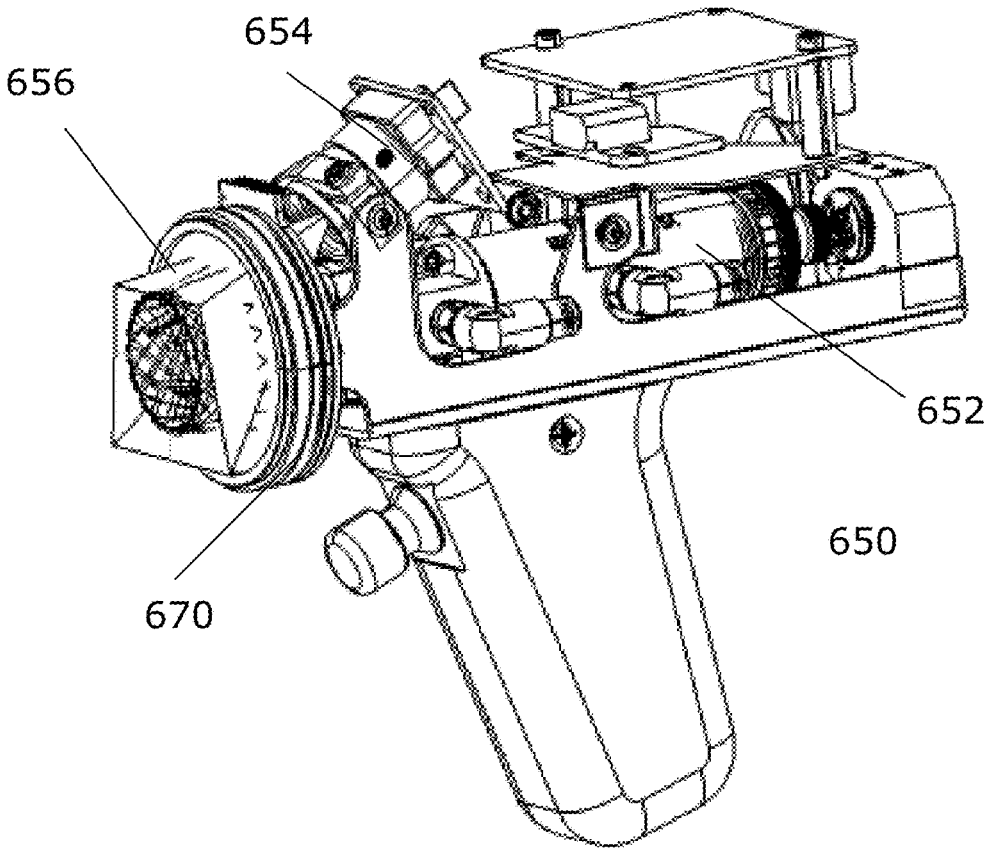
FIG. 18 is a side perspective view of a camera and spray test device.

FIG. 18 is a side perspective view of a test device 650 which was designed and built for scanning and depositing an RMA on skin. This device is substantially larger than a typical commercial handheld embodiment because it uses an industrial microsprayer 652, EFD787MS (microsprayer) with EFD8040 Valve Controller, which has the capability to spray a wide range of materials under a variety of spray conditions during testing evaluation. The test device comprised a Unibrain Camera 654 with Lens Part #2043 with a customized controller board, VGA 640×480 at 30 frames per second, RAW CCD Sony ICX-098BQ with remote lens attachment, a Hoya Polarizing Filter 656.

Figure 19:
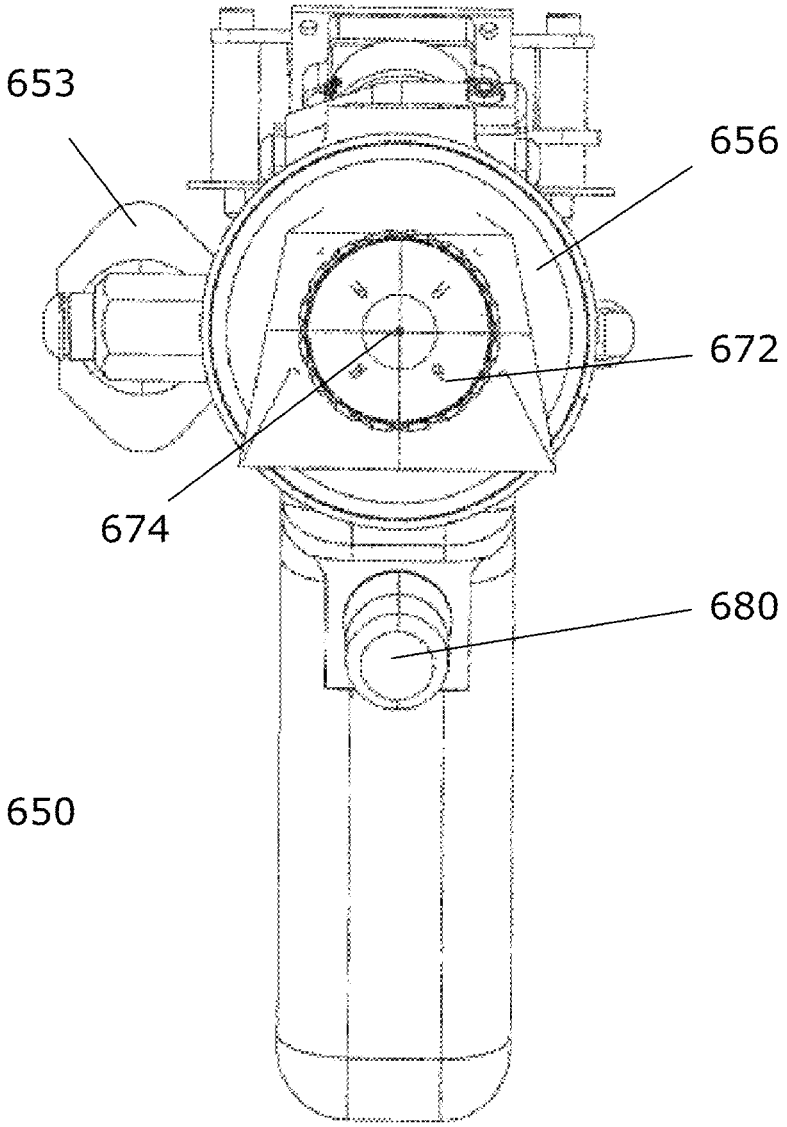
FIG. 19 is a front view of the device of FIG. 18.

FIG. 19 is a front view of the device showing the large circular polarizing filter 656. A set of 12 green wavelength 3 mm 2000 mcd, 20 mA, 3.6 Vf LEDs 670, are provided in a circular arrangement behind the polarizing filter (shown in FIG. 18). Four red 650 NM, 2.5 mW lasers 672 are provided for projecting four points onto the skin surface so that the relative position of the points may be used to determine device height and tilt.

The sprayer 652 includes a supply cartridge 653 for an RMA composition, an inlet compressed air port, and a cabled connection to the spray controller (not shown) for the sprayer. The RMA composition is delivered through an interchangeable needle 674 which protrudes through a hole cut in the polarizing filter. In this example, the needle lengths and diameter can be changed by changing needles, and the air pressure and other spray parameters can be adjusted. In commercial devices, the number of controllable deposition element parameters is expected to be significantly reduced as the deposition element is matched to the expected RMA composition(s). In one simple form, for instance, the deposition control is a simple ON signal. In this example, the camera 654 is mounted at an angle of approximately 30 degrees with respect to the sprayer axis. In other embodiments, the camera and spray device may be collinear. As described below, software adjusts the camera image so that the needle and other device artifacts are removed from the image.

For operator convenience, the device may be mounted on a Miscroscibe Arm with a MicroScribe G2 3D Digitizer, or be handheld.

In this example, the camera image is provided to a computer (not shown) by a cable connection from the camera board to the computer. A separate control circuit board (not shown) is also provided for the LEDs, and power is supplied by an external connection. The LED controller has the capability to sequence the LEDs in any desired order, or to turn all LEDs on and off at the same time. A commercial device may be self contained with a power source and one or more microprocessors so that computers and external power supplies are not required.

Figure 20:
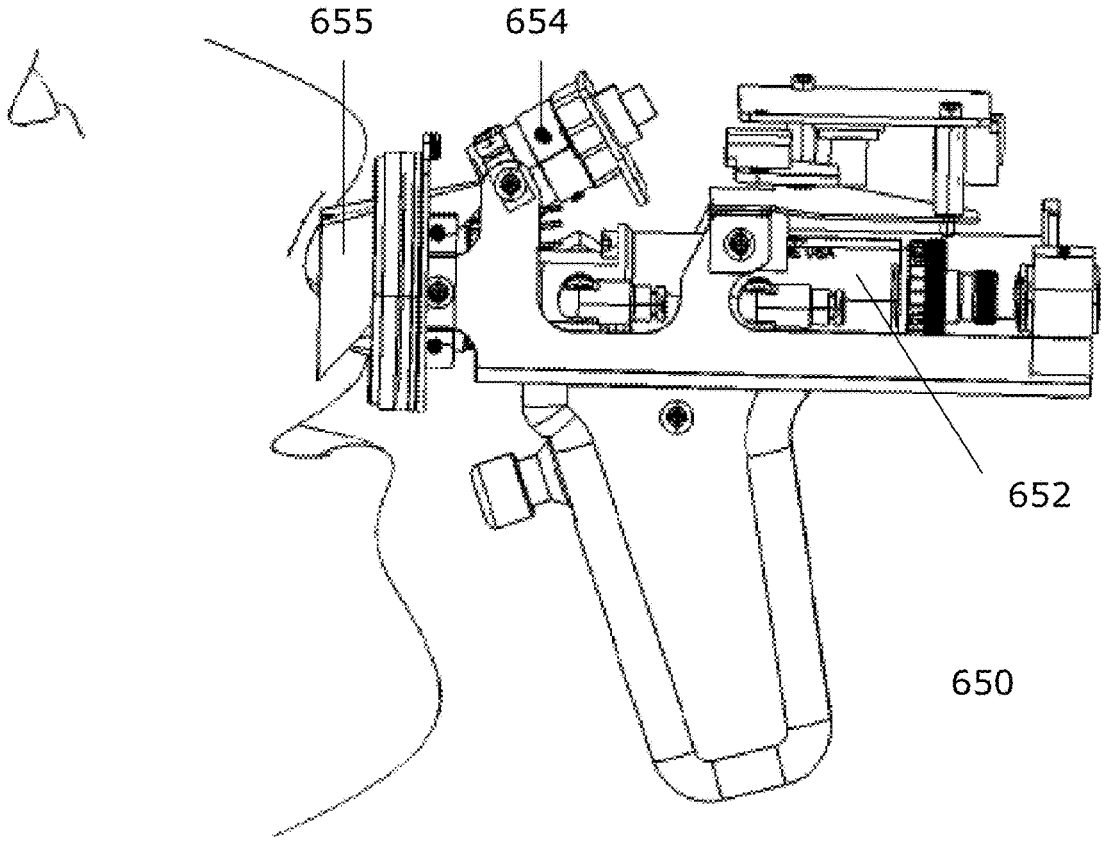
FIG. 20 is a side view of the device of FIG. 18.

FIG. 20 is a side view of the device showing thew camera field of view 655 relative to a test subject. In this example, a trigger switch 680 is provided to activate the device. When the trigger is depressed the device can selectively deposit an RMA as it is moved over the surface.

In this example, the device may be hand-held or may be mounted on the 6 axis articulated arm in order to provide counterweight to assist a technician in moving the device over an area of skin such as a face, arm, or leg. In one test, with standard airbrush cosmetic compositions, device spray settings were selected to deliver approximately 1-2 micrograms per pulse of total composition dry mass. Subsequent tests reduced this application density. The number of pulses could be monitored during test sessions and compared to known number of simulated pulses in a corresponding PhotoShop simulation.

Figure 11A:
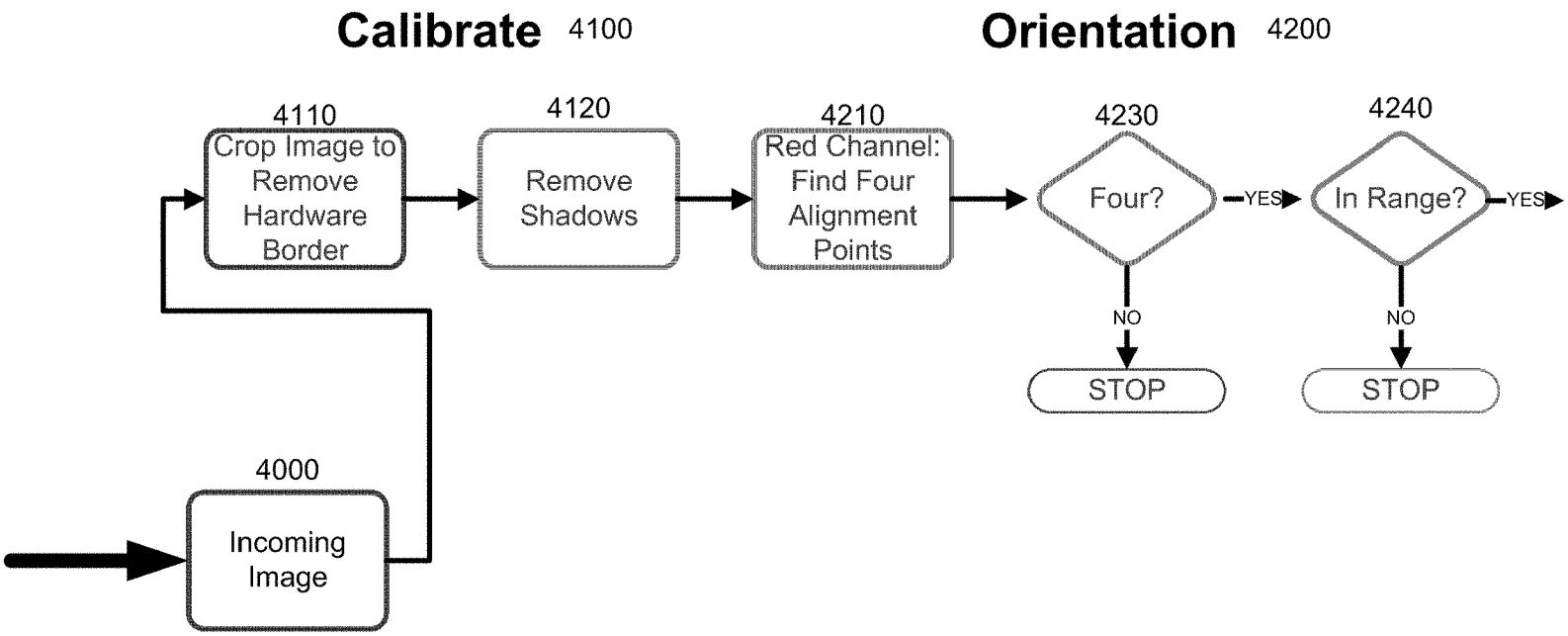
FIGS. 11A-11C are a control flowchart for a camera and spray test device.
Figure 11B:
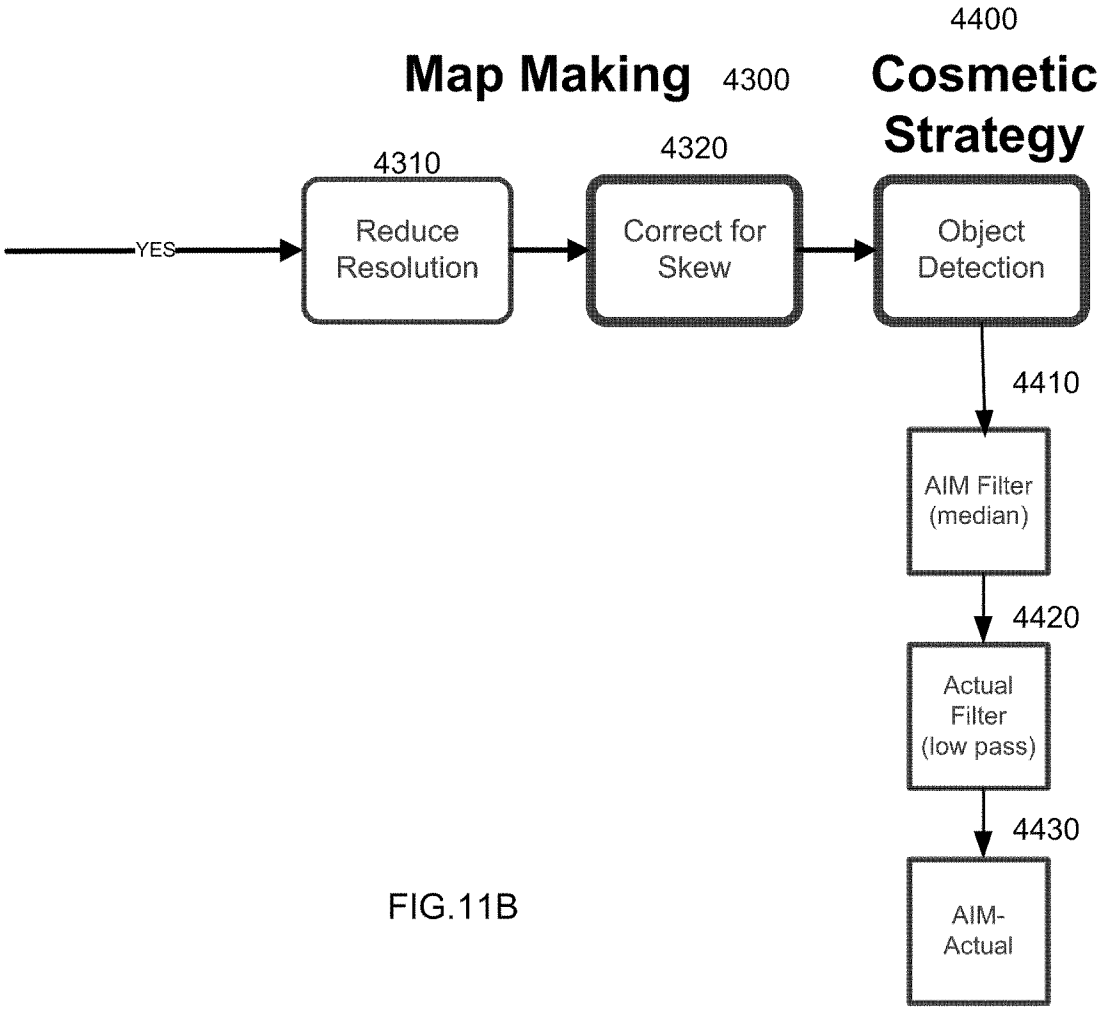
Figure 11C:
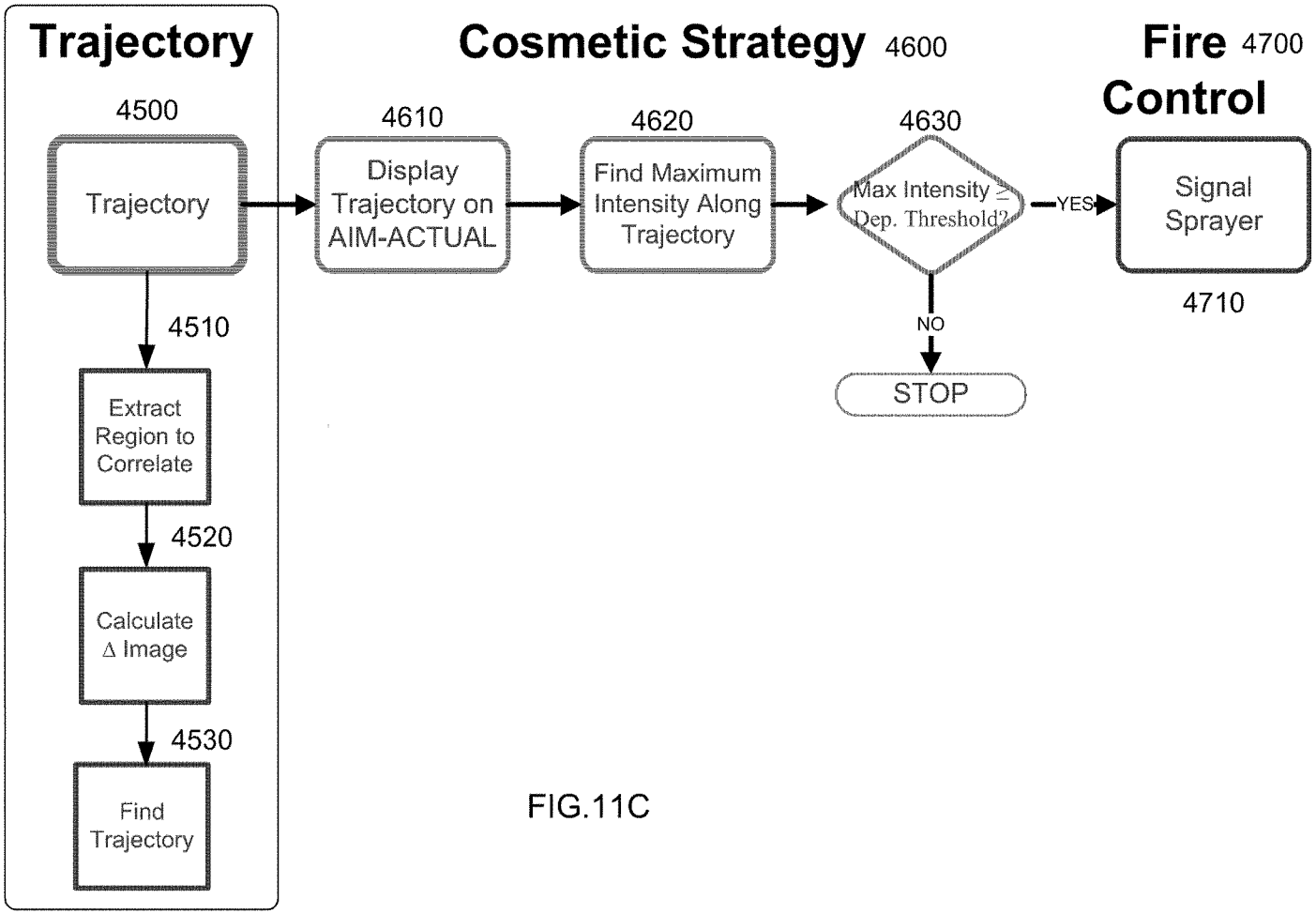

FIGS. 11A-11C presents a control flowchart for this example device. At step 4000 an incoming image is received. At block 4100, the image is calibrated by cropping the image at step 4110 and removing shadows at step 4120. At block 4200, the image is oriented by finding and checking for the four red laser alignment points at steps 4210 and 4230, and determining if the points are within range at step 4240. The image is further oriented in block 4300 by reducing resolution to improve processing efficiency at step 4310 and correcting for skew at step 4320. Block 4400 performs object or feature detection by performing a median filter based on a square area of 0.4 inches per side at step 4410 and a low pass filter based on a 1/15 inch spot size at step 4420. Block 4500 calculates a device trajectory based on the current image and the last few images by extracting a region to correlate at step 4510, calculating a difference in images at step 4520, and finding the trajectory at step 4530. A decision on whether and when to fire a spray is made in block 4600 by displaying the trajectory at step 4610, finding the maximum intensity along the trajectory at step 4620, and determining whether that maximum intensity is greater than a dark feature threshold in this skin lightening application. The actual spray control is at block 4700 including step 4710 to send a fire control signal to the sprayer. The control software for this test device illustrates one method of controlling a deposition. device of the current invention, and other control schemes may be used. In general, a control scheme performs smoothing to decide whether to request a deposition event at a particular time.

Description of Embodiment—Multiple-Pass Application of Cosmetic Substances with Digitally Controlled Deposition Device In this embodiment, the eraser brush is moved manually back and for across the area in multiple passes, to continually scan attributes of the area, for example lightness and darkness, relative to a set threshold designed to cosmetically improve the appearance of the area. The eraser brush automatically deposits the RMA, for instance a pigment-based cosmetic, until the threshold is achieved. Using multiple passes enable the eraser brush to apply a desired amount of an RMA effectively.

By depositing several passes of a thinly applied RMA, relatively gross resolution can produce good results. This type of result is difficult or impossible to achieve with a manual application using similar deposition devices.

This embodiment allows the use of highly differentiated RMAs for cosmetics, rather than, for example, a base color close to the skin color. For example, a light RMA may be applied in on dark skin features to lighten them so that they contrast less with the surrounding areas. After being passed over several times and receiving several puffs of RMA from the eraser brush, the skin is lightened to the selected degree, and no more cosmetic is applied to those frexels.

Figure 13:
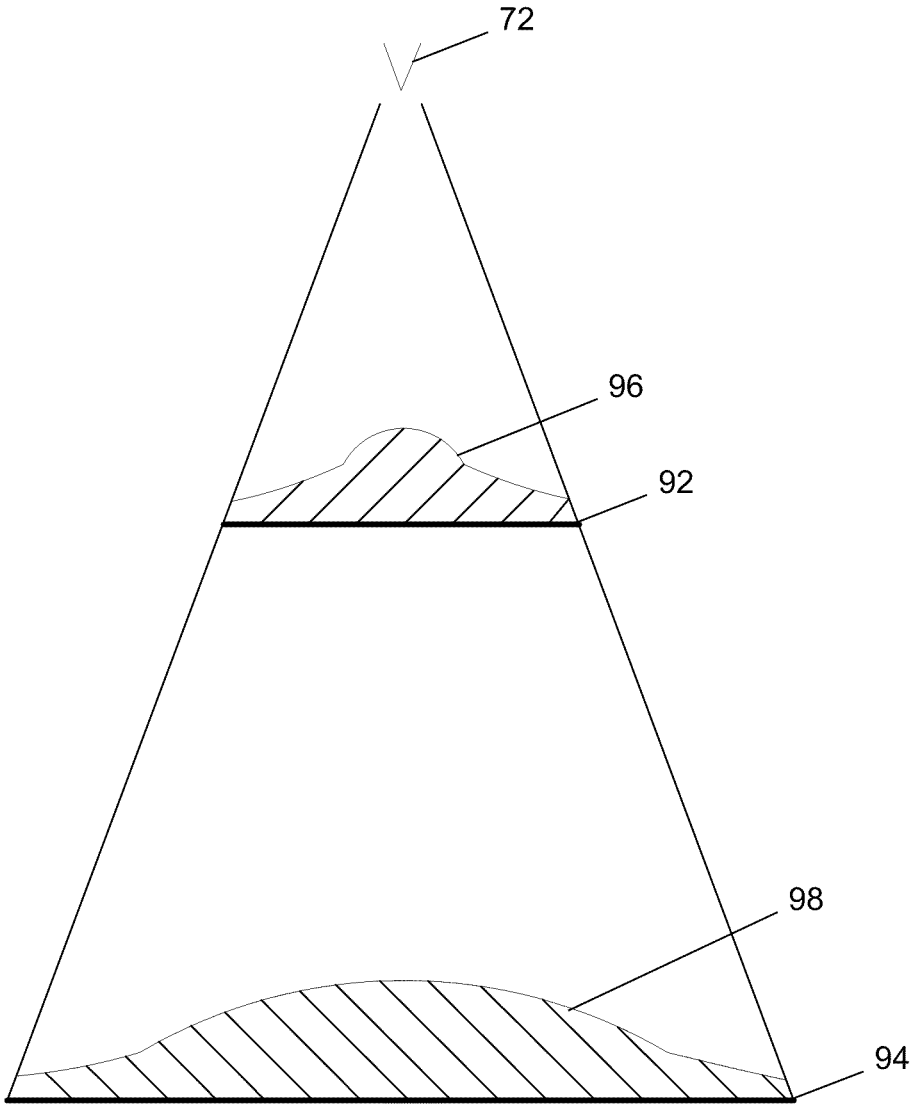
FIG. 13 is a chart that illustrates typical patterns of deposition made at different heights from a surface.

For effective application of cosmetics, the amount of the cosmetic being applied may be calibrated. For example, cosmetics applied at different heights from a surface will have different patterns of deposition, such as according to Gaussian distribution. FIG. 13 shows typical patterns of deposition at different heights. A cosmetic deposited through a nozzle 72 to a first surface 92 that is relatively close to the nozzle 72 will tend to have a first deposition pattern 96. On the other hand, a cosmetic deposited to a second surface 94 that is relatively farther from the nozzle 72 will tend to have a second deposition pattern 98.

Applying RMAs in multiple passes allows small diluted puffs of RMAs to be applied to an area until a desired reflectance is achieved. The cosmetic pattern of RMAs that is deposited does not require an absolute precision in reflectance or precise location of deposition, which might be measured quantitatively by machines. Instead, the cosmetic pattern should be aesthetically satisfactory to the interpretation of the human eye.

For aesthetic purposes, a small change in the direction of a perceived improvement often results in a large perceived improvement. Humans can perceive differences in images or portions of images as a function of the square of the differences of intensity.

For example, if a first image has a first intensity of a distracting, undesirable characteristic, and a second image has an intensity with only half (½) of the distracting characteristic, the second image will appear to the human eye to have about one quarter (¼) the damage of the distracting characteristic. This is one of the factors that permits substantial improvement in appearance in the current invention. RMAs can be deliberately and precisely applied in a manner to reduce the differences in intensity between portions of human skin. By reducing the faults of the skin even moderately, the "appearance" may be substantially improved. This is the reason that single color, as opposed to tri-color, or middle resolution printing as opposed to high resolution printing, or partial correction of defect as opposed to full correction, may provide visually substantial correction.

In one embodiment, RMAs can be applied with a precision that is equivalent to the resolution of the human eye. For example, a resolution of 20 pixels per millimeter at a distance of 10 inches (254 mm) is about 500 dots per inch (20 dpmm). This is a practical limit of the human eye resolution under good lighting conditions and a strong pure black and white contrast. Often, however, this high resolution is not needed, relaxing technical requirements of the camera and printing system.

As the explanation above shows, the eye applies its own interpretation to aesthetic matters, such as reflectance on skin. The fact can be used effectively for cosmetic enhancements made through multiple passes. For example, to make skin appear more aesthetically pleasing, a smoothing effect can be achieved by evening the reflectance patterns of light and dark spots on the skin through the application of RMAs to filter middle spatial frequencies. The absolute reflectance value of each spot does not need to be made exactly the same. Nor does application of RMAs have to be precisely within the boundaries of individual spots. Because of the powers of the eye's interpretation, a general reduction in contrast among the reflectance values of generally located spots may be seen as a distinct cosmetic improvement.

Description of Embodiment—Application of Cosmetic Substances with Combination of Digitally Controlled Drop Control and Spray Deposition Devices In this embodiment, at least one drop control deposition device is provided in combination with at least one non-drop control deposition device, such as an electrostatic sprayer.

In one example, the sprayer selectively applies a lightening agent, and the drop control device selectively applies transparent dyes.

Description of Embodiment—Use of Natural "Eraser-Like" Movements to Anticipate Reflectance Readings In one embodiment of the current invention, multiple passes of application are made by manually moving the device. A high speed of application is achieved by using a rapid back-and-forth motion, such as the eraser movement, or in a generally circular or elliptical motion.

Figure 42:
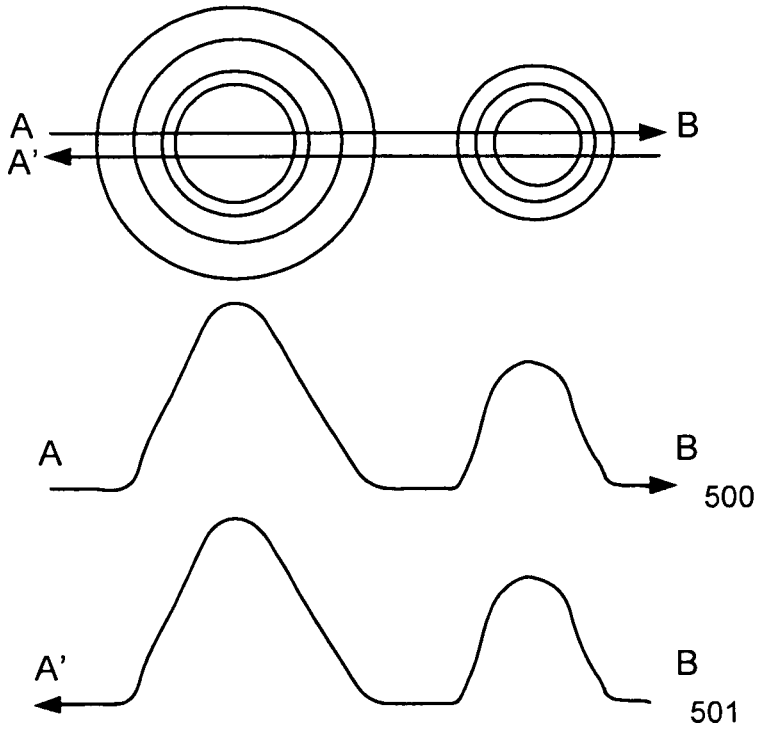
FIG. 42 is an example of a reflectance reading in a forward direction and a reflectance reading in the reverse direction over the same path.

Some principles of using repetitive movement to anticipate reflectance readings and improve device control are illustrated by the examples below. FIG. 42 is an example of a reflectance reading in a forward direction 500 and a reflectance reading in the reverse direction 501 over the same path. In general it is possible, to train a user to use a repetitive movement in order to predict reflectance and improve the accuracy of RMA deposition.

Example—Uniform Periodic Motion in One Dimension Across Reflectance Region

Figure 28B:
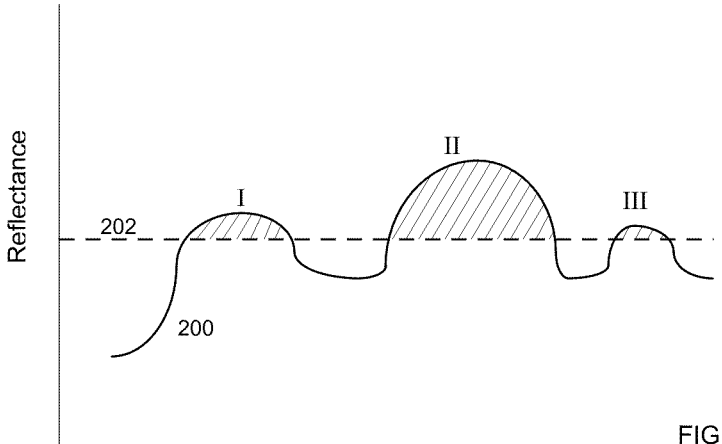
FIG. 28B is a plot of the original reflectance of the surface as a function of position for the example of FIG. 28A.
Figure 28A:
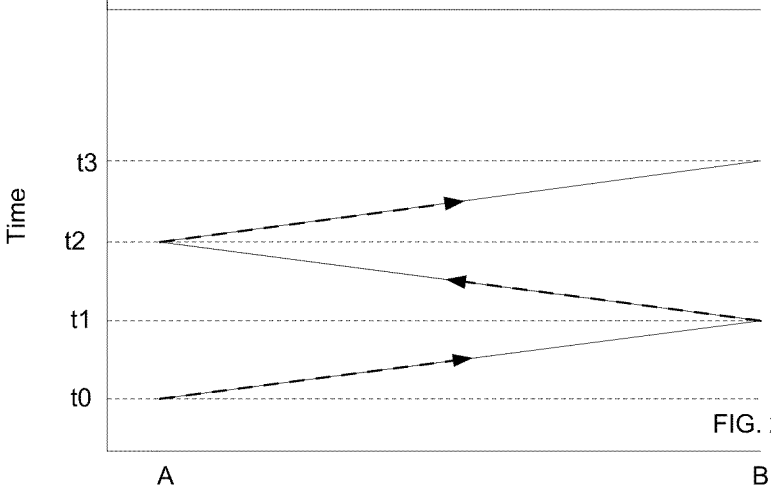
FIG. 28A is a plot of position versus time for an example application.

In this example, a sensor/applicator is moved back and forth between point A and point B as shown in FIG. 28A. In this example, the movement is at a constant velocity from A to B, then a reversal of direction and the same constant velocity from B to A.

FIG. 28B shows the original reflectance 200 of the surface as a function of position. In this example, the target smoothed reflectance $R_T$ 202 is given by the dashed line. The objective of the example is lighten areas I 204, II 206 and III 208 by adding a lightening agent to those areas.

In this example, there is no error of measurement of reflectance, and the period of the cycle A-B-A is assumed constant.

One approach to performing this lightening is to move the device slowly from Point A to Point B, and to apply the lightning agent in those regions where the reflectance is over the value of $R_T$. There are several practical difficulties with this approach. The treatment might have abrupt and easily noticeable edges, or overlapped portions may be noticeable. The calibration may not be accurate, and system errors may result in more or less than the target reflectance. The application time might be too slow to be of practical use.

Another approach to lightening the area between Point A and Point B is to use an "eraser-like" motion by rapidly moving the device back and forth between the points. The lightening agent is then deposited in multiple applications during these motions. Advantages to this approach include less abrupt edges, improved speed of application, and less error.

Read/Print Control Strategy

In this example, scan data is read in one direction and a correction is printed as the device travels in the reverse direction. Other scan and print techniques may be used in other examples.

In this example, the device has at least one accelerometer 210 (not shown) that detects motion and changes in motion. Referring to FIG. 28A, the device knows that the motion started in the positive direction at to, that the motion reversed at time $t_1$, and that the motion reversed again at time $t_2$ etc.

In this example, the device captures reflectance as a function of time as it moves from Point A and Point B. Then, when the device changes direction, the control logic assumes that it will traverse the same path and see the same reflectance in the reverse direction. For demonstration purposes, there is no error in this example, so that the device expects to see the same pattern of reflectance versus time that was detected from Point A and Point B.

This expectation may be validated as a sensor collects additional data in the travel from Point A and Point B. As long as the sensors detect the pattern of reflectance that is anticipated, then the device can apply an RMA with a high degree of confidence. However, if the actual measured pattern differs from the expected pattern, then that difference may be expressed as an error. The error may be used to be more cautious in applying the RMA.

One control strategy of this example is to subtract the error from the actual reflectance. If that adjusted value is greater than the target reflectance by a predetermined amount, then an RMA will be added. If the sum of those values is less than the target reflectance, the RMA will not be added.

In one embodiment, at least one form of feedback is provided to the user to indicate when RMA is applied. As described below, the user can "learn" how to better use the device through this type of feedback. For instance, if the user has a prolonged time without application of an RMA, the device may be silent and thereby advise the user that the repetition of the motion may not of inadequate to determine a desired correction with confidence.

Figure 28C:
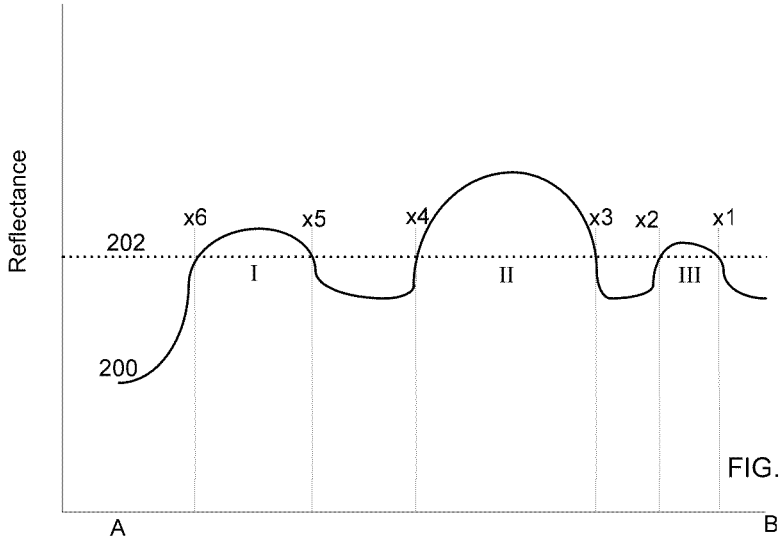
FIG. 28C is a plot of the original reflectance of the surface illustrating regions where it is desirable to add a RMA on a first pass.

In this example, as the device is move back to Point A from Point B, its control logic will cause it to add RMA in the approximate regions $x_1$ to $x_2$, $x_3$ to $x_4$, and $x_5$ to $x_6$ as shown in FIG. 28C.

Figure 29A:
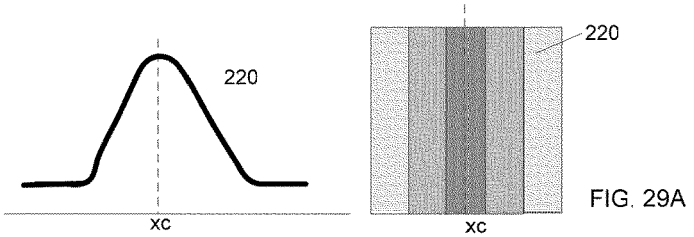
FIG. 29A-B is an example of spray distribution patterns for RMA to be applied to the surface.
Figure 29B:
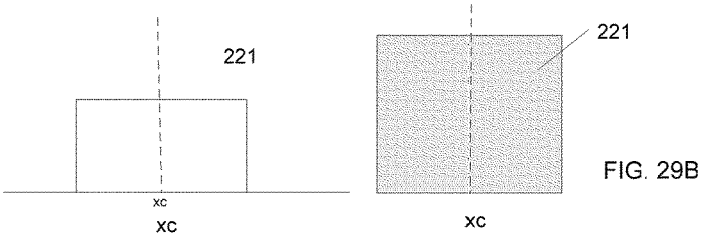

For purposes of this example, the RMA is assumed to be sprayed with a spray distribution 220 as shown below in FIG. 29A-B. This distribution is simplified for purposes of example. In subsequent examples, a two-dimensional spray distribution is assumed. In this example, the scale is exaggerated. In other examples, the RMA application may be uniform, or have other distribution patterns.

Figure 32:
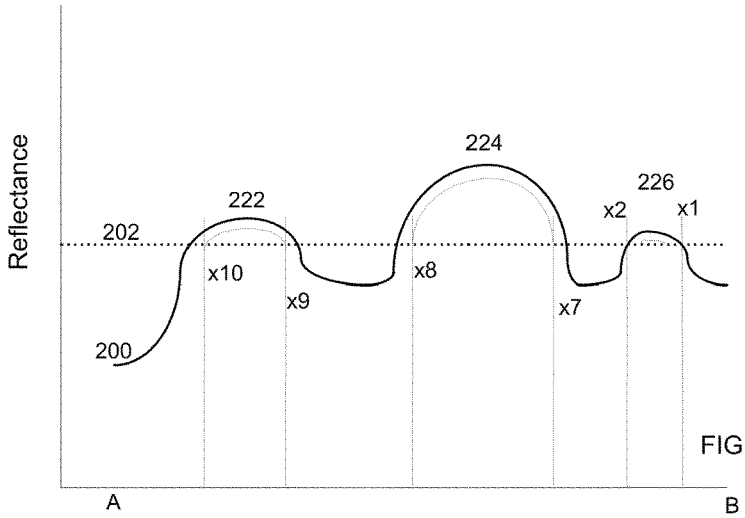
FIG. 32 is an example of the reflectance versus position after first pass of RMA application.

FIG. 32 is an example of the reflectance versus distance after first application of RMA. This example graph was generated by adding pure white pigment in those regions 222, 223, and 224 that need lightening. The amount of RMA which is applied is deliberately less than the calculated amount in order for the total amount to be deposited in multiple passes.

In this example, the volume of RMA is calculated to reduce reflectance by about 0.1 unit in the middle section. This simple distribution is selected to illustrate edge effects.

If the spray is turned on and off when the centerpoint $x_c$ of the pattern is precisely over $x_1$, $x_2$, $x_3$, etc. then an adjustment is made as described below.

For purposes of this example, the actual path of the RMA spray or drops is neglected, and it is assumed that a pattern is deposited instantaneously at the exact location of the "on" position. The example also assumes that the deposition stops at the exact location of the "off" position. In subsequent examples, the path of the RMA is predicted, and the on and off points are adjusted by this ballistic trajectory compensation.

Figure 33:
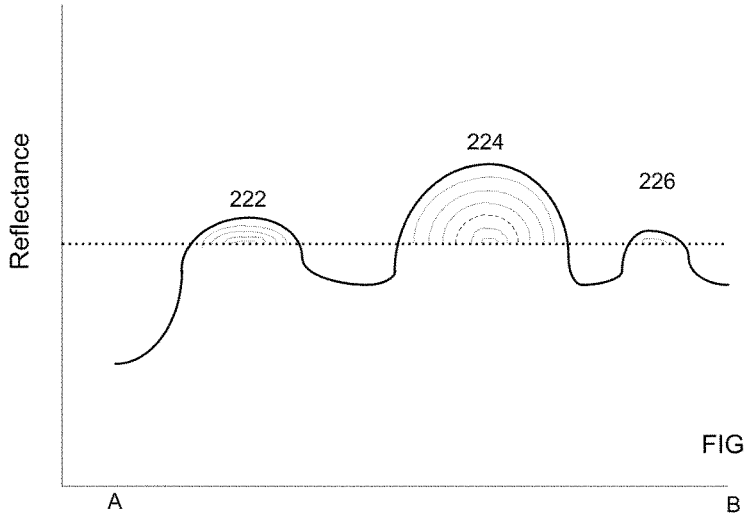
FIG. 33 is an example which shows the amount of lightening agent that may be applied in multiple passes in the example of FIG. 28C.

As the device is moved in a second cycle of A to B to A, the sensing and control logic is repeated. In the second pass, the region $x_1$ to $x_2$ has been corrected and does not need further adjustment. The region $x_3$ to $x_4$ has been narrowed to $x_7$ to $x_8$; and the region $x_5$ to $x_6$ has been narrowed to $x_9$ to $x_{10}$. In this example, this process is repeated for seven passes and all adjustments are made. FIG. 33 shows the amount of lightening that may applied, and the resulting modified reflectance of the region between Point A and Point B.

One lesson from this simple example is that it may be desirable to turn the device on and off at some offset from the actual points $x_1$, $x_2$, $x_3$ etc. so that there is not an overshoot at those points.

While it is possible to introduce a delay at $x_1$, it may not be practical to anticipate $x_2$ unless something is assumed about the pattern. This predictive ability based on the history is one aspect of the eraser type motion. By having traversed a region previously, the device can anticipate readings.

Example—Uniform Eraser-Type Motion with Offsets

This example uses the same reflectance attributes of the first example, but assumes that the distance between point A and point B is relatively long.

Figure 34:
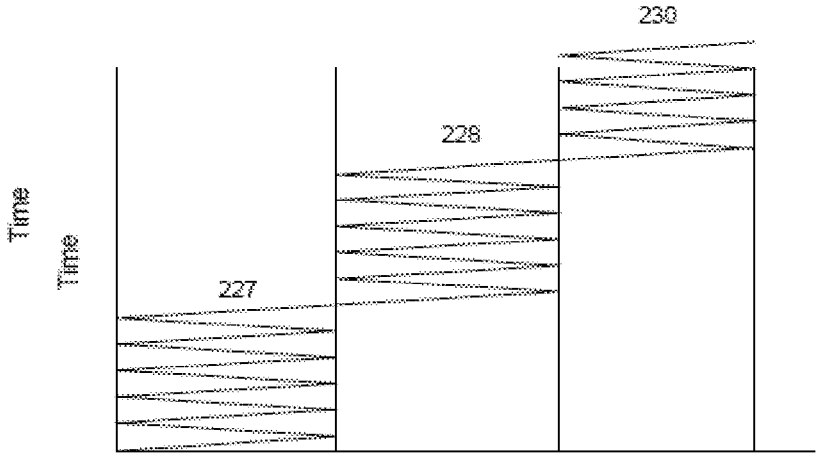
FIG. 34 is a plot of position versus time for an example of a first repetitive motion, then an offset followed by a second repetitive motion, then offset by a third repetitive motion.
Figure 35:
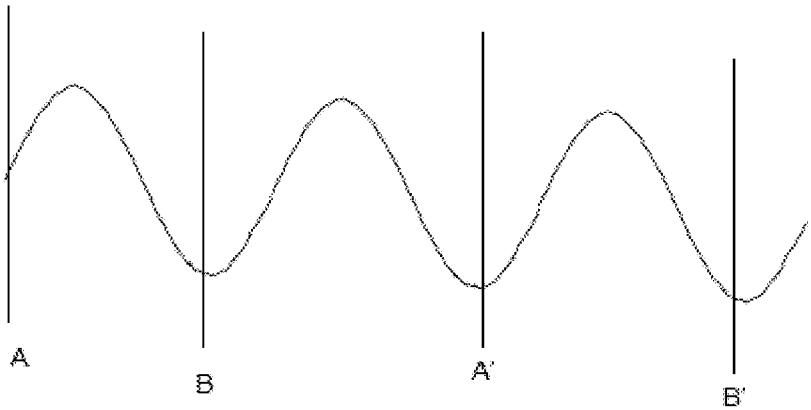
FIG. 35 is a plot of reflectance for a repetitive movement between points A and B in an example.

In this example, three sets of periodic motion are used as indicated in the FIG. 34. The figure represents a first repetitive motion 226, and offset followed by a second repetitive motion 228, then another offset followed by a third repetitive motion 230. In this example, the movement in each region is perfectly repetitive. This type of repetitive movement represents an instantaneous frequency as illustrated in FIG. 35.

Example 3—Non-Repetitive Motion

Figure 38:
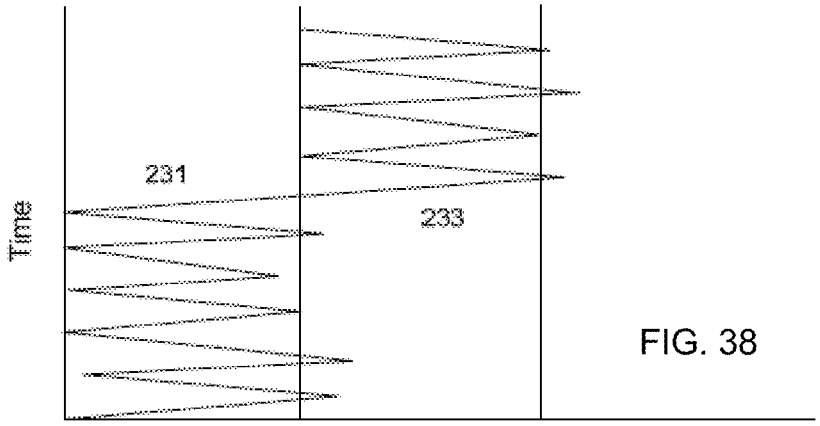
FIG. 38 is a plot of position versus time for an example of where the repetitive motion is not uniform.

In this example, movements in each region 231 and 233 are not perfectly repetitive. The end points A and B are not the same position on each cycle, such as shown in FIG. 38.

The previous examples have been reading in one direction, and then applying RMA as the device is moved in the opposite direction. Other control strategies may be employed. For instance, one variation is to occasionally skip a leg so that the direction of read and scan is periodically reversed.

Another variation is to read an entire cycle and then compare readings and apply RMA during the next cycle.

Ellipsoidal Movement

Figure 6A:
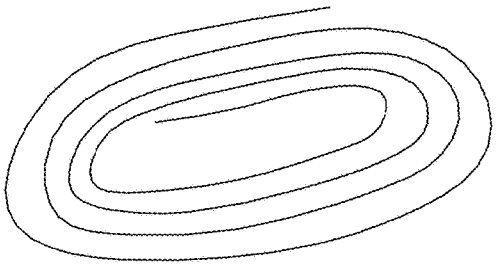
FIG. 6A is an example of a repetitive ellipsoidal path.

The previous examples have discussed a back-and-forth eraser type movement. Other movements are also possible. Another type of repetitive movement is an ellipsoidal path as illustrated in FIG. 6A.

Figure 6B:
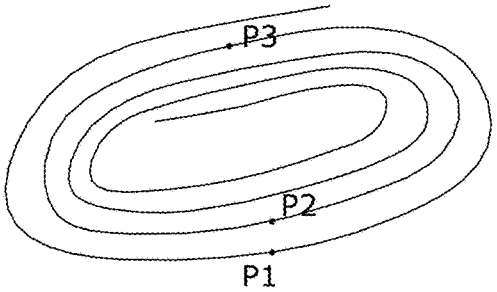
FIG. 6B is an example of a present point, full previous cycle, and half cycle points in the repetitive ellipsoidal path.

In an ellipsoidal path, predictive points at a particular point P1 include the point a full cycle back P2, and the point at half cycle back P3 as illustrated in FIG. 6B.

Determining Instantaneous Frequency

If there is a regular back-and-forth note movement, or other repetitive motions such as an ellipsoidal path, then it is possible to determine instantaneous frequency.

FIG. 46 illustrates a reflectance data for a path A-B-A'-B'-A" etc. In this case, the predicted path from A' to B' is the same as the path A-B. As long as the measured reflectance corresponds to what was measured in the previous path, it is possible to apply RMA with some degree of confidence.

Use of an Accelerometer

Figure 9B:
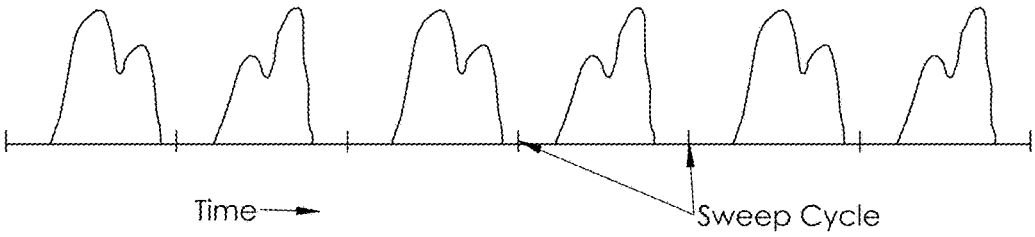
FIG. 9B is a chart that illustrates how an eraser brush's computer technology can phase lock to a repetitive signal and forward phase in anticipation to firing the deposition enough in advance to precisely hit a target frexel as the device swept over it.

In an embodiment, the head of the eraser brush includes at least one accelerometer 90, shown in FIG. 12, such as a miniature piezo unit to give very precise tracking of rapid movements of the eraser brush. This allows associated computer technology, for example the computer chips 80 shown in FIG. 10 and explained below, to sense rapid repetitive movement, and know its frequency and phase. If the user operates the apparatus as an eraser with rapid back and forth movements, the eraser brush's computer technology can phase lock to the repetitive signal and forward phase in anticipation, as shown in FIG. 9B, thereby firing the deposition enough in advance to precisely hit the target as the device swept over it.

In the anticipated mode, the need not be trained, rather the brush would be self training and fail safe. The software would sense two modes of operation, the first with slow movements and slow variation in measured reflectance, would operate in real time. The eraser brush would automatically exit this mode by any rapid acceleration so as not to deposit in the wrong spot. The second mode of operation would forward anticipate coverage using the phase lock approach. This would be the fastest as it would cover a slowly moving line rather than a slowly moving point, which is why such movement is a natural learned skill in driving an eraser. The eraser brush would automatically exit this mode by any rapid acceleration out of the oscillation, or if the phase lock prediction is not matching the actual measurement, as would happen if lateral motion becomes too fast. Without being able to do damage, the user would quickly acquire skill without training by "feeling," "seeing," and "hearing" which movements give the quickest erasure.

Method of Operation

Figure 14:
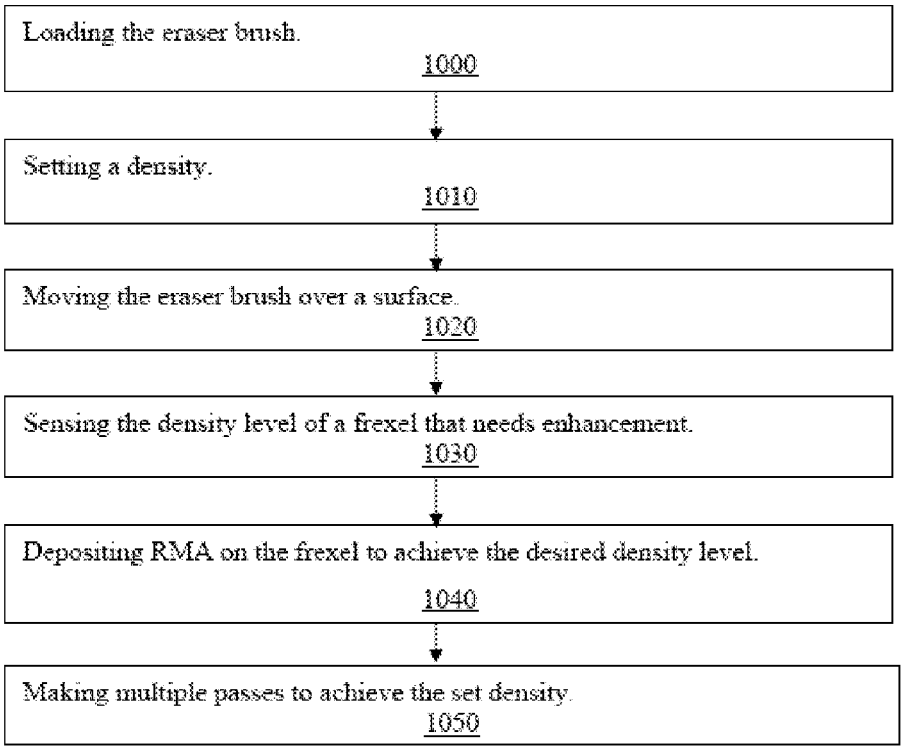
FIG. 14 is a flow chart that illustrates steps in the process of using an eraser brush.

The general steps of a method are illustrated in FIG. 14, with reference to an embodiment using LEDs, photocells, an airbrush technology, and an accelerometer as shown in FIGS. 10 and 12.

At Step 1000, the device is loaded with RMA for cosmetic enhancements. In an embodiment, a computer-controlled airbrush with an electronic valve is loaded with a highly differentiated RMA. At Step 1010, a density level is set that specifies the desired density to be achieved throughout the surface to be treated. In an embodiment, a density threshold may be preset in one or more computer chips 80, shown in FIG. 10, on the eraser brush. In another embodiment, a user aims the eraser brush at a select point of skin and depresses a "set" button to enter the density of that point of skin as the set density. For example, an eraser brush may be set to achieve certain such as a light or dark tan or various degrees of lightening. In another example, an eraser brush may be set to modify not just light or dark densities, but to modify other reflectance colors. At Step 1020, a user rapidly guides the eraser brush back and forth, like an eraser, over the area to be treated, as shown in FIG. 9A. The computer phase locks to the repetitive cycle from the photocell, and triggers the airbrush puffs in anticipation forward phased to cancel system lag, as shown in FIG. 9B. A piezo accelerometer 90, shown in FIG. 12, in the eraser brush aids locking. When predictability is compromised by excess lateral or random motion, the computer shuts out of erase mode to protect against mistakes. The user experiences the natural feel of erasing defects, and, protected by computer heuristics from doing wrong, quickly learns by feel how to do it fast. At Step 1030, the eraser brush's light sources 2, shown in FIG. 1, flash, and the sensors 4 sense the reflectance attributes of the frexels over which the eraser brush is being passed. In different embodiments, the following kinds of data about individual frexels may be acquired by the sensors 4 such as reflectance for light value and color characteristics; texture for topography, such as bumps and wrinkles; differential lighting for a single or multiple frexels; and mean illumination. At Step 1040, when the eraser brush is passed over a frexel that has been identified for enhancement, it deposits one or more RMAs on the frexel to give the frexel the desired shade of color. In an embodiment, when the eraser brush passes over a frexel of skin that is darker than the set density, an extremely small amount of the white pigment is deposited. In another embodiment, when the eraser brush passes over a frexel of skin that is lighter than the set density, an extremely small amount of the dark pigment is deposited. In still another embodiment comprising both light and dark pigments, light pigment may be applied to a dark frexel and dark pigment to a light frexel from the same eraser brush during a pass. At Step 1050, multiple passes are made to achieve the target density. For example, diluted cosmetics may be deposited to achieve a 1-5% opacity with each burst. Multiple passes of an area, like with an electric razor, enable full deposition, with continual refinement through sensing.

After a number of such passes, the amount deposited is just sufficient to modify the reflectance of the frexel to the desired density, and further passes elicit no further depositions on that frexel.

In operation, the device would feel like an eraser that is swept over the skin to erase age spots, varicose veins, and other defects and mottling. When programmed for angle, it would also partially erase bumps and skin irregularities. Like an electric razor, it would be self limiting, and the user could tell by sound and appearance that the operation was complete.

Figure 41:
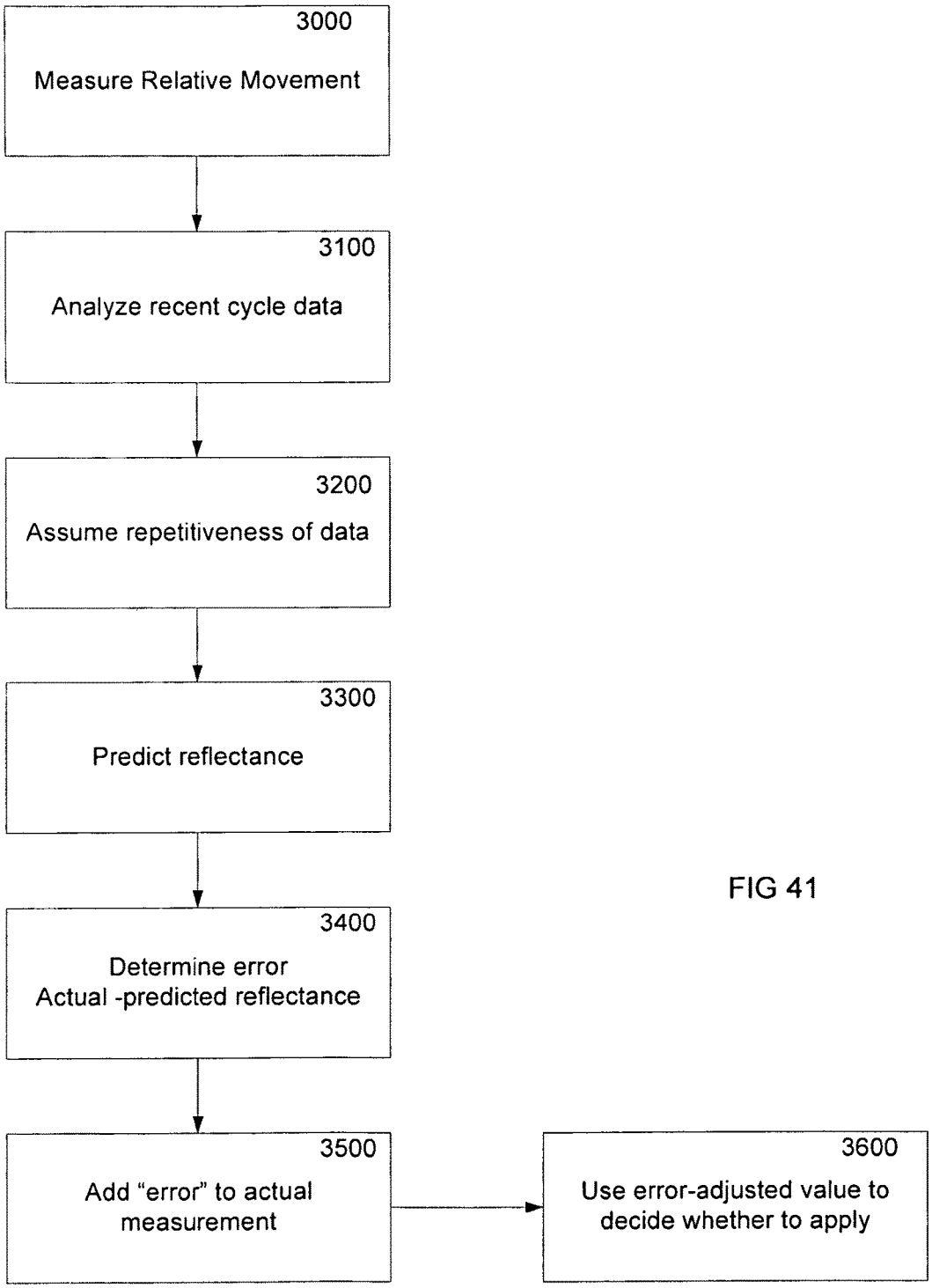
FIG. 41 is a general control flow chart.

FIG. 41 shows a general control flow chart. At step 3000, the device measures relative movement such as with one or more accelerometer. At step 3100, the device analyzes recent cycle data. At step 3200, the device determines whether there is repetitiveness of data. At step 3300, the device predicts reflectance based on the repetitiveness of recent historical data. At step 3400, the device determines the error, such as by subtracting predicted reflectance from actual reflectance. At step 3500, the actual reflectance reading is adjusted by the error, such as by adding the error. At step 3600, the device uses the error-adjusted value to decide whether to apply an RMA.

Description of Embodiment—Use of LEDs and Photodiodes to Provide Accurate Reflectance Measurements to Support Digital Control of Cosmetic Drop Control Deposition Device In this embodiment, a drop control deposition element, for example an inkjet technology, is controlled based on data obtained by a combination of LEDs and photodiodes as described above.

In this embodiment, the drop control deposition device does not print a complete image. Instead, it is used as a thin paint brush with more precise control, in a way that helps eliminate overspray of an area being enhanced through treatment with an RMA. Typically the drop control device deposits an ink or dye and is used in darkening techniques, which may achieve smoothing or tanning effects.

A spray control device typically deposits a substance through a single aperture in a Gaussian pattern, with a more concentrated amount of the substance in the center of the deposition and less concentrated amounts away from the center. Moreover, the spray is either on or off. With drop control technologies, it is possible to deposit a large number of drops simultaneously. For instance, multiple inkjet heads may be provided, and each head may have dozens or hundreds of individual inkjets. The individual inkjets on an inkjet head are each configurable and do not have to be all turned on at one time. As a result, an inkjet head may be operated to provide a uniform pattern of deposition or other patterns, as desired. Thus, inkjet heads with multiple inkjets are typically offer much more controllable depositions than spray control devices do.

Description of Embodiment—Spot Treatment Device

In this embodiment, the device is moved over one or more specific features of interest to the user rather than over larger skin areas.

Description of Embodiment—PhotoShop™ Simulations

PhotoShop provides a very powerful simulation capability which is used to evaluate various treatment strategies, error sensitivity, and process parameters.

In general, these simulations are performed according to the following method:

- Start with a natural and uncorrected image of a region of skin in approximately, such as on a face.
- Determine the contribution of shadowing to the image, and prepare an image of the skin that is independent of the shadowing.

Preferably operating in the green channel:

- Determine an "AIM" image, such as by using a 0.4 inch per side square area high pass filter.
- Determine an "ACTUAL" image blurred over a selected spot size, such as 1/15 inch diameter spot size.
- Determine the ACTUAL—AIM which represents a high pass filter and a band pass filter. In this example, the band pass is accomplished by two low pass filters—the high pass is the correction, the low pass is a median. Note that this filtering approach will selectively target middle spatial frequency skin features such as age spots. These actual filtering parameters can be adjusted as desired, such as to compare the results from various spot sizes and other parameters.
- Determine the RMA or cosmetic "color" to be applied. This can be close to actual skin color, but is preferably highly differentiated.
- Convert the ACTUAL—AIM image correction to cosmetic space to determine how much of the cosmetic is required to convert the ACTUAL to the AIM.
- Apply a selected deposition strategy such as
  - Determine the peaks, or the local maxima of the areas where cosmetic is to be applied. In this approach these peaks represent targets for a first pass deposition. In this example, the simulation will "apply" selected amounts of RMA.
  - View the simulated actual pulses with a 1/15 inch diameter. Note that this simulation does not deliberately introduce error in applying the RMA. As discussed below, other simulations do simulate error in deposition accuracy, and the results are surprisingly robust.
  - If desired, view the simulated pulses on a white background or magnified.
  - Add the simulated pulses to the skin image which was independent of shadowing.
  - Add the shadowing back to permit a comparison of the first pass corrected image to the initial image.
- Repeat this process as desired for additional passes.

Example—Dithering the Spot Deposition

In this example, Photoshop simulations were conducted using various spot sizes and various amounts of deliberate random error in spot location, or "dither". In this example, the dither pattern accepts a random seed. A different seed was selected for each pass, but the seed was constant for that pass in subsequent simulations in order to compare results. One surprising result of these simulations was that a significant benefit was achieved after only three passes with a 5% opacity RMA with a 1/15 inch dithered pulse. Although the total deposition could not exceed 15% (3 passes at a maximum of 5% per pass), the visual effect was good. In general, this type of simulation permits an analysis of acceptable error for various possible spot sizes, deposition amounts, and number of passes; particularly as those factors relate to the effective treatment of larger skin features.

PhotoShop™ and MatLab™ Simulation

In this example, a simulation was developed to permit a user to move a mouse while the display showed a region of a skin image. As the mouse caused the screen pointer to pass over an area a first time, a corrected image was provided which replaced pixels in the path of the mouse with corresponding pixels from the first pass PhotoShop simulation described above. As the mouse caused the screen pointer to pass over an area a second time, a corrected image was provided which replaced pixels in the path of the mouse with corresponding pixels from the second pass PhotoShop simulation. The end point of these simulations, but could be selected, and was typically to stop new depositions at the $5^{th}$ to $7^{th}$ pass. Most of the final correction had been performed by the $3^{rd}$ to $5^{th}$ pass. One interesting aspect of these simulations was the effectiveness of targeting specific areas of the skin, such as dark spots, with only a few passes, while making little or no correction to other areas of the skin image. Matlab™ routines were used to track the mouse movements and to build this simulation by accessing the PhotoShop uncorrected image and the first pass, second pass, etc. corrected images.

Description of Embodiment—Deposition Parameters

This description provides desired RMA deposition parameters in terms of mass per area and percent skin area covered.

Mass Per Area

Prior art cosmetic application densities are in the range of approximately 0.8-1.0 mg/sq. cm for liquid foundations; and 0.4 mg/sq. cm for powder foundations The total concentration of high refractive index particles, which is selected as a refractive index greater than 2.0 in this discussion, is approximately 10-12 percent for liquid foundations; and 20-25 percent for powder foundations.

Therefore, the total amount of high opacity particles that are laid on the skin is approximately the same for either liquid foundations or powder foundations and is in the range of 0.08-0.15 mg/sq.cm; or 80-150 micrograms per sq. cm.

The preferred range of application density in the current invention is preferably 0.1-40 micrograms/sq.cm;

more preferably 0.5-30 micrograms/sq.cm; and most preferably 1.0-20 micrograms/sq.cm.

The surprising result is that a superior masking of tonal imperfections is achieved from the use of between 0.07-20% of the amount that a typical foundation user applies. This low application density typically has a corresponding low opacity relative to conventional cosmetic treatment.

Percent Skin Area

In this discussion, "bare skin" is defined as any region of skin larger than 1.0 sq.mm for which the amount of high refractive index particles laying on the surface of the skin is less than 0.1 micrograms/sq.cm. This definition is used to distinguish the deliberate application of RMA to some portion of the area of skin versus minute overspray from a Gaussian or other spray distribution onto skin areas outside the intended spot area to be covered.

The preferred range of the percent area of the skin that is covered by high refractive index particles (RI>2.0) in the current invention is preferably less than 40 percent;

more preferably less than 30 percent; and most preferably less than 20 percent.

Figure 2:
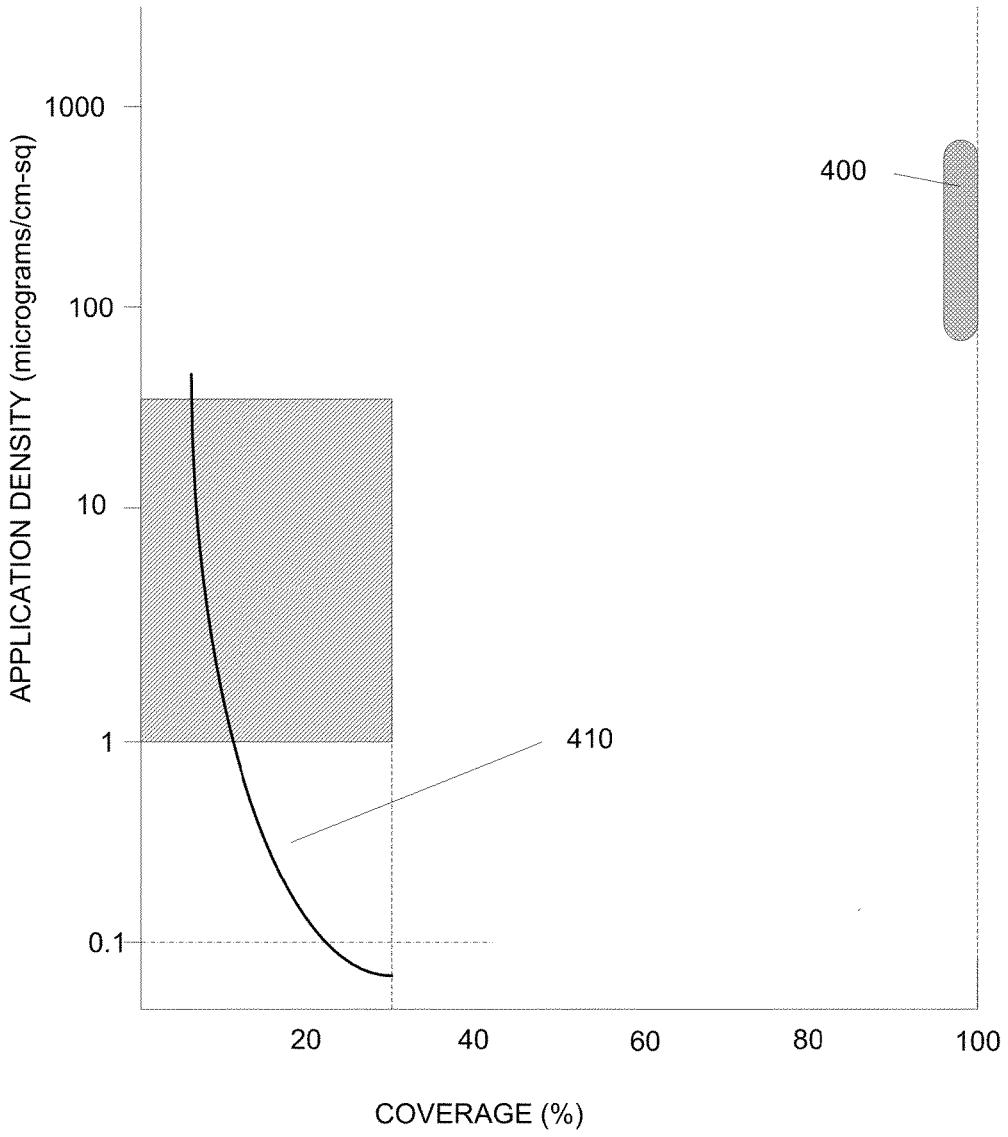
FIG. 2 is a graph of cosmetic or RMA application density versus skin coverage percent for a conventional base cosmetics treatment and a representative Eraser Brush treatment.

FIG. 2 compares the coverage (%) on the x-axis and the application density in the y-axis for conventional base cosmetics treatment 400 and a representative Eraser Brush treatment 410. The conventional base cosmetic treatment 400 is shown in the upper right corner of the graph with approximately 100% coverage over a skin area at a high refractive index particle application density of 80-150 micrograms per square centimeter. The 100% coverage is for a base cosmetic, and other cosmetics types added in addition to base, such as blush, may cover less area. Overall however, some cosmetic typically covers 100% of exposed skin, such as in a facial area.

The Eraser Brush treatment 410 is shown by a curve which extends from an application density of 1-20 micrograms per square centimeter of skin for less than 30% of the skin area. The y-axis is logarithmic. This figure is a two dimensional representation of the differences in how much RMA is applied, and where it is applied.

As noted in the discussion below, the difference between the current invention and prior art cosmetic treatment strategies can also extend to a third axis of what RMA is applied. Thus the three axes of what is applied (such as high luminance RMA); where it is applied (such as selectively to middle spatial frequency features), and how much is applied (such as at low opacity or application density) can be each be significantly different from conventional cosmetic practice. Although each of these axes may be selected independently, they are complementary and the use of all three techniques in combination provides a surprisingly effective result which preserves natural beauty while applying a minimum amount of cosmetic agent.

Devices of the current invention may be provided in accordance with these preferred ranges of application density percent area of the skin that is covered by high refractive index particles, by pre-programming the devices to thresholds consistent with these ranges. Although in some cases, a user may elect to modify the threshold, such a decision should be considered carefully in order to avoid compromising the appearance benefit.

One aspect of this approach is a relatively sparse distribution of RMA. A typical treatment according to the present invention is to apply RMA over a relatively small area of middle spatial frequency features and to not apply significant amounts of RMA over other areas. This approach leads to a treatment of isolated areas which are surrounded by untreated areas. This non-continuous application permits the use of compositions which might not otherwise be practical. For instance, there are various approaches to improving the durability of a cosmetic treatment by modifying existing cosmetic compositions. To the extent that these modifications can be felt by the user, such as feeling heavier or feeling like a continuous mask, the sparseness of the current invention makes those alternate compositions more practical that prior art deposition techniques and strategies.

The effects of the low mass deposition, the low opacity, and the sparse application include a more natural look and a more pleasant and natural feel to the user. One result of these factors is the feasibility of expanding the traditional color cosmetic market by providing stealth cosmetic treatments to men, children, and women who either do not use traditional cosmetics or who use those products sparingly. Another result of these factors is the ability to provide effective solutions for areas other than a face—such as for arms, legs, and upper torso.

Description of Embodiment—Highly Differentiated RMA

This description provides desired luminance properties of the RMA for highly differentiated RMA.

Example—Highly Differentiated RMA

Figure 15A:
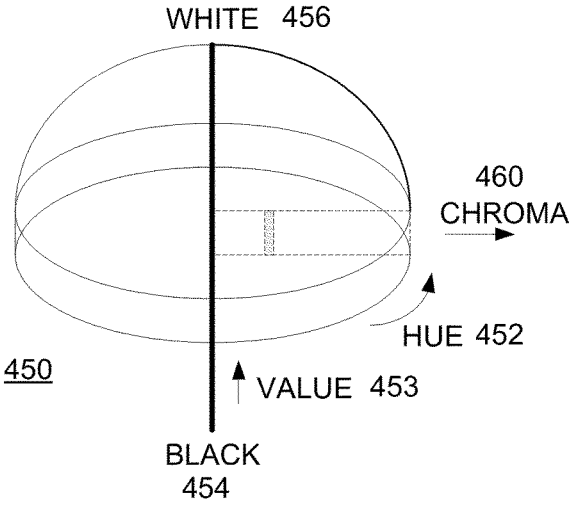
FIG. 15A is a representation of a Munsel color wheel.

FIG. 15A is a representation of a Munsel color wheel 450. The figure illustrates the three axes of the color wheel. Hue 452 is shown around the circumference of the wheel, and includes transitions through the primary colors and combinations, such as yellow, yellow-red, red, red-blue, etc. "Value", also termed "luminance" in this discussion, is shown on the vertical axis 453 between Black 454 and White 456. For a reddish hue for instance, high luminance would be pink and a lower luminance would be maroon. "Chroma" or strength of the hue is shown on the X-axis 460.

Figure 15B:
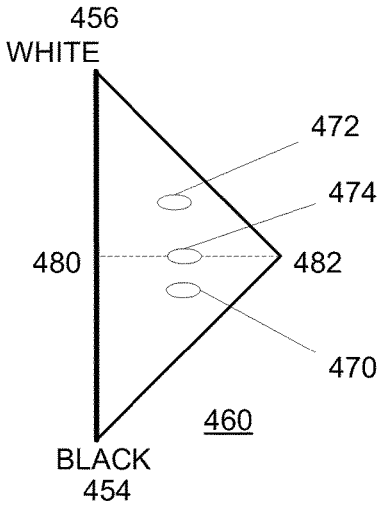
FIG. 15B is a wedge from the color wheel of FIG. 15A showing various skin chroma and luminance.

FIG. 15B is a wedge 460 from the Munsel wheel. In this example, the wedge represents typical reddish orange human skin hue and shows approximate regions for African skin 470, Caucasian 472, and an approximate world average of skin hue 474. As the figure indicates, there can be some differences in hue and chroma between different demographic groups, but the predominate difference is in "value" or "luminance". This wedge illustrates the range from low chromaticity (Grey) 480 on the left side to the high chromacity of reddish orange 482 on the right side. The human skin regions are typically near the middle of the wedge with respect to chroma. In this example, the "value" or "luminance" could be a value between 0 and 1, or a value between 0% and 100%, or in digital imaging art a value between 0 and 255. Hue is usually a value between 0 degrees and 360 degrees.

Figure 15C:
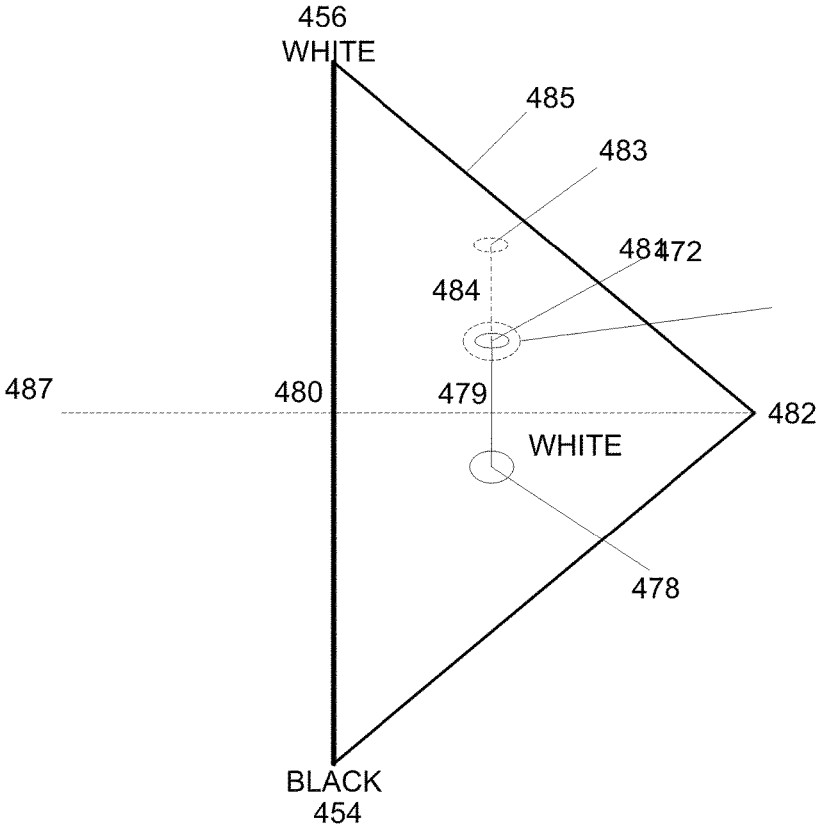
FIG. 15C is the wedge of FIG. 15B illustrating a highly differentiated RMA.

FIG. 15C shows the region of typical skin color for Caucasians 472 and a region of typical dark skin features 473 such as age spots. In this example, which is typical, the dark skin feature region 478 has approximately the same chromaticity—or relative distance along the grey/orange-red axis as the skin color. The correction vector 479 shown in FIG. 15C is a desired correction to change the appearance of a dark skin feature such as an age spot to that of surrounding skin. A conventional cosmetic treatment would be to apply a foundation 481 approximating the skin chromaticity and luminance to the age spot and to the surrounding skin. By contrast, the current invention permits the use of a highly differentiated RMA 483 which is selectively applied to the skin feature. Thus, far less RMA may be used in the current invention than with a conventional cosmetic coverage strategy such as the widespread use of liquid or powder foundation.

In this example, the highly differentiated RMA is selected to be in region 483 which is along the extension 484 of the correction vector 479, and is close to the upper right line 485. This line 485 represents 100% saturation in the red channel. Thus, the selected RMA will appear pinkish-red and will have more luminance than the target skin. By selecting an RMA that is closer to the red saturation, less RMA is required than with traditional cosmetic selection. Typically, a highly differentiated RMA will be 85% or greater saturation in the red channel.

In this example, the ability to selectively and precisely apply RMAs permits the choice of an RMA that has far more luminance than the target skin—and even less material is required to make a desired correction. As discussed in the Photoshop and lab skin tests below, an unexpected result of the current invention is how robust the current invention is with respect to factors such as spot size, spray distribution, and the accuracy of placement of the RMA. For example, one simulation result discussed below showed surprisingly good visual results with a peak RMA opacity of less than 15%. One factor in this result is that the highly differentiated RMA is very effective.

In this example, the highly differentiated RMA region 483 which was selected for Caucasian skin will also work effectively for darker African skin. However, in some cases, it may be desirable to select an RMA that is closer to the desired skin luminance. Some Asian skin, such as Chinese, frequently has a hue with more yellow or orange than Caucasian skin, but less chroma. Some Caucasian skin can be "white" (low chroma) or quite pink (higher chroma). The highly differentiated cosmetic preferably tracks the user's hue and chroma, even though differentiated in luminance. A typical highly differentiated RMA for these various skin hues and chroma follows the same approach as outlined in this example selecting the RMA for approximately the same hue and chroma, and with a substantially higher value or luminance.

Color Corrections for Features

Note that if the "defect" is red, then the straight line extrapolation of the correction vector still holds, but aims the highly differentiated cosmetic color to less red chroma, maybe even across the center line into cyan. Vericose veins, which are blue, may request a more red chroma. Thus ideally, the deposition would have two or more RMAs or cosmetics of different chroma or hue to print from. This combination of two or more RMAs permits a more robust or composite selection of highly differentiated RMA deposition for particular skin feature attributes.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for selectively applying a reflectance modifying agent to an area of skin while guided over the area of skin, the device comprising:

an applicator, the applicator being operable to selectively apply one or more reflectance modifying agents to frexels of the area of skin;

one or more sensors, the one or more sensors being responsive to illumination of areas of skin; and a computer that is coupled to the applicator and the one or more sensors, and that is operable to perform operations comprising:

determining attributes of a plurality of frexels in the area of skin based on input provided by the one or more sensors;

identifying a range of spatial frequencies within the area of skin;

differentiating between at least one middle spatial frequency feature and at least one high spatial frequency feature in the area of skin based on the attributes, the at least one middle spatial frequency feature being below a threshold corresponding to less than 40 percent of the range of the spatial frequencies and the at least one high spatial frequency feature being above the threshold;

determining a desired amount of a highly differentiated reflectance modifying agent (RMA) to apply to the middle spatial frequency feature, the highly differentiated RMA being an RMA that has a higher luminance than the area of skin;

determining deposition control parameters based on the desired amount; and instructing the applicator to selectively deposit the highly differentiated RMA to the at least one middle spatial frequency feature in the area of skin based on the deposition control parameters to provide a layer of the highly differentiated RMA that attenuates reflection from the at least one middle spatial frequency feature without attenuating the at least one high spatial frequency feature in the area of skin, such that a first percentage of the area of skin with attenuated reflection is smaller than a second percentage of the area of skin without attenuated reflection.

2. The device of claim 1 wherein the computer is operable to determine the desired amount of the highly differentiated RMA based on a preset density level for the highly differentiated RMA.

3. The device of claim 1 wherein the computer is operable to determine the desired amount of the highly differentiated RMA based on an average density for the area of skin.

4. The device of claim 1, further comprising:

a plurality of illuminators, at least one camera provided as a sensor of the one or more sensors, and a circular polarizing filter, wherein determining attributes of a plurality of frexels in the area of skin comprises:

obtaining at least one camera image with at least a portion of the illuminators illuminated, and analyzing the image to determine skin attributes for the plurality of frexels.

5. The device of claim 4 wherein the plurality of illuminators are light emitting diodes which illuminate in a green wavelength.

6. The device of claim 4 wherein analyzing the image to determine skin attributes for the plurality of frexels further comprises at least one of:

determining a reflectance of the plurality of frexels; and determining a surface texture of the plurality of frexels.

7. The device of claim 1, further comprising:

a plurality of light emitting diodes, and a plurality of photodiode sensors provided as sensors of the one or more sensors, wherein determining attributes of a plurality of frexels in the area of skin comprises:

sequencing the light emitting diodes through a plurality of illumination state combinations, obtaining at least one sensor reading for each illumination state combination, and analyzing the sensor readings to determine attributes for the plurality of frexels.

8. The device of claim 7 wherein sensing attributes of a plurality of frexels in the area of skin further comprises:

providing a device calibration to compensate for device height and device tilt relative to the area of skin;

obtaining a sensor reading for each illumination state combination; and determining a height of the device from the area of skin and a tilt of the device with respect to the area of skin, wherein the attributes are determined further based on the device calibration, the height and the tilt.

9. The device of claim 1 wherein, to determine a desired amount of the highly differentiated RMA, the computer is operable to perform further operations comprising:

determining a desired amount of a first RMA, such that the first RMA is lighter than the portion of the area of skin; and determining a desired amount of a second RMA, such that the second RMA is darker than the portion of the area of skin.

10. The device of claim 1 wherein, to determine a desired amount of the highly differentiated RMA, the computer is operable to perform further operations comprising:

determining a total desired amount of the highly differentiated RMA to be applied in multiple passes; and allocating a portion of the total desired amount for a single pass.

11. The device of claim 1 wherein, to determine a desired amount of the highly differentiated RMA, the computer is operable to perform further operations comprising determining a total amount of a RMA composition, such that the application density of high refractive index particles in the RMA composition is in the range of 0.1 to 40 micrograms per square centimeter of the area of skin.

12. The device of claim 1 wherein instructing the applicator to selectively deposit the highly differentiated RMA comprises instructing the applicator to apply high refractive index particles to less than 40 percent of the area of skin.

13. The device of claim 1 wherein determining desired deposition control parameters comprises determining when to begin a deposition event.

14. The device of claim 1 wherein determining desired deposition control parameters comprises determining a duration of a deposition event.

15. The device of claim 1 further comprising a drop control deposition element.

16. The device of claim 1 wherein the computer is further operable to perform operations comprising:

determining that repetitive data is provided;

predicting reflectance based on the repetitive data;

determining a difference between predicted reflectance and actual reflectance;

calculating an error-adjusted value by adding the difference between predicted reflectance and actual reflectance to actual reflectance; and using the error-adjusted value to decide whether to apply a RMA.

* * * * *